US007330681B2

(12) United States Patent
Okamoto

(10) Patent No.: US 7,330,681 B2
(45) Date of Patent: Feb. 12, 2008

(54) DEVELOPING DEVICE, IMAGE FORMING APPARATUS, AND IMAGE FORMING SYSTEM

(75) Inventor: Katsumi Okamoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 193 days.

(21) Appl. No.: 11/215,128

(22) Filed: Aug. 30, 2005

(65) Prior Publication Data

US 2006/0045569 A1 Mar. 2, 2006

(30) Foreign Application Priority Data

Aug. 30, 2004 (JP) ..... 2004-249869
Aug. 30, 2004 (JP) ..... 2004-249870
Aug. 30, 2004 (JP) ..... 2004-249871
Nov. 29, 2004 (JP) ..... 2004-344548

(51) Int. Cl.
*G03G 15/08* (2006.01)
*G03G 21/16* (2006.01)

(52) U.S. Cl. ..... 399/119; 399/111

(58) Field of Classification Search ..... 399/119, 399/111, 88, 227, 222; 347/138, 152
See application file for complete search history.

(56) References Cited

U.S. PATENT DOCUMENTS 4,743,938 A 5/1988 Ohno ..... 399/227
5,631,726 A 5/1997 Sawada
5,848,336 A 12/1998 Hazama et al.
6,151,459 A 11/2000 Hashimoto et al. ..... 399/27
6,473,580 B1 10/2002 Inomata ..... 399/167
6,823,160 B2 * 11/2004 Okabe ..... 399/222
7,027,756 B2 * 4/2006 Hoshi et al. ..... 399/111
7,224,924 B2 * 5/2007 Okamoto ..... 399/119
2002/0085857 A1 * 7/2002 Kim et al. ..... 399/119
2003/0156862 A1 8/2003 Nishimura
2004/0114961 A1 * 6/2004 Yoshino et al. ..... 399/119
2005/0180775 A1 * 8/2005 Okamoto ..... 399/119
2005/0207786 A1 * 9/2005 Askren et al. ..... 399/119

FOREIGN PATENT DOCUMENTS

EP 1 403 737 3/2004
EP 1 574 912 A2 9/2005
JP 03-125059 A 5/1991
JP 03-249780 11/1991
JP 08-248717 A 9/1996

(Continued)

*Primary Examiner*—Sophia S. Chen
(74) *Attorney, Agent, or Firm*—Hogan & Hartson LLP

(57) ABSTRACT

A developing device, an image forming apparatus, and an image forming system with which it is possible to appropriately perform developing operations are achieved. A developing device attachable to and detachable from a body of an image forming apparatus, is provided with: a developer bearing roller for bearing a developer; a first driving wheel that is provided on an end of the developer bearing roller and that is for driving the developer bearing roller; a second driving wheel that, in a state where the developing device is attached to the body of the image forming apparatus, receives a drive force from the body of the image forming apparatus and that transmits the drive force to the first driving wheel; and a positioning member that is made of metal and that is for positioning the first driving wheel and the second driving wheel.

38 Claims, 20 Drawing Sheets

FOREIGN PATENT DOCUMENTS

| | | |
|---|---|---|
| JP | 09-073260 | 3/1997 |
| JP | 10-069207 | 3/1998 |
| JP | 2001-228660 | 8/2001 |
| JP | 3366965 (B2) | 11/2002 |
| JP | 2003-029530 | 1/2003 |
| JP | 2003-195727 | 7/2003 |
| JP | 2003-280371 | 10/2003 |
| JP | 2004-191524 | 7/2004 |

* cited by examiner

DEVELOPING DEVICE, IMAGE FORMING APPARATUS, AND IMAGE FORMING SYSTEM

CROSS-REFERENCE TO RELATED APPLICATIONS

The present application claims priority upon Japanese Patent Application No. 2004-249869 filed on Aug. 30, 2004, Japanese Patent Application No. 2004-249870 filed on Aug. 30, 2004, Japanese Patent Application No. 2004-249871 filed on Aug. 30, 2004, and Japanese Patent Application No. 2004-344548 filed on Nov. 29, 2004, which are herein incorporated by reference.

BACKGROUND OF THE INVENTION

1. Field of the Invention

The present invention relates to developing devices, image forming apparatuses, and image forming systems.

2. Description of the Related Art (1) Image forming apparatuses such as laser beam printers are well known in the art. Such image forming apparatuses are provided with, for example, a photoconductor for bearing a latent image, and a developing device that is attachable to and detachable from the body of the image forming apparatus (or to/from a movable attach/detach section provided on the body of the image forming apparatus) and that is for developing the latent image borne on the photoconductor with a developer. When the image forming apparatus receives image signals etc. from an external device such as a host computer, it positions the developing device at a developing position which is in opposition to the photoconductor, develops the latent image borne on the photoconductor with the developer contained in the developing device to form a developer image, and transfers the developer image onto a medium to ultimately form an image on the medium.

In order to achieve, for example, the above-described function of developing the latent image borne on the photoconductor, the developing device of the above-described type is provided with a developer bearing roller for bearing the developer. The developing device develops the latent image borne on the photoconductor with the developer borne on the developer bearing roller.

The developing device is further provided with a first driving wheel that is provided on an end of the developer bearing roller for driving the roller, and a second driving wheel for transmitting a drive force to the first driving wheel. When the developing device is attached to the body of the image forming apparatus, the second driving wheel receives the drive force from the body of the image forming apparatus and transmits this drive force to the first driving wheel. The developer bearing roller is driven in this way. (See, for example, JP 2004-191524 A.)

It is, however, necessary for the first driving wheel and the second driving wheel to be positioned with high accuracy in order to appropriately drive the developer bearing roller. In developing devices in which the first driving wheel and the second driving wheel are not positioned with high accuracy, the developer bearing roller will not be driven appropriately, which may result in inappropriate developing operations.

(2) Another type of developing device is further provided with a positioning member for positioning the drive-system members such as the first driving wheel and the second driving wheel. This positioning member may be provided as two independent members (parts) in consideration of, for example, easy assembly of the developing device. The positioning member is provided with a positioning pin for positioning the developing device with respect to the body of the image forming apparatus when the developing device is attached thereto. (See, for example, JP 2004-191524 A.)

In order to let the developing device achieve appropriate developing operations, it is necessary to drive the developer bearing roller appropriately. On the other hand, in order to drive the developer bearing roller appropriately, it is necessary to design the developing device etc. so that the above-mentioned second driving wheel can appropriately receive the drive force from the body of the image forming apparatus.

In cases where the second driving wheel cannot appropriately receive the drive force from the body of the image forming apparatus, then it will become difficult for the second driving wheel to transmit a sufficient amount of drive force to the first driving wheel, which may cause inappropriate driving of the developer bearing roller and result in inappropriate developing operations.

(3) In order to achieve, for example, the above-described function of developing the latent image borne on the photoconductor, a developing device of another type has, in addition to the developer bearing roller for bearing the developer, a developer supplying roller for supplying the developer to the developer bearing roller. The developing device develops the latent image borne on the photoconductor with the developer supplied by the developer supplying roller and borne on the developer bearing roller.

The developer bearing roller and the developer supplying roller are mounted, respectively, on separate members, that is, an assembly member which is an example of a "first attachment member", and a housing which is an example of a "second attachment member". (See, for example, JP 2004-191524 A.)

In order to make the developer supplying roller appropriately achieve its function of supplying the developer to the developer bearing roller, it is necessary to position the developer supplying roller and the developer bearing roller with high accuracy. Further, it is preferable that this positioning is achieved with a simple structure.

(4) Furthermore, another type of developing device has a second gear wheel that meshes with a first gear wheel provided in the body of the image forming apparatus when the developing device, in a state attached to the attach/detach section, is moved up to a predetermined position along with the movement of the attach/detach section. The second gear wheel is supported by a second-gear-wheel shaft which, in turn, is supported on the body of the developing device by a supported section. (See, for example, JP 2001-228660 A.)

When the developing device is moved up to the above-mentioned predetermined position along with the movement of the attach/detach section, the first gear wheel and the second gear wheel come in to contact. At this time, the second-gear-wheel shaft may bend due to an external force applied through the second gear wheel.

SUMMARY OF THE INVENTION

The present invention has been made in light of the foregoing issues.

(1) A first object of the present invention is to achieve a developing device, an image forming apparatus, and an image forming system with which it is possible to achieve appropriate developing operations.

A first aspect of the present invention is a developing device attachable to and detachable from a body of an image forming apparatus, comprising: a developer bearing roller for bearing a developer; a first driving wheel that is provided on an end of the developer bearing roller and that is for driving the developer bearing roller; a second driving wheel that, in a state where the developing device is attached to the body of the image forming apparatus, receives a drive force from the body of the image forming apparatus and that transmits the drive force to the first driving wheel; and a positioning member that is made of metal and that is for positioning the first driving wheel and the second driving wheel.

(2) A second object of the present invention is to achieve a developing device, an image forming apparatus, and an image forming system with which it is possible to achieve appropriate developing operations.

A second aspect of the present invention is a developing device attachable to and detachable from a body of an image forming apparatus, comprising: a developer bearing roller for bearing a developer; a first driving wheel that is provided on an end of the developer bearing roller and that is for driving the developer bearing roller; a first positioning member for positioning the first driving wheel; a second driving wheel that, in a state where the developing device is attached to the body of the image forming apparatus, receives a drive force from the body of the image forming apparatus and that transmits the drive force to the first driving wheel; and a second positioning member that is for positioning the second driving wheel and that has a positioning pin for positioning the developing device with respect to the body of the image forming apparatus.

(3) A third object of the present invention is to achieve a developing device, an image forming apparatus, and an image forming system in which a developer supplying roller and a developer bearing roller are positioned with high accuracy through a simple structure.

A third aspect of the present invention is a developing device comprising: a developer bearing roller for bearing a developer; a first attachment member to which the developer bearing roller is attached; a developer supplying roller for supplying the developer to the developer bearing roller; a second attachment member to which the developer supplying roller is attached; and a first bearing for relatively positioning the first attachment member and the second attachment member and for receiving a shaft of the developer supplying roller.

(4) A fourth object of the present invention is to appropriately prevent bending of a second-gear-wheel shaft.

A fourth aspect of the present invention is a developing device attachable to and detachable from a movable attach/detach section provided in a body of an image forming apparatus, comprising: a second gear wheel that meshes with a first gear wheel provided in the body of the image forming apparatus when the developing device is in a state attached to the attach/detach section and when the developing device is moved to a predetermined position along with the movement of the attach/detach section; a second-gear-wheel shaft that is supported on a body of the developing device by a supported section and that supports the second gear wheel; and a cover that covers a portion of the second gear wheel and that supports a section of the second-gear-wheel shaft located on a side opposite from the side of the supported section with respect to the second gear wheel.

Other features and objects of the present invention will be made clear through the following description with reference to the accompanying drawings.

DETAILED DESCRIPTION OF THE INVENTION

Figure 1:
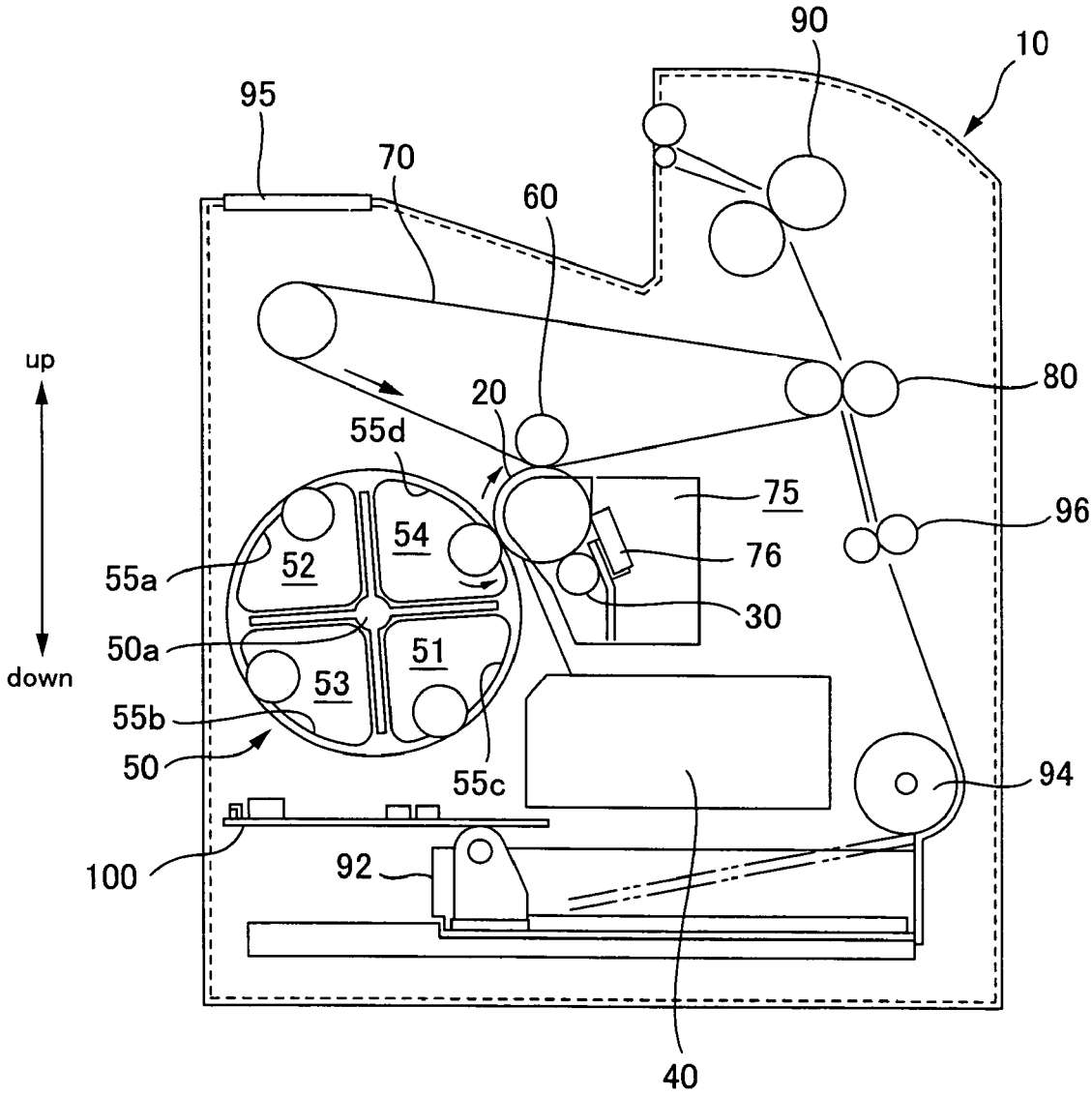
FIG. 1 is a diagram showing main structural components constructing a printer 10.

At least the following matters will become clear by the explanation in the present specification and the description of the accompanying drawings.

(1) A first aspect of the present invention is a developing device attachable to and detachable from a body of an image forming apparatus, comprising: a developer bearing roller for bearing a developer; a first driving wheel that is provided on an end of the developer bearing roller and that is for driving the developer bearing roller; a second driving wheel that, in a state where the developing device is attached to the body of the image forming apparatus, receives a drive force from the body of the image forming apparatus and that transmits the drive force to the first driving wheel; and a positioning member that is made of metal and that is for positioning the first driving wheel and the second driving wheel.

In this way, the first driving wheel and the second driving wheel are positioned with high accuracy, and thus the developer bearing roller is driven appropriately. Therefore, it is possible to achieve a developing device with which the developing operations can be performed appropriately.

Further, the developing device may have a third driving wheel that serves as a medium when the second driving wheel transmits the drive force to the first driving wheel; in a state where the developing device is attached to the body of the image forming apparatus, the second driving wheel may receive the drive force from the body of the image forming apparatus and transmit the drive force to the first driving wheel via the third driving wheel; and the third driving wheel may be positioned using the positioning member.

In this way, the first driving wheel, the second driving wheel, and the third driving wheel are positioned with high accuracy, and thus the developer bearing roller is driven appropriately. Therefore, it is possible to achieve a developing device with which the developing operations can be performed appropriately.

Further, the first driving wheel, the second driving wheel, and the third driving wheel may be a first driving gear wheel, a second driving gear wheel, and a third driving gear wheel, respectively; the positioning member may have a first supporting section for rotatably supporting the developer bearing roller, a second supporting section for rotatably supporting the second driving gear wheel, and a third supporting section for rotatably supporting the third driving gear wheel; the second driving gear wheel supported by the second supporting section may mesh with the third driving gear wheel supported by the third supporting section; and the third driving gear wheel may mesh with the first driving gear wheel that is provided on the developer bearing roller supported by the first supporting section.

In this way, the structure of the driving-system members is simplified.

Further, the developing device may have a developer supplying roller for supplying the developer to the developer bearing roller, and a fourth driving wheel that is provided on an end of the developer supplying roller and that is for driving the developer supplying roller; in a state where the developing device is attached to the body of the image forming apparatus, the second driving wheel may receive the drive force from the body of the image forming apparatus and transmit the drive force to the fourth driving wheel; and the fourth driving wheel may be positioned using the positioning member.

In this way, the fourth driving wheel is positioned with high accuracy, and thus the developer supplying roller is driven appropriately. Therefore, it is possible to achieve a developing device with which the developing operations can be performed appropriately.

Further, the first driving wheel, the second driving wheel, the third driving wheel, and the fourth driving wheel may be a first driving gear wheel, a second driving gear wheel, a third driving gear wheel, and a fourth driving gear wheel, respectively; the positioning member may have a first supporting section for rotatably supporting the developer bearing roller, a second supporting section for rotatably supporting the second driving gear wheel, a third supporting section for rotatably supporting the third driving gear wheel, and a fourth supporting section for rotatably supporting the developer supplying roller; the second driving gear wheel supported by the second supporting section may mesh with the third driving gear wheel supported by the third supporting section; the third driving gear wheel may mesh with the first driving gear wheel that is provided on the developer bearing roller supported by the first supporting section; and the first driving gear wheel may mesh with the fourth driving gear wheel that is provided on the developer supplying roller supported by the fourth supporting section.

In this way, the structure of the driving-system members is simplified.

Further, the positioning member may have a positioning pin for positioning the developing device with respect to the body of the image forming apparatus.

In this way, the developer bearing roller etc. is driven even more appropriately.

Further, it is also possible to achieve a developing device attachable to and detachable from a body of an image forming apparatus, comprising: a developer bearing roller for bearing a developer; a first driving wheel that is provided on an end of the developer bearing roller and that is for driving the developer bearing roller; a second driving wheel that, in a state where the developing device is attached to the body of the image forming apparatus, receives a drive force from the body of the image forming apparatus and that transmits the drive force to the first driving wheel; and a positioning member that is made of metal and that is for positioning the first driving wheel and the second driving wheel; wherein the developing device has a third driving wheel that serves as a medium when the second driving wheel transmits the drive force to the first driving wheel; wherein, in a state where the developing device is attached to the body of the image forming apparatus, the second driving wheel receives the drive force from the body of the image forming apparatus and transmits the drive force to the first driving wheel via the third driving wheel; wherein the third driving wheel is positioned using the positioning member; wherein the developing device has a developer supplying roller for supplying the developer to the developer bearing roller, and a fourth driving wheel that is provided on an end of the developer supplying roller and that is for driving the developer supplying roller; wherein, in a state where the developing device is attached to the body of the image forming apparatus, the second driving wheel receives the drive force from the body of the image forming apparatus and transmits the drive force to the fourth driving wheel; wherein the fourth driving wheel is positioned using the positioning member; wherein the first driving wheel, the second driving wheel, the third driving wheel, and the fourth driving wheel are a first driving gear wheel, a second driving gear wheel, a third driving gear wheel, and a fourth driving gear wheel, respectively; wherein the positioning member has a first supporting section for rotatably supporting the developer bearing roller, a second supporting section for rotatably supporting the second driving gear wheel, a third supporting section for rotatably supporting the third driving gear wheel, and a fourth supporting section for rotatably supporting the developer supplying roller; wherein the second driving gear wheel supported by the second supporting section meshes with the third driving gear wheel supported by the third supporting section; wherein the third driving gear wheel meshes with the first driving gear wheel that is provided on the developer bearing roller supported by the first supporting section; wherein the first driving gear wheel meshes with the fourth driving gear wheel that is provided on the developer supplying roller supported by the fourth supporting section; and wherein the positioning member has a positioning pin for positioning the developing device with respect to the body of the image forming apparatus.

In this way, the object of the present invention is achieved more effectively because all of the above-described effects can be attained.

Further, it is also possible to achieve an image forming apparatus comprising: a body of the image forming apparatus; and a developing device that has: a developer bearing roller for bearing a developer; a first driving wheel that is provided on an end of the developer bearing roller and that is for driving the developer bearing roller; a second driving wheel that receives a drive force from the body of the image forming apparatus and that transmits the drive force to the first driving wheel; and a positioning member that is made of metal and that is for positioning the first driving wheel and the second driving wheel.

In this way, the first driving wheel and the second driving wheel are positioned with high accuracy, and thus the developer bearing roller is driven appropriately. Therefore, it is possible to achieve an image forming apparatus with which the developing operations can be performed appropriately.

Further, the positioning member may have a positioning pin for positioning the developing device with respect to the body of the image forming apparatus; the body of the image forming apparatus may have a fitting hole into which the positioning pin can fit, and an other driving wheel that gives the drive force to the second driving wheel; the developing device may be positioned with respect to the body of the image forming apparatus by fitting the positioning pin into the fitting hole; and the second driving wheel may receive the drive force from the other driving wheel and transmit the drive force to the first driving wheel.

In this way, the other driving wheel and the second driving wheel are positioned with high accuracy, and thus the developer bearing roller etc. is driven even more appropriately.

Further, it is also possible to achieve an image forming system comprising: a computer; and an image forming apparatus that is connectable to the computer and that includes: a body of the image forming apparatus; and a developing device that has: a developer bearing roller for bearing a developer; a first driving wheel that is provided on an end of the developer bearing roller and that is for driving the developer bearing roller; a second driving wheel that receives a drive force from the body of the image forming apparatus and that transmits the drive force to the first driving wheel; and a positioning member that is made of metal and that is for positioning the first driving wheel and the second driving wheel.

In this way, the first driving wheel and the second driving wheel are positioned with high accuracy, and thus the developer bearing roller is driven appropriately. Therefore, it is possible to achieve an image forming system with which the developing operations can be performed appropriately.

(2) A second aspect of the present invention is a developing device attachable to and detachable from a body of an image forming apparatus, comprising: a developer bearing roller for bearing a developer; a first driving wheel that is provided on an end of the developer bearing roller and that is for driving the developer bearing roller; a first positioning member for positioning the first driving wheel; a second driving wheel that, in a state where the developing device is attached to the body of the image forming apparatus, receives a drive force from the body of the image forming apparatus and that transmits the drive force to the first driving wheel; and a second positioning member that is for positioning the second driving wheel and that has a positioning pin for positioning the developing device with respect to the body of the image forming apparatus.

In this way, the second driving wheel can receive the drive force more appropriately from the body of the image forming apparatus, and can therefore transmit a sufficient amount of drive force to the first driving wheel. Therefore, it is possible to achieve a developing device with which the developer bearing roller is driven appropriately and developing operations can be performed appropriately.

Further, the developing device may have a third driving wheel that serves as a medium when the second driving wheel transmits the drive force to the first driving wheel; in a state where the developing device is attached to the body of the image forming apparatus, the second driving wheel may receive the drive force from the body of the image forming apparatus and transmit the drive force to the first driving wheel via the third driving wheel; and the third driving wheel may be positioned using the first positioning member.

In this way, the second driving wheel can receive the drive force more appropriately from the body of the image forming apparatus, and can therefore transmit a sufficient amount of drive force to the first driving wheel via the third driving wheel. Therefore, the developer bearing roller is driven appropriately and developing operations can be performed appropriately.

Further, the first driving wheel, the second driving wheel, and the third driving wheel may be a first driving gear wheel, a second driving gear wheel, and a third driving gear wheel, respectively; the first positioning member may have a first supporting section for rotatably supporting the developer bearing roller, and a third supporting section for rotatably supporting the third driving gear wheel; the second positioning member has a second supporting section for rotatably supporting the second driving gear wheel; the second driving gear wheel supported by the second supporting section may mesh with the third driving gear wheel supported by the third supporting section; and the third driving gear wheel may mesh with the first driving gear wheel that is provided on the developer bearing roller supported by the first supporting section.

In this way, the structure of the driving-system members is simplified.

Further, the first supporting section of the first positioning member may rotatably support the developer bearing roller via a developing-roller bearing; the second positioning member may have a supporting-section fitting hole into which the third supporting section of the first positioning member can fit, and a bearing fitting hole into which the developing-roller bearing can fit; and the first positioning member and the second positioning member may be positioned by fitting the third supporting section into the supporting-section fitting hole and fitting the developing-roller bearing into the bearing fitting hole.

Further, it is also possible to achieve a developing device attachable to and detachable from a body of an image forming apparatus, comprising: a developer bearing roller for bearing a developer; a first driving wheel that is provided on an end of the developer bearing roller and that is for driving the developer bearing roller; a first positioning member for positioning the first driving wheel; a second driving wheel that, in a state where the developing device is attached to the body of the image forming apparatus, receives a drive force from the body of the image forming apparatus and that transmits the drive force to the first driving wheel; and a second positioning member that is for positioning the second driving wheel and that has a positioning pin for positioning the developing device with respect to the body of the image forming apparatus; wherein the developing device has a third driving wheel that serves as a medium when the second driving wheel transmits the drive force to the first driving wheel; wherein, in a state where the developing device is attached to the body of the image forming apparatus, the second driving wheel receives the drive force from the body of the image forming apparatus and transmits the drive force to the first driving wheel via the third driving wheel; wherein the third driving wheel is positioned using the first positioning member; wherein the first driving wheel, the second driving wheel, and the third driving wheel are a first driving gear wheel, a second driving gear wheel, and a third driving gear wheel, respectively; wherein the first positioning member has a first supporting section for rotatably supporting the developer bearing roller, and a third supporting section for rotatably supporting the third driving gear wheel; wherein the second positioning member has a second supporting section for rotatably supporting the second driving gear wheel; wherein the second driving gear wheel supported by the second supporting section meshes with the third driving gear wheel supported by the third supporting section; wherein the third driving gear wheel meshes with the first driving gear wheel that is provided on the developer bearing roller supported by the first supporting section; wherein the first supporting section of the first positioning member rotatably supports the developer bearing roller via a developing-roller bearing; wherein the second positioning member has a supporting-section fitting hole into which the third supporting section of the first positioning member can fit, and a bearing fitting hole into which the developing-roller bearing can fit; and wherein the first positioning member and the second positioning member are positioned by fitting the third supporting section into the supporting-section fitting hole and fitting the developing-roller bearing into the bearing fitting hole.

In this way, the object of the present invention is achieved more effectively because all of the above-described effects can be attained.

Further, it is also possible to achieve an image forming apparatus comprising: a body of the image forming apparatus; and a developing device that has: a developer bearing roller for bearing a developer; a first driving wheel that is provided on an end of the developer bearing roller and that is for driving the developer bearing roller; a first positioning member for positioning the first driving wheel; a second driving wheel that receives a drive force from the body of the image forming apparatus and that transmits the drive force to the first driving wheel; and a second positioning member that is for positioning the second driving wheel and that has a positioning pin for positioning the developing device with respect to the body of the image forming apparatus.

In this way, the second driving wheel can receive the drive force more appropriately from the body of the image forming apparatus, and can therefore transmit a sufficient amount of drive force to the first driving wheel. Therefore, it is possible to achieve an image forming apparatus with which the developer bearing roller is driven appropriately and developing operations can be performed appropriately.

Further, the body of the image forming apparatus may have an apparatus-side fitting hole into which the positioning pin can fit, and an other driving wheel that gives the drive force to the second driving wheel; the developing device may be positioned with respect to the body of the image forming apparatus by fitting the positioning pin into the apparatus-side fitting hole; and the second driving wheel may receive the drive force from the other driving wheel and transmit the drive force to the first driving wheel.

In this way, the second driving wheel can receive the drive force more appropriately from the other driving wheel, and can therefore transmit a sufficient amount of drive force to the first driving wheel. Therefore, an image forming apparatus with which the developer bearing roller is driven appropriately and developing operations can be performed appropriately is achieved.

Further, it is also possible to achieve an image forming system comprising: a computer; and an image forming apparatus that is connectable to the computer and that includes: a body of the image forming apparatus; and a developing device that has: a developer bearing roller for bearing a developer; a first driving wheel that is provided on an end of the developer bearing roller and that is for driving the developer bearing roller; a first positioning member for positioning the first driving wheel; a second driving wheel that receives a drive force from the body of the image forming apparatus and that transmits the drive force to the first driving wheel; and a second positioning member that is for positioning the second driving wheel and that has a positioning pin for positioning the developing device with respect to the body of the image forming apparatus.

In this way, the second driving wheel can receive the drive force more appropriately from the body of the image forming apparatus, and can therefore transmit a sufficient amount of drive force to the first driving wheel. Therefore, it is possible to achieve an image forming system with which the developer bearing roller is driven appropriately and developing operations can be performed appropriately.

(3) A third aspect of the present invention is a developing device comprising: a developer bearing roller for bearing a developer; a first attachment member to which the developer bearing roller is attached; a developer supplying roller for supplying the developer to the developer bearing roller; a second attachment member to which the developer supplying roller is attached; and a first bearing for relatively positioning the first attachment member and the second attachment member and for receiving a shaft of the developer supplying roller.

In this way, it becomes possible to achieve a developing device in which the developer supplying roller and the developer bearing roller are positioned with high accuracy using a simple structure.

Further, the first attachment member and the second attachment member may have, respectively, a first fitting hole and a second fitting hole into which the first bearing can fit; the developer supplying roller may be rotatably supported by the second attachment member via the first bearing that is fitted into the second fitting hole; and the first attachment member and the second attachment member may be relatively positioned by fitting the first bearing that is fitted into the second fitting hole also into the first fitting hole.

Further, the developing device may have a second bearing for receiving a shaft of the developer bearing roller; the first attachment member may have a third fitting hole into which the second bearing can fit; and the developer bearing roller may be rotatably supported by the first attachment member via the second bearing that is fitted into the third fitting hole.

Further, the developing device may have, as the first bearing, a one-end-side first bearing positioned on a side of one end, in a longitudinal direction, of the developing device, and an other-end-side first bearing positioned on a side of the other end, in the longitudinal direction, of the developing device; the second attachment member may have, as the second fitting hole, a one-end-side second fitting hole into which the one-end-side first bearing can fit, and an other-end-side second fitting hole into which the other-end-side first bearing can fit; the developer supplying roller may be rotatably supported by the second attachment member via the one-end-side first bearing that is fitted into the one-end-side second fitting hole and the other-end-side first bearing that is fitted into the other-end-side second fitting hole; the developing device may have, as the second bearing, a one-end-side second bearing positioned on the side of one end, in the longitudinal direction, of the developing device, and an other-end-side second bearing positioned on the side of the other end, in the longitudinal direction, of the developing device; the first attachment member may have, as the third fitting hole, a one-end-side third fitting hole into which the one-end-side second bearing can fit, and an other-end-side third fitting hole into which the other-end-side second bearing can fit; the developer bearing roller may be rotatably supported by the first attachment member via the one-end-side second bearing that is fitted into the one-end-side third fitting hole and the other-end-side second bearing that is fitted into the other-end-side third fitting hole; the first attachment member may have, only on the side of one end of the developing device in the longitudinal direction, the first fitting hole into which the one-end-side first bearing can fit; and the first attachment member and the second attachment member may relatively be positioned by fitting the one-end-side first bearing that is fitted into the one-end-side second fitting hole also into the first fitting hole.

Further, on the side of one end of the developing device in the longitudinal direction, a pin may be provided on either one of the first attachment member and the second attachment member, and a fourth fitting hole into which the pin can fit may be provided in the other of the first attachment member and the second attachment member; and the pin may be fitted into the fourth fitting hole.

In this way, the positioning of the first attachment member and the second attachment member becomes even more reliable.

Further, the developing device may have, on the side of the other end of the developing device in the longitudinal direction, an other-end-side positioning member for relatively positioning the other-end-side first bearing and the other-end-side second bearing.

In this way, the positioning of the developer supplying roller and the developer bearing roller becomes even more reliable.

Further, it is also possible to achieve a developing device comprising: a developer bearing roller for bearing a developer; a first attachment member to which the developer bearing roller is attached; a developer supplying roller for supplying the developer to the developer bearing roller; a second attachment member to which the developer supplying roller is attached; and a first bearing for relatively positioning the first attachment member and the second attachment member and for receiving a shaft of the developer supplying roller; wherein the first attachment member and the second attachment member have, respectively, a first fitting hole and a second fitting hole into which the first bearing can fit; wherein the developer supplying roller is rotatably supported by the second attachment member via the first bearing that is fitted into the second fitting hole; wherein the first attachment member and the second attachment member are relatively positioned by fitting the first bearing that is fitted into the second fitting hole also into the first fitting hole; wherein the developing device has a second bearing for receiving a shaft of the developer bearing roller; wherein the first attachment member has a third fitting hole into which the second bearing can fit; wherein the developer bearing roller is rotatably supported by the first attachment member via the second bearing that is fitted into the third fitting hole; wherein the developing device has, as the first bearing, a one-end-side first bearing positioned on a side of one end, in a longitudinal direction, of the developing device, and an other-end-side first bearing positioned on a side of the other end, in the longitudinal direction, of the developing device; wherein the second attachment member has, as the second fitting hole, a one-end-side second fitting hole into which the one-end-side first bearing can fit, and an other-end-side second fitting hole into which the other-end-side first bearing can fit; wherein the developer supplying roller is rotatably supported by the second attachment member via the one-end-side first bearing that is fitted into the one-end-side second fitting hole and the other-end-side first bearing that is fitted into the other-end-side second fitting hole; wherein the developing device has, as the second bearing, a one-end-side second bearing positioned on the side of one end, in the longitudinal direction, of the developing device, and an other-end-side second bearing positioned on the side of the other end, in the longitudinal direction, of the developing device; wherein the first attachment member has, as the third fitting hole, a one-end-side third fitting hole into which the one-end-side second bearing can fit, and an other-end-side third fitting hole into which the other-end-side second bearing can fit; wherein the developer bearing roller is rotatably supported by the first attachment member via the one-end-side second bearing that is fitted into the one-end-side third fitting hole and the other-end-side second bearing that is fitted into the other-end-side third fitting hole; wherein the first attachment member has, only on the side of one end of the developing device in the longitudinal direction, the first fitting hole into which the one-end-side first bearing can fit; wherein the first attachment member and the second attachment member are relatively positioned by fitting the one-end-side first bearing that is fitted into the one-end-side second fitting hole also into the first fitting hole; wherein, on the side of one end of the developing device in the longitudinal direction, a pin is provided on either one of the first attachment member and the second attachment member, and a fourth fitting hole into which the pin can fit is provided in the other of the first attachment member and the second attachment member; wherein the pin is fitted into the fourth fitting hole; and wherein the developing device has, on the side of the other end of the developing device in the longitudinal direction, an other-end-side positioning member for relatively positioning the other-end-side first bearing and the other-end-side second bearing.

In this way, the object of the present invention is achieved more effectively because all of the above-described effects can be attained.

Further, it is also possible to achieve an image forming apparatus comprising: a developing device that has: a developer bearing roller for bearing a developer; a first attachment member to which the developer bearing roller is attached; a developer supplying roller for supplying the developer to the developer bearing roller; a second attachment member to which the developer supplying roller is attached; and a first bearing for relatively positioning the first attachment member and the second attachment member and for receiving a shaft of the developer supplying roller.

In this way, it becomes possible to achieve an image forming apparatus in which the developer supplying roller and the developer bearing roller are positioned with high accuracy using a simple structure.

Further, it is also possible to achieve an image forming system comprising: a computer; and an image forming apparatus that is connectable to the computer and that includes: a developing device that has: a developer bearing roller for bearing a developer; a first attachment member to which the developer bearing roller is attached; a developer supplying roller for supplying the developer to the developer bearing roller; a second attachment member to which the developer supplying roller is attached; and a first bearing for relatively positioning the first attachment member and the second attachment member and for receiving a shaft of the developer supplying roller.

In this way, it becomes possible to achieve an image forming system in which the developer supplying roller and the developer bearing roller are positioned with high accuracy using a simple structure.

(4) A fourth aspect of the present invention is a developing device attachable to and detachable from a movable attach/detach section provided in a body of an image forming apparatus, comprising: a second gear wheel that meshes with a first gear wheel provided in the body of the image forming apparatus when the developing device is in a state attached to the attach/detach section and when the developing device is moved to a predetermined position along with the movement of the attach/detach section; a second-gear-wheel shaft that is supported on a body of the developing device by a supported section and that supports the second gear wheel; and a cover that covers a portion of the second gear wheel and that supports a section of the second-gear-wheel shaft located on a side opposite from the side of the supported section with respect to the second gear wheel.

In this way, since the rigidity of the second-gear-wheel shaft is increased due to the second-gear-wheel shaft being supported by a so-called dual-support, it becomes possible to appropriately prevent bending of the second-gear-wheel shaft.

Further, in this developing device, the cover may have a shaft-supporting section that supports the section of the second-gear-wheel shaft located on the side opposite from the side of the supported section with respect to the second gear wheel, and that restricts movement of the second gear wheel in a direction from the supported section toward the section on the opposite side (which is referred to as "fall-out direction").

In order to prevent the second gear wheel from moving in the fall-out direction and falling out from the second-gear-wheel shaft, it is preferable to provide a member for restricting movement of the second gear wheel in the fall-out direction. By providing the cover with the shaft-supporting section that has the function of supporting the second-gear-wheel shaft as well as the function of restricting the movement of the second gear wheel in the fall-out direction, it is not necessary to separately provide a member for restricting the movement of the second gear wheel in the fall-out direction, and thus, it is possible to achieve a reduction in the number of structural components.

Further, in this developing device, the supported section may be provided on a side of one end of the second-gear-wheel shaft; and the shaft-supporting section of the cover may support a side of the other end of the second-gear-wheel shaft.

Further, in this developing device, the developing device may have a third gear wheel that meshes with the second gear wheel, and a third-gear-wheel shaft that is supported on the body of the developing device by a second supported section and that supports the third gear wheel.

In such a configuration, the second gear wheel and the third gear wheel may not mesh appropriately when the second-gear-wheel shaft is bent. However, by supporting the second-gear-wheel shaft with the cover, bending of the second-gear-wheel shaft is prevented, and thus, it becomes possible to make the second gear wheel and the third gear wheel mesh with one another appropriately.

Further, in this developing device, the cover may support a section of the third-gear-wheel shaft located on a side opposite from the side of the second supported section with respect to the third gear wheel.

In this way, since the rigidity of the third-gear-wheel shaft is increased due to the third-gear-wheel shaft being supported at both ends with respect to the third gear wheel, that is, supported by a so-called dual-support, it becomes possible to prevent bending of the third-gear-wheel shaft.

Further, in this developing device, the cover may have a second shaft-supporting section that supports the section of the third-gear-wheel shaft located on the side opposite from the side of the second supported section with respect to the third gear wheel, and that restricts movement of the third gear wheel in a direction from the second supported section toward the section on the opposite side (which is referred to as "second fall-out direction").

In order to prevent the third gear wheel from moving in the second fall-out direction and falling out from the third-gear-wheel shaft, it is preferable to provide a member for restricting movement of the third gear wheel in the second fall-out direction. By providing the cover with the second shaft-supporting section that has the function of supporting the third-gear-wheel shaft as well as the function of restricting the movement of the third gear wheel in the second fall-out direction, it is not necessary to separately provide a member for restricting the movement of the third gear wheel in the second fall-out direction, and thus, it is possible to achieve a reduction in the number of structural components.

Further, in this developing device, the shaft-supporting section may have a first hole into which the second-gear-wheel shaft can fit; the second shaft-supporting section may have a second hole into which the third-gear-wheel shaft can fit; the shaft-supporting section may support the second-gear-wheel shaft by the second-gear-wheel shaft fitting into the first hole; and the second shaft-supporting section may support the third-gear-wheel shaft by the third-gear-wheel shaft fitting into the second hole.

In this way, the shaft-supporting section can reliably support the second-gear-wheel shaft and the second shaft-supporting section can reliably support the third-gear-wheel shaft. Therefore, it becomes possible to prevent bending of the second-gear-wheel shaft and the third-gear-wheel shaft even more effectively.

Further, in this developing device, the second-gear-wheel shaft and the third-gear-wheel shaft may be a cover-positioning member for positioning the cover.

In order to prevent the cover from interfering with the second gear wheel and the third gear wheel, it is necessary to precisely position the cover with respect to the body of the developing device. If the second-gear-wheel shaft and the third-gear-wheel shaft function as a cover-positioning member, then the second-gear-wheel shaft and the third-gear-wheel shaft can possess both the function of supporting the gear wheels and the function of determining the position of the cover with respect to the body of the developing device. As a result, it is not necessary to provide a cover-positioning member separately, and thus, it becomes possible to achieve a reduction in the number of structural components.

Further, in this developing device, the developing device may have a developer bearing body for bearing a developer, and a fourth gear wheel that is provided on a side of one end, in a longitudinal direction, of the developer bearing body and that meshes with the third gear wheel.

In a structure where the third gear wheel and the fourth gear wheel mesh with one another, the third gear wheel and the fourth gear wheel may not mesh appropriately when the third-gear-wheel shaft is bent, and this may cause unevenness in rotation of the developer bearing body. This unevenness in rotation, in turn, leads to defects in an image. On the other hand, by supporting the third-gear-wheel shaft with the cover, bending of the third-gear-wheel shaft can be prevented, and thus, it becomes possible to make the third gear wheel and the fourth gear wheel mesh appropriately and make the developer bearing body rotate appropriately.

Further, in this developing device, the developing device may develop a latent image borne on an image bearing body provided in the body of the image forming apparatus when the developing device is moved to the predetermined position.

One main function of the developing device is to develop a latent image borne on the image bearing body. Therefore, the frequency that the developing device moves to the predetermined position and the second gear wheel comes into contact with the first gear wheel is high, and thus, there is a high possibility that the second-gear-wheel shaft may bend. In such a case where the developing device develops a latent image borne on the image bearing body when the developing device is moved to the predetermined position, the effect of being able to appropriately prevent the second-gear-wheel shaft from bending, can be achieved more effectively.

Further, it is also possible to achieve a developing device attachable to and detachable from a movable attach/detach section provided in a body of an image forming apparatus, comprising: a second gear wheel that meshes with a first gear wheel provided in the body of the image forming apparatus when the developing device is in a state attached to the attach/detach section and when the developing device is moved to a predetermined position along with the movement of the attach/detach section; a second-gear-wheel shaft that is supported on a body of the developing device by a supported section and that supports the second gear wheel; and a cover that covers a portion of the second gear wheel and that supports a section of the second-gear-wheel shaft located on a side opposite from the side of the supported section with respect to the second gear wheel; wherein the cover has a shaft-supporting section that supports the section of the second-gear-wheel shaft located on the side opposite from the side of the supported section with respect to the second gear wheel, and that restricts movement of the second gear wheel in a direction from the supported section toward the section on the opposite side; wherein the supported section is provided on a side of one end of the second-gear-wheel shaft; wherein the shaft-supporting section of the cover supports a side of the other end of the second-gear-wheel shaft; wherein the developing device has a third gear wheel that meshes with the second gear wheel, and a third-gear-wheel shaft that is supported on the body of the developing device by a second supported section and that supports the third gear wheel; wherein the cover supports a section of the third-gear-wheel shaft located on a side opposite from the side of the second supported section with respect to the third gear wheel; wherein the cover has a second shaft-supporting section that supports the section of the third-gear-wheel shaft located on the side opposite from the side of the second supported section with respect to the third gear wheel, and that restricts movement of the third gear wheel in a direction from the second supported section toward the section on the opposite side; wherein the shaft-supporting section has a first hole into which the second-gear-wheel shaft can fit; wherein the second shaft-supporting section has a second hole into which the third-gear-wheel shaft can fit; wherein the shaft-supporting section supports the second-gear-wheel shaft by the second-gear-wheel shaft fitting into the first hole; wherein the second shaft-supporting section supports the third-gear-wheel shaft by the third-gear-wheel shaft fitting into the second hole; wherein the second-gear-wheel shaft and the third-gear-wheel shaft are a cover-positioning member for positioning the cover; wherein the developing device has a developer bearing body for bearing a developer, and a fourth gear wheel that is provided on a side of one end, in a longitudinal direction, of the developer bearing body and that meshes with the third gear wheel; and wherein the developing device develops a latent image borne on an image bearing body provided in the body of the image forming apparatus when the developing device is moved to the predetermined position.

With this developing device, the effect of being able to appropriately prevent the second-gear-wheel shaft from bending, can be achieved most effectively.

Further, it is also possible to achieve an image forming apparatus comprising: an image bearing body for bearing a latent image; and a developing device that is attachable to and detachable from a movable attach/detach section provided in a body of the image forming apparatus, that is for developing the latent image borne on the image bearing body in a state where the developing device is attached to the attach/detach section, and that has: a second gear wheel that meshes with a first gear wheel provided in the body of the image forming apparatus when the developing device is in a state attached to the attach/detach section and when the developing device is moved to a predetermined position along with the movement of the attach/detach section; a second-gear-wheel shaft that is supported on a body of the developing device by a supported section and that supports the second gear wheel; and a cover that covers a portion of the second gear wheel and that supports a section of the second-gear-wheel shaft located on a side opposite from the side of the supported section with respect to the second gear wheel.

Since the above-described image forming apparatus is provided with a developing device with which the bending of the second-gear-wheel shaft can appropriately be prevented, it becomes possible to achieve an image forming apparatus superior to conventional apparatuses.

Further, it is also possible to achieve an image forming system comprising: a computer; and an image forming apparatus that is connectable to the computer and that includes: an image bearing body for bearing a latent image; and a developing device that is attachable to and detachable from a movable attach/detach section provided in a body of the image forming apparatus, that is for developing the latent image borne on the image bearing body in a state where the developing device is attached to the attach/detach section, and that has: a second gear wheel that meshes with a first gear wheel provided in the body of the image forming apparatus when the developing device is in a state attached to the attach/detach section and when the developing device is moved to a predetermined position along with the movement of the attach/detach section; a second-gear-wheel shaft that is supported on a body of the developing device by a supported section and that supports the second gear wheel; and a cover that covers a portion of the second gear wheel and that supports a section of the second-gear-wheel shaft located on a side opposite from the side of the supported section with respect to the second gear wheel.

Since the above-described image forming system is provided with a developing device with which the bending of the second-gear-wheel shaft can appropriately be prevented, it becomes possible to achieve an image forming system superior to conventional systems.

FIRST EMBODIMENT

===Overall Configuration Example of Image Forming Apparatus===

Next, with reference to FIG. 1, an outline of an image forming apparatus will be described, taking a laser-beam printer 10 (hereinafter referred to also as "printer") as an example. FIG. 1 is a diagram showing main structural components constructing the printer 10. It should be noted that in FIG. 1, the vertical direction is shown by the arrow, and, for example, a paper supply tray 92 is arranged at a lower section of the printer 10, and a fusing unit 90 is arranged at an upper section of the printer 10.

As shown in FIG. 1, the printer 10 according to the present embodiment is provided with a charging unit 30, an exposing unit 40, a YMCK developing unit 50, a first transferring unit 60, an intermediate transferring body 70, and a cleaning unit 75. These components are arranged in the direction of rotation of a photoconductor 20. The printer 10 is further provided with a second transferring unit 80, a fusing unit 90, a displaying unit 95 constructed of a liquid-crystal panel and serving as means for making notifications to a user, and a control unit 100 for controlling these units etc. and managing the operations as a printer.

The photoconductor 20 has a cylindrical electrically-conductive base and a photoconductive layer formed on the outer peripheral surface of the electrically-conductive base, and it is rotatable about its central axis. In the present embodiment, the photoconductor 20 rotates clockwise, as shown by the arrow in FIG. 1.

The charging unit 30 is a device for electrically charging the photoconductor 20. The exposing unit 40 is a device for forming a latent image on the charged photoconductor 20 by radiating a laser beam thereon. The exposing unit 40 has, for example, a semiconductor laser, a polygon mirror, and an F-θ lens, and radiates a modulated laser beam onto the charged photoconductor 20 in accordance with image signals having been input from a not-shown host computer such as a personal computer or a word processor.

The YMCK developing unit 50 is a device for developing the latent image formed on the photoconductor 20 using toner T, that is, black (K) toner contained in a black developing device 51, magenta (M) toner contained in a magenta developing device 52, cyan (C) toner contained in a cyan developing device 53, and yellow (Y) toner contained in a yellow developing device 54. The toner T is an example of a "developer" contained in each of the developing devices.

The YMCK developing unit 50 can move the positions of the four developing devices 51, 52, 53, and 54 by rotating while the developing devices 51, 52, 53, and 54 are in an attached state. More specifically, the YMCK developing unit 50 holds the four developing devices 51, 52, 53, and 54 with four holding sections 55*a*, 55*b*, 55*c*, and 55*d*. The four developing devices 51, 52, 53, and 54 can be rotated about a rotation shaft 50*a* while maintaining their relative positions. Every time an image forming process for one page is finished, each of the developing devices selectively opposes the photoconductor 20 to successively develop the latent image formed on the photoconductor 20 using the toner T contained in each of the developing devices 51, 52, 53, and 54. It should be noted that each of the four developing devices 51, 52, 53, and 54 described above is attachable to and detachable from the body of the image forming apparatus, more specifically, the respective holding sections 55*a*, 55*b*, 55*c*, and 55*d* of the YMCK developing unit 50. When the developing devices 51, 52, 53, and 54 are attached respectively to the holding sections 55*a*, 55*b*, 55*c*, and 55*d*, a positioning pin 592 provided on each developing device 51, 52, 53, and 54 (described further below) fits into a corresponding positioning-pin fitting hole 58 that is provided in the body of the image forming apparatus and that is an example of a "fitting hole" or an "apparatus-side fitting hole" into which the positioning pin 592 can be fitted. In this way, the developing devices 51, 52, 53, and 54 are positioned with respect to the body of the image forming apparatus (see FIG. 12). Details on the developing devices will be described further below.

The first transferring unit 60 is a device for transferring, onto the intermediate transferring body 70, a single-color toner image formed on the photoconductor 20. When the toners of all four colors are successively transferred in a superimposing manner, a full-color toner image will be formed on the intermediate transferring body 70.

The intermediate transferring body 70 is a laminated endless belt that is made by providing an aluminum layer on the surface of a PET film by vapor deposition, and then further applying semiconducting coating on the outer layer thereof. The intermediate transferring body 70 is driven to rotate at substantially the same circumferential speed as the photoconductor 20.

The second transferring unit 80 is a device for transferring the single-color toner image or the full-color toner image formed on the intermediate transferring body 70 onto a medium such as paper, film, and cloth.

The fusing unit 90 is a device for fusing the single-color toner image or the full-color toner image, which has been transferred onto the medium, to the medium to make it into a permanent image.

The cleaning unit 75 is a device that is provided between the first transferring unit 60 and the charging unit 30, that has a rubber cleaning blade 76 made to abut against the surface of the photoconductor 20, and that is for removing the toner T remaining on the photoconductor 20 by scraping it off with the cleaning blade 76 after the toner image has been transferred onto the intermediate transferring body 70 by the first transferring unit 60.

Figure 2:
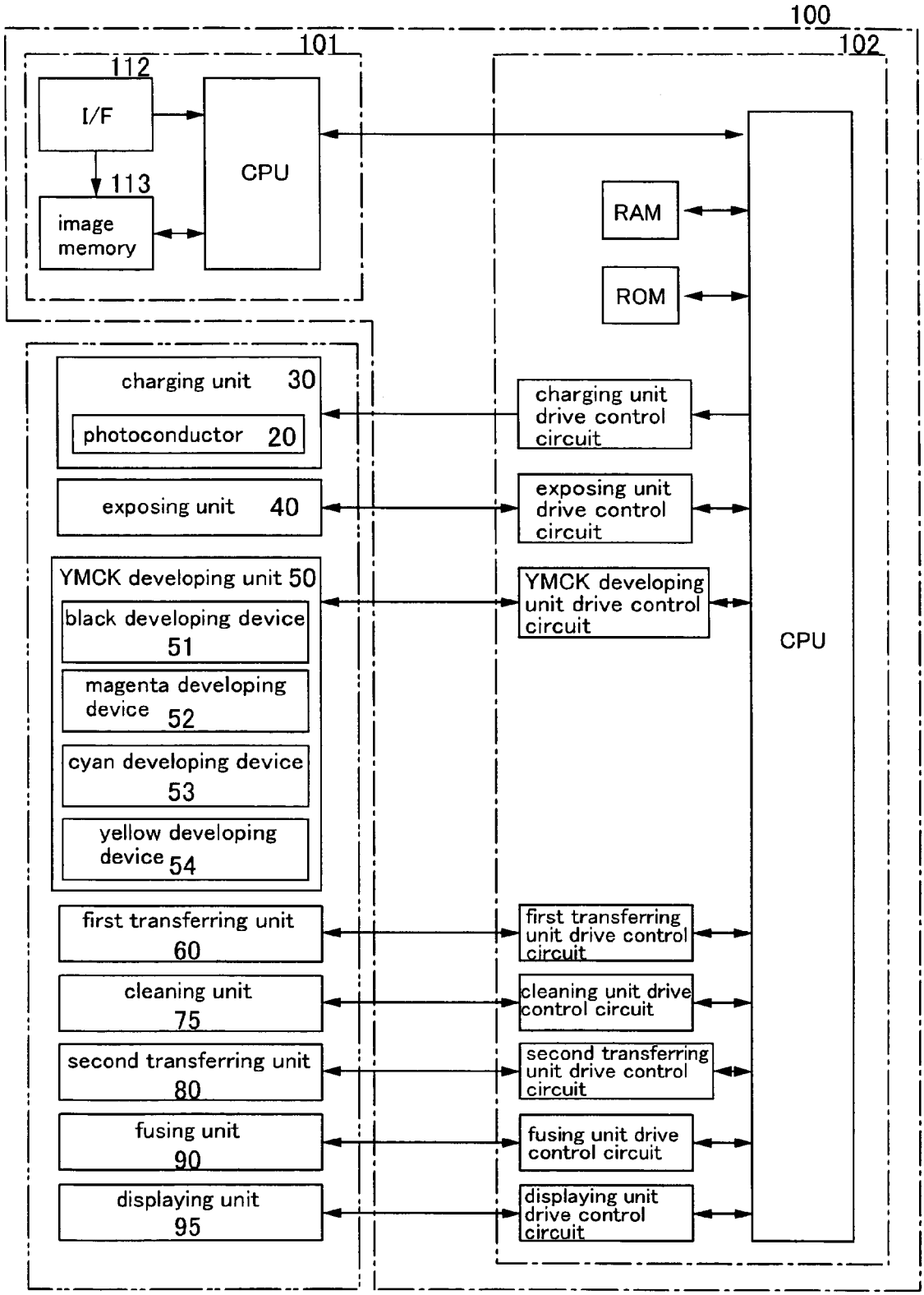
FIG. 2 is a block diagram showing a control unit of the printer 10 of FIG. 1.

The control unit 100 is provided with a main controller 101 and a unit controller 102 as shown in FIG. 2. Image signals and control signals are input to the main controller 101, and according to instructions based on the image signals and control signals, the unit controller 102 controls each of the above-mentioned units etc. to form an image.

Next, operations of the printer 10 structured as above will be described.

First, when image signals and control signals are input from the not-shown host computer to the main controller 101 of the printer 10 through an interface (I/F) 112, the photoconductor 20, a developing roller which is an example of a "developer bearing roller", and the intermediate transferring body 70 rotate under the control of the unit controller 102 based on the instructions from the main controller 101. While being rotated, the photoconductor 20 is successively charged by the charging unit 30 at a charging position.

With the rotation of the photoconductor 20, the charged area of the photoconductor 20 reaches an exposing position. A latent image that corresponds to the image information about the first color, for example, yellow Y, is formed in that area by the exposing unit 40. The YMCK developing unit 50 positions the yellow developing device 54, which contains yellow (Y) toner, at the developing position, which is in opposition to the photoconductor 20.

With the rotation of the photoconductor 20, the latent image formed on the photoconductor 20 reaches the developing position, and is developed with the yellow toner by the yellow developing device 54. Thus, a yellow toner image is formed on the photoconductor 20.

With the rotation of the photoconductor 20, the yellow toner image formed on the photoconductor 20 reaches a first transferring position, and is transferred onto the intermediate transferring body 70 by the first transferring unit 60. At this time, a first transferring voltage, which is in an opposite polarity from the polarity to which the toner T has been charged, is applied to the first transferring unit 60. It should be noted that, during this process, the photoconductor 20 and the intermediate transferring body 70 are placed in contact with each other, but the second transferring unit 80 is kept separated from the intermediate transferring body 70.

By subsequently performing the above-mentioned processes for the second, the third, and the fourth colors using each of the developing devices, toner images in four colors corresponding to the respective image signals are transferred onto the intermediate transferring body 70 in a superimposed manner. As a result, a full-color toner image is formed on the intermediate transferring body 70.

With the rotation of the intermediate transferring body 70, the full-color toner image formed on the intermediate transferring body 70 reaches a second transferring position, and is transferred onto a medium by the second transferring unit 80. It should be noted that the medium is carried from the paper supply tray 92 to the second transferring unit 80 via the paper-feed roller 94 and resisting rollers 96. During transferring operations, a second transferring voltage is applied to the second transferring unit 80 and also the unit 80 is pressed against the intermediate transferring body 70.

The full-color toner image transferred onto the medium is heated and pressurized by the fusing unit 90 and fused to the medium.

On the other hand, after the photoconductor 20 passes the first transferring position, the toner T adhering to the surface of the photoconductor 20 is scraped off by the cleaning blade 76 that is supported on the cleaning unit 75, and the photoconductor 20 is prepared for electrical charging for forming the next latent image. The scraped-off toner T is collected in a remaining-toner collector of the cleaning unit 75.

===Overview of Control Unit===

Next, a configuration of the control unit 100 is described with reference to FIG. 2. The main controller 101 of the control unit 100 is connected to a host computer via the interface 112, and is provided with an image memory 113 for storing the image signals that have been input from the host computer. The unit controller 102 is electrically connected to the units in the body of the apparatus (i.e., the charging unit 30, the exposing unit 40, the YMCK developing unit 50, the first transferring unit 60, the cleaning unit 75, the second transferring unit 80, the fusing unit 90, and the displaying unit 95), and it detects the state of the units by receiving signals from sensors provided in those units, and controls them based on the signals that are input from the main controller 101.

===Configuration Example of Developing Device===

Figure 3:
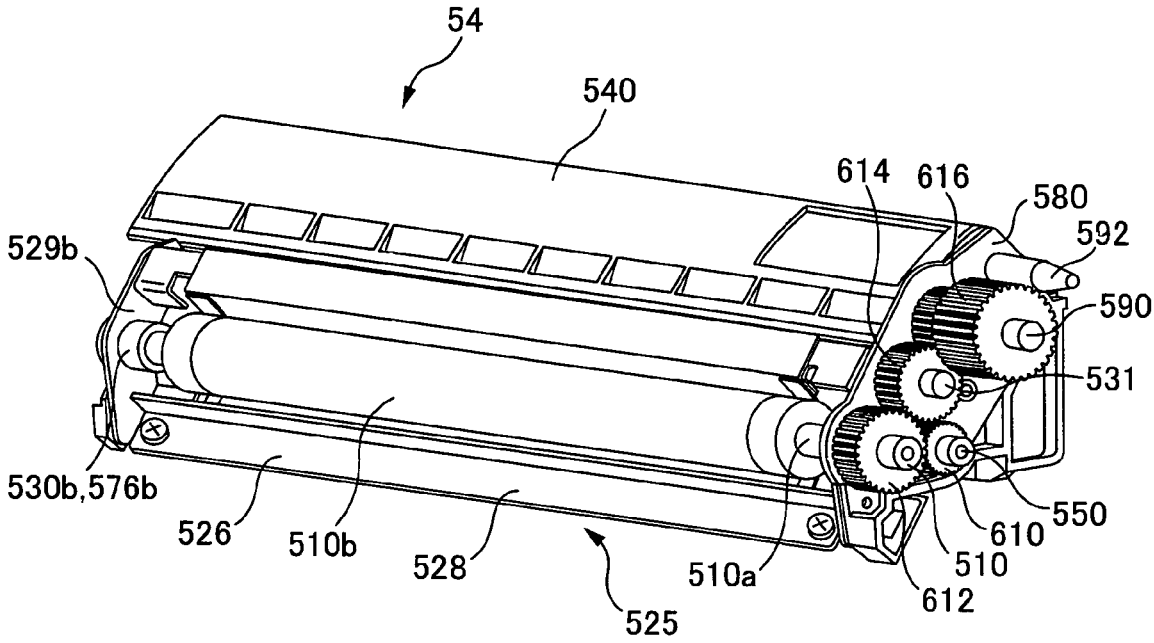
FIG. 3 is a perspective view of a developing device.
Figure 4:
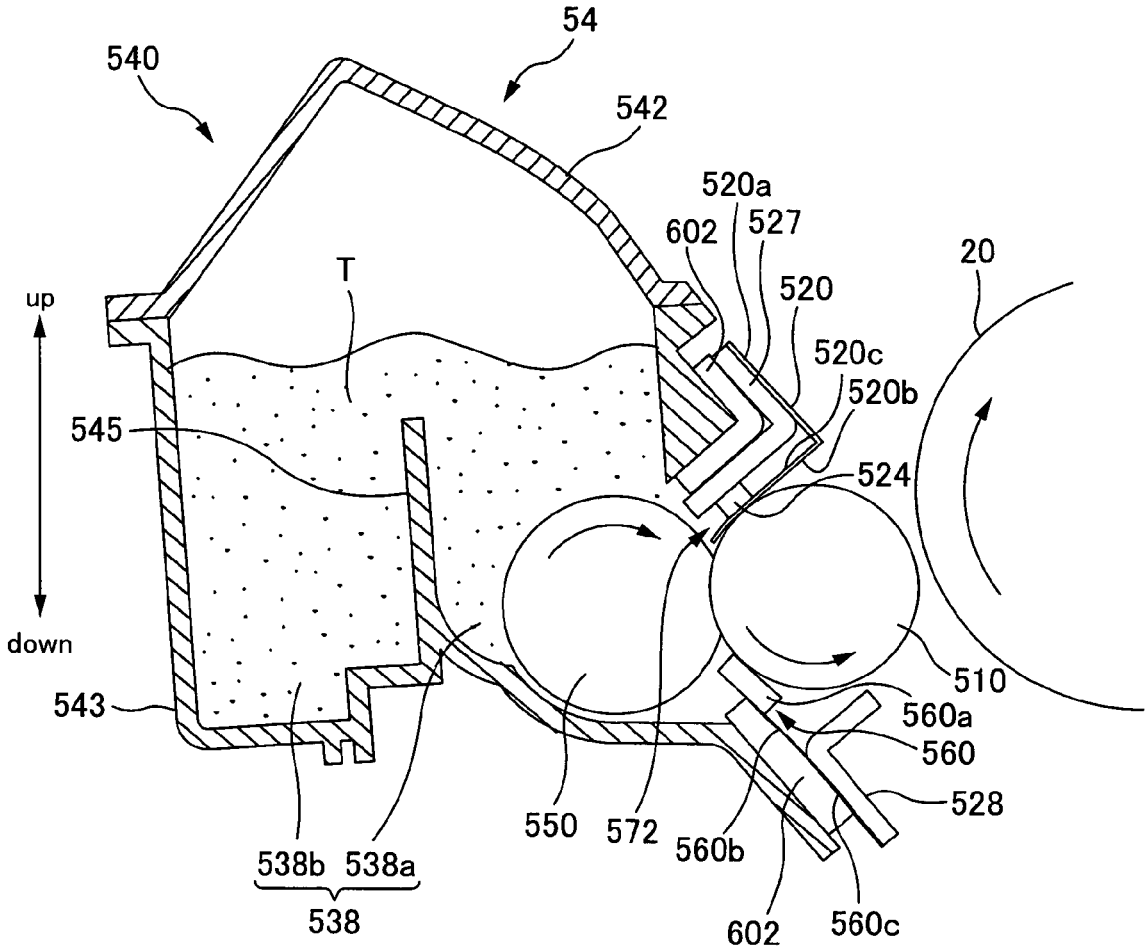
FIG. 4 is a section view showing main structural components of the developing device.
Figure 5:
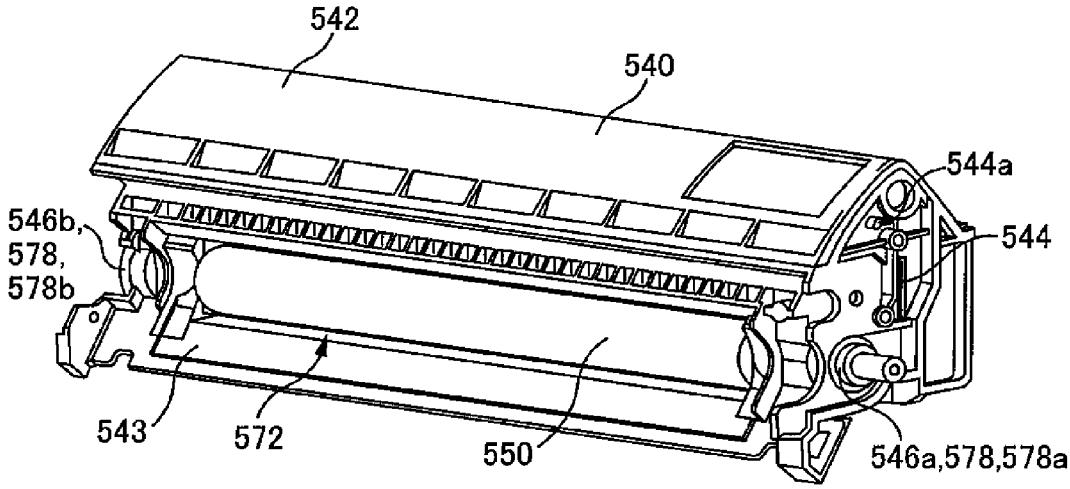
FIG. 5 is a perspective view showing how a toner supplying roller 550 is attached to a housing 540.
Figure 6:
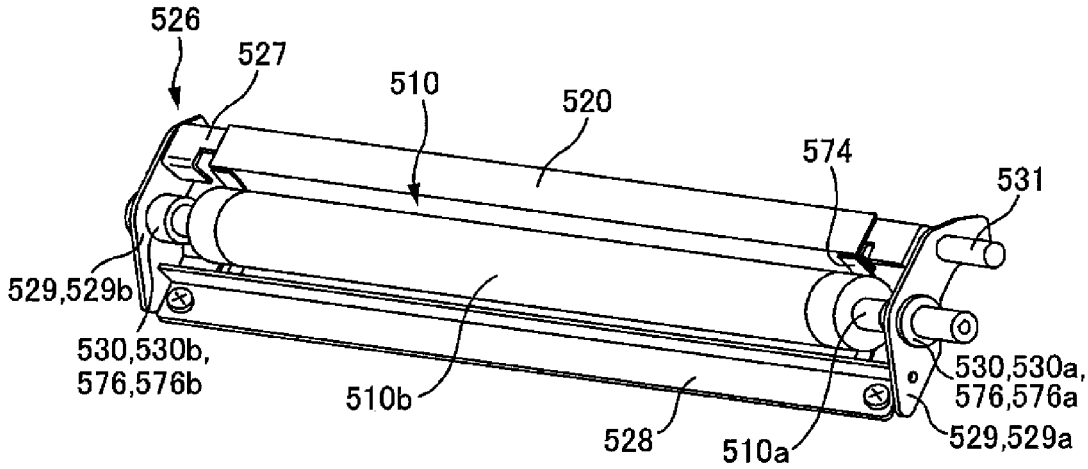
FIG. 6 is a perspective view showing how a developing roller 510 is attached to a holder 526 shown in FIG. 7.
Figure 7:
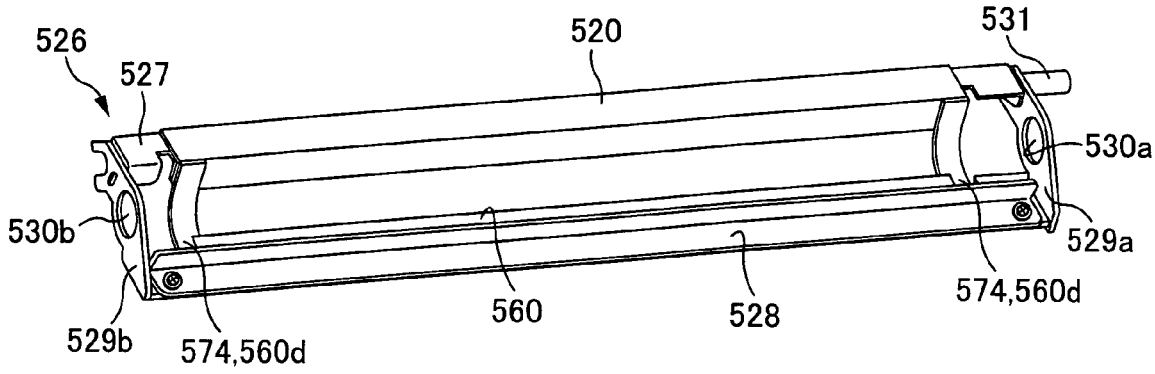
FIG. 7 is a perspective view showing how an upper sealing member 520 and a restriction blade 560 are assembled to the holder 526.
Figure 8:
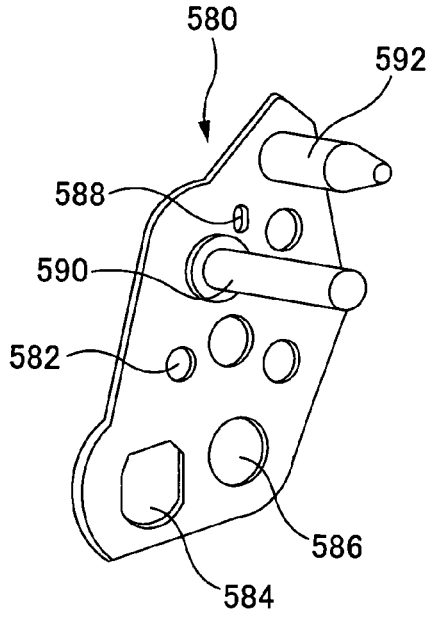
FIG. 8 is a perspective view of a side plate 580.
Figure 9:
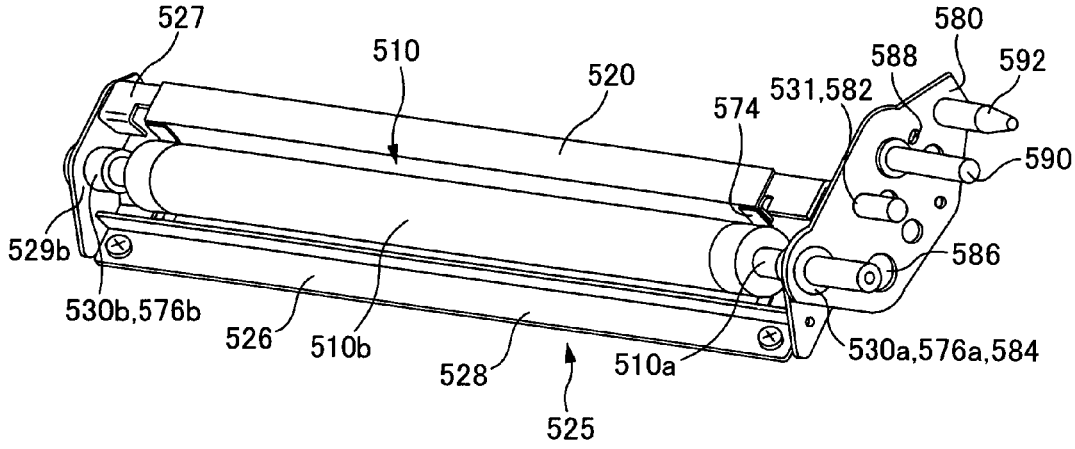
FIG. 9 is a perspective view showing how the upper sealing member 520, the restriction blade 560, and the developing roller 510 are attached to the assembly member 525.
Figure 10:
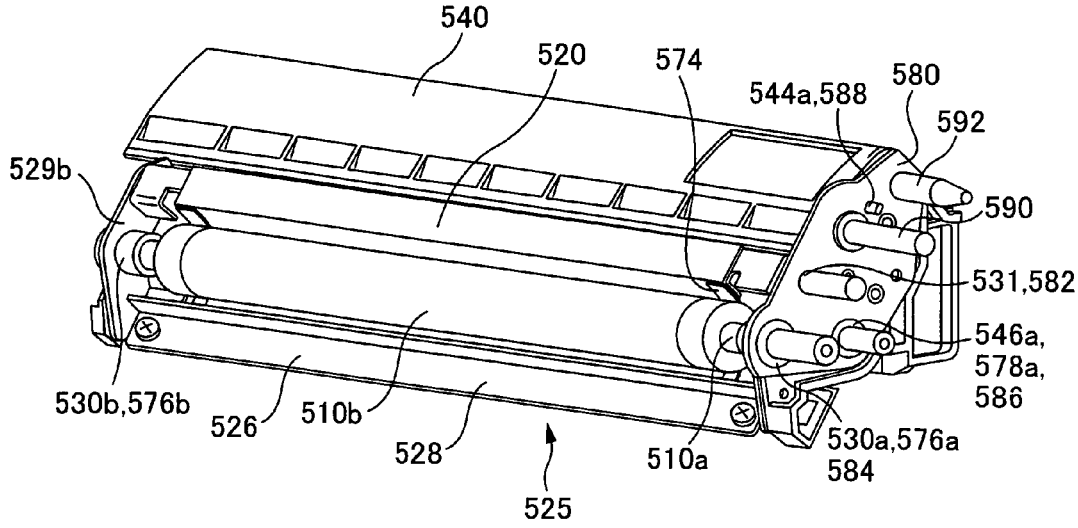
FIG. 10 is a perspective view showing how the assembly member 525 shown in FIG. 9 is attached to the housing 540 shown in FIG. 5.
Figure 11:
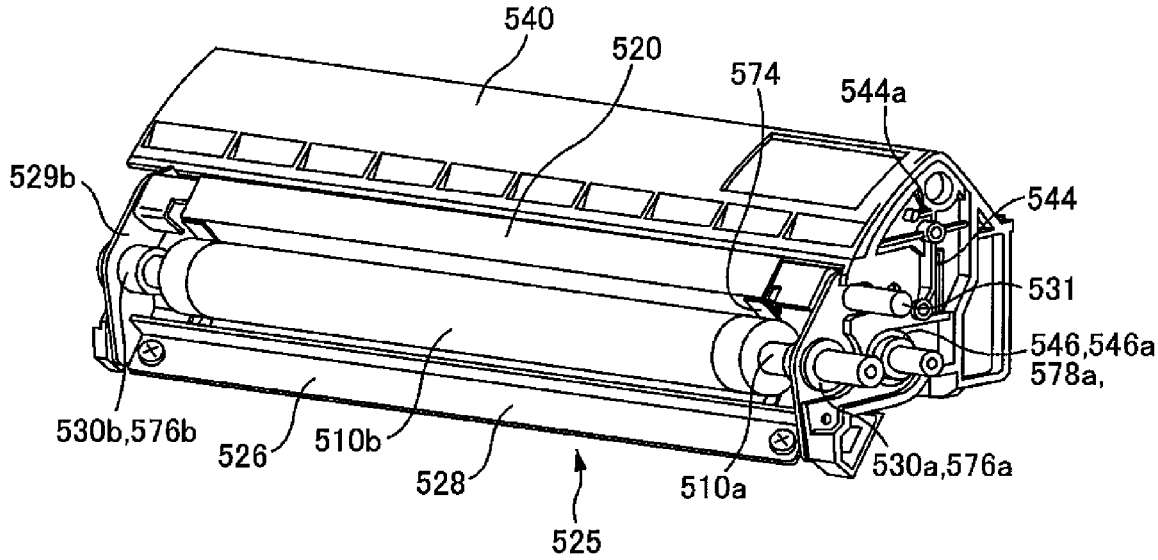
FIG. 11 is a reference perspective view showing a state in which the side plate 580 has been removed from the assembly member 525 shown in FIG. 10.
Figure 12:
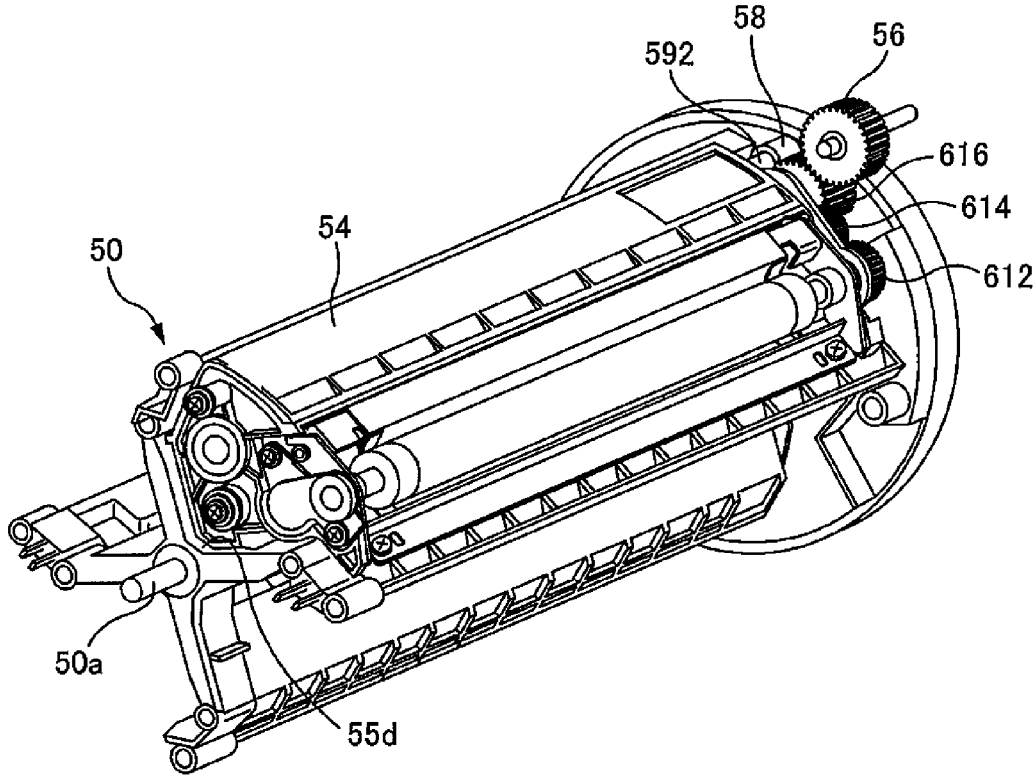
FIG. 12 is a perspective view showing how a yellow developing device 54 is attached to a holding section 55*d* of a YMCK developing unit 50.
Figure 13:
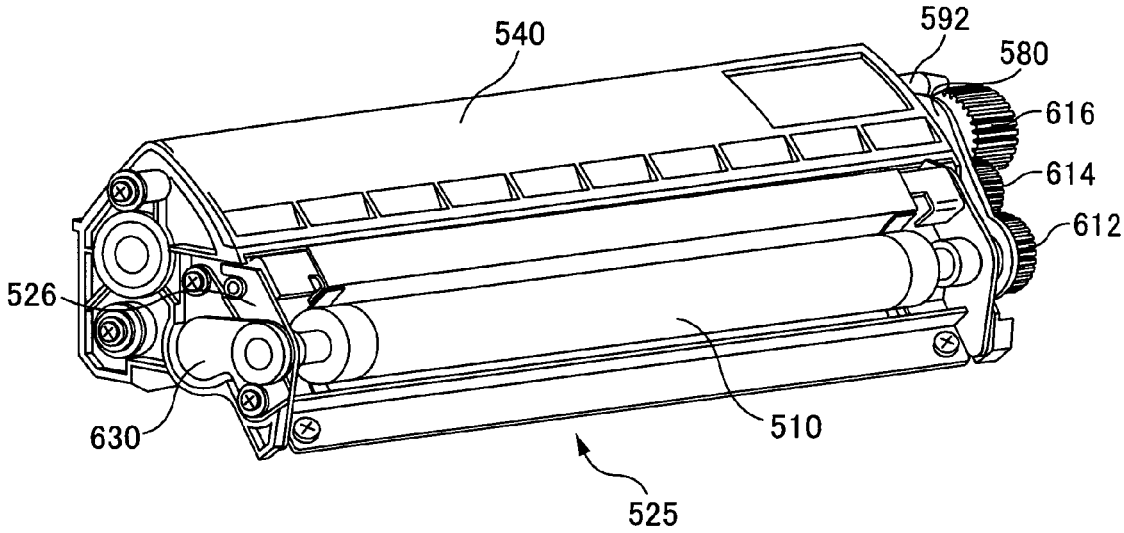
FIG. 13 is a perspective view showing how a bracket 630 is provided on a side of the other end of the yellow developing device 54 in the longitudinal direction.
Figure 14:
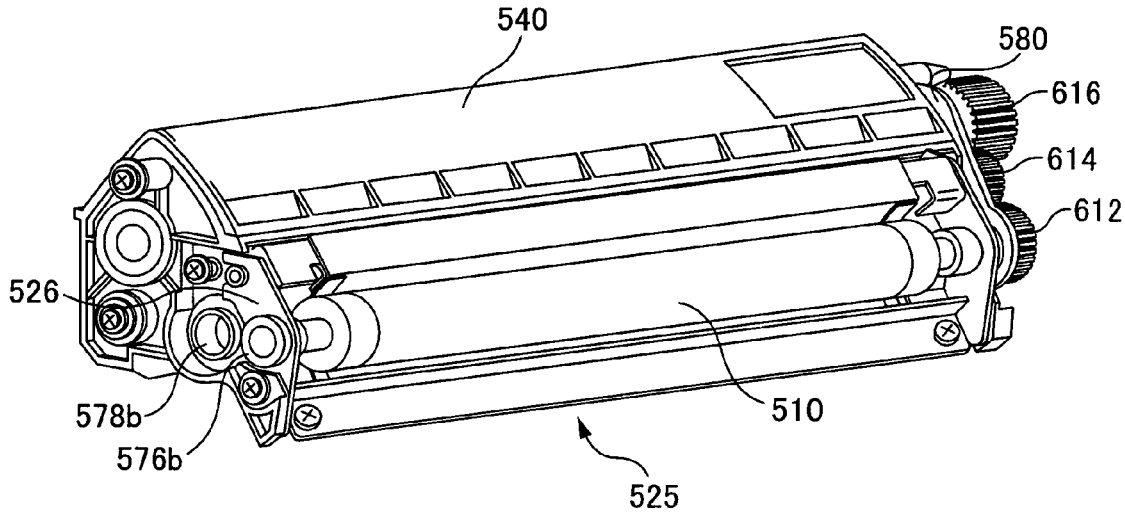
FIG. 14 is a reference perspective view showing a state of the other-end side, in the longitudinal direction, of the yellow developing device 54 before the bracket 630 is provided.
Figure 15:
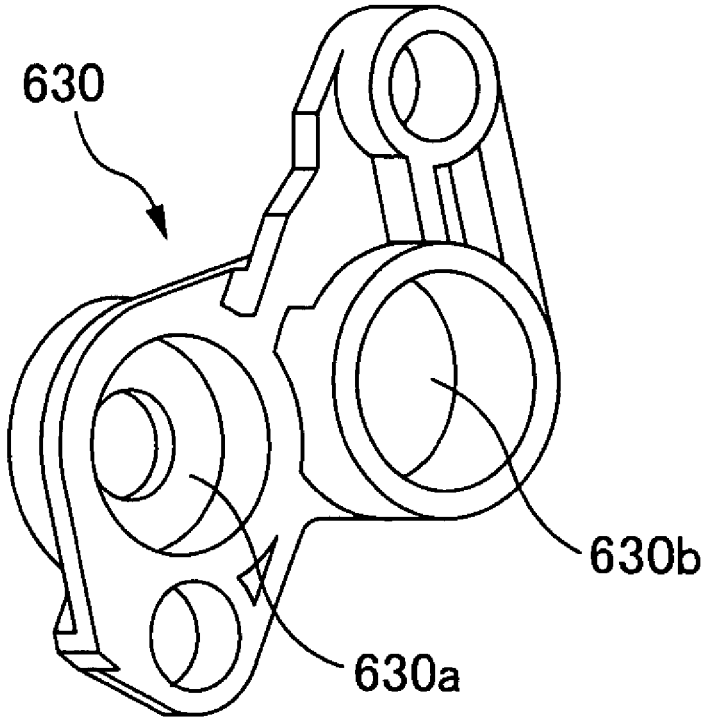
FIG. 15 is a perspective view showing the back side of the bracket 630.

Next, with reference to FIG. 3 through FIG. 15, a configuration of the developing device will be described. FIG. 3 is a perspective view of a developing device. FIG. 4 is a section view showing main structural components of the developing device. FIG. 5 is a perspective view showing how a toner supplying roller 550 is attached to a housing 540. FIG. 6 is a perspective view showing how a developing roller 510 is attached to a holder 526 shown in FIG. 7. FIG. 7 is a perspective view showing how an upper sealing member 520 and a restriction blade 560 are assembled to the holder 526. FIG. 8 is a perspective view of a side plate 580. FIG. 9 is a perspective view showing how the upper sealing member 520, the restriction blade 560, and the developing roller 510 are attached to the assembly member 525. FIG. 10 is a perspective view showing how the assembly member 525 shown in FIG. 9 is attached to the housing 540 shown in FIG. 5. FIG. 11 is a reference perspective view showing a state in which the side plate 580 has been removed from the assembly member 525 shown in FIG. 10. FIG. 12 is a perspective view showing how a yellow developing device 54 is attached to a holding section **55*d* of a YMCK developing unit 50. FIG. 13 is a perspective view showing how a bracket 630 is provided on a side of the other end of the yellow developing device 54 in the longitudinal direction. FIG. 14 is a reference perspective view showing a state of the other-end side, in the longitudinal direction, of the yellow developing device 54 before the bracket 630 is provided. FIG. 15 is a perspective view showing the back side of the bracket 630**.

It should be noted that the section view shown in FIG. 4 is a section of the developing device bisected by a plane perpendicular to the longitudinal direction shown in FIG. 3. Further, in FIG. 4, the arrow indicates the vertical direction as in FIG. 1, and, for example, the central axis of the developing roller 510 is located below the central axis of the photoconductor 20. Further, in FIG. 4, the yellow developing device 54 is shown positioned at the developing position, which is in opposition to the photoconductor 20.

The YMCK developing unit 50 is provided with: the black developing device 51 containing black (K) toner; the magenta developing device 52 containing magenta (M) toner; the cyan developing device 53 containing cyan (C) toner; and the yellow developing device 54 containing yellow (Y) toner. Since the configuration of each of the developing devices is the same, description will be made only about the yellow developing device 54 below.

The yellow developing device 54 has, for example: a housing 540 which is an example of a "second attachment member" to which a toner supplying roller 550 is attached; the toner supplying roller 550 which is an example of a "developer supplying roller"; a developing roller 510; an upper sealing member 520; a restriction blade 560; and an assembly member 525 which is an example of a "positioning member" or a "first attachment member" to which the developing roller 510 is attached.

The housing 540 is manufactured by welding together a plurality of integrally-molded housing sections made of resin, that is, an upper housing section 542 and a lower housing section 543. In the housing 540 is formed a toner containing body 538 for containing the toner T. The toner containing body 538 is divided into two toner containing sections, namely, the first toner containing section 538*a* and the second toner containing section 538*b*, by a partitioning wall 545 that is for partitioning the toner T and that protrudes inwards (in the up/down direction of FIG. 4) from the inner wall. The first toner containing section 538*a* and the second toner containing section 538*b* are connected at their upper sections, and in the state shown in FIG. 4, movement of the toner T is restricted by the partitioning wall 545. However, when the YMCK developing unit 50 is rotated, the toner contained in the first toner containing section 538*a* and the second toner containing section 538*b* is once gathered on the side of the section where the containing sections are connected, which is on the upper side when in the developing position, and when the YMCK developing unit 50 returns to the state shown in FIG. 4, the toner gets mixed and is returned to the first toner containing section 538*a* and the second toner containing section 538*b*. In other words, the toner T is appropriately stirred within the developing device by the rotation of the YMCK developing unit 50. Therefore, in the present embodiment, no stirring member is provided in the toner containing body 538. However, it is possible to provide a stirring member for stirring the toner T contained in the toner containing body 538. It should be noted that as shown in FIG. 4, the housing 540 (more specifically, the first toner containing section 538*a*) has an opening 572 in its lower section, and the developing roller 510 described below is provided facing the opening 572. Further, on a side wall 544 positioned on a side of one end, in the longitudinal direction, of the housing 540 (yellow developing device 54), there is provided a pin 544*a* that can be fitted into a pin-fitting hole 588 which is provided in the assembly member 525 (side plate 580) and which is an example of a "fourth fitting hole" (see FIG. 5).

As shown in FIG. 4 and FIG. 5, the toner supplying roller 550 is provided in the first toner containing section 538*a* described above and supplies the toner T contained in the first toner containing section 538*a* to the developing roller 510 described below. It also strips off, from the developing roller 510, the toner T remaining on the developing roller 510 after development. The toner supplying roller 550 is made of, for example, polyurethane foam, and is made to abut against the developing roller 510 in an elastically deformed state. The toner supplying roller 550 is arranged at a lower section of the first toner containing section 538*a*. The toner T contained in the first toner containing section 538*a* is supplied to the developing roller 510 by the toner supplying roller 550 at the lower section of the first toner containing section 538*a*. As shown in FIG. 5, the toner supplying roller 550 is rotatably supported by its shaft being supported by the housing 540 via two supplying-roller bearings 578 (which is an example of a "first bearing" for receiving the shaft), namely: a one-end-side supplying-roller bearing 578*a* which is positioned on a side of one end, in the longitudinal direction, of the toner supplying roller 550 (yellow developing device 54) and which is an example of a "one-end-side first bearing"; and an other-end-side supplying-roller bearing 578*b* which is positioned on a side of the other end in the longitudinal direction and which is an example of an "other-end-side first bearing". More specifically, the housing 540 is provided with: a one-end-side supplying-roller fitting hole 546*a* which is an example of a "one-end-side second fitting hole" into which the one-end-side supplying-roller bearing 578*a* can fit; and an other-end-side supplying-roller fitting hole 546*b* which is an example of an "other-end-side second fitting hole" into which the other-end-side supplying-roller bearing 578*b* can fit, the holes 546*a* and 546*b* serving as supplying-roller fitting holes 546 which are an example of a "second fitting hole" into which the supplying-roller bearings 578 can fit. The toner supplying roller 550 is rotatably supported by the housing 540 via the one-end-side supplying-roller bearing 578*a* that fits into the one-end-side supplying-roller fitting hole 546*a* and the other-end-side supplying-roller bearing 578*b* that fits into the other-end-side supplying-roller fitting hole 546*b*. As shown in FIG. 4, the toner supplying roller 550 rotates in the opposite direction (clockwise in FIG. 4) to the rotating direction of the developing roller 510 (counterclockwise in FIG. 4). The central axis of the toner supplying roller 550 is located lower than the central axis of rotation of the developing roller 510. It should be noted that a supplying-roller driving gear wheel 610, which is an example of a "fourth driving wheel (fourth driving gear wheel)" for driving the toner supplying roller 550, is provided on an end of the toner supplying roller 550 (on a side of one end in the axial direction) (see FIG. 3).

The developing roller 510 bears toner T and delivers it to the developing position opposing the photoconductor 20. The developing roller 510 is made of, for example, aluminum alloy such as aluminum alloy 5056 or aluminum alloy 6063, or iron alloy such as STKM, and where necessary, the roller 510 is plated with, for example, nickel plating or chromium plating.

As shown in FIG. 6, the developing roller 510 has a shaft 510*a* and a large-diameter section 510*b*. The developing roller 510 is rotatably supported by its shaft 510*a* being supported by the holder 526 (described later) via two developing-roller bearings 576 (which is an example of a "developing-roller bearing" or a "second bearing" for receiving the shaft 510*a*), namely: a one-end-side developing-roller bearing 576*a* which is positioned on a side of one end, in the longitudinal direction, of the developing roller 510 (yellow developing device 54) and which is an example of a "one-end-side second bearing"; and an other-end-side developing-roller bearing 576*b* which is positioned on a side of the other end in the longitudinal direction and which is an example of an "other-end-side second bearing". As shown in FIG. 4, the developing roller 510 rotates in the opposite direction (counterclockwise in FIG. 4) to the rotating direction of the photoconductor 20 (clockwise in FIG. 4). The central axis of the roller 510 is located below the central axis of the photoconductor 20. It should be noted that a developing-roller driving gear wheel 612, which is an example of a "first driving wheel (first driving gear wheel)" for driving the developing roller 510, is provided on an end of the developing roller 510 (on a side of one end in the axial direction) (see FIG. 3).

Further, in a state where the yellow developing device 54 is in opposition to the photoconductor 20, there is a gap between the developing roller 510 and the photoconductor 20. That is, the yellow developing device 54 develops the latent image formed on the photoconductor 20 in a non-contacting state. It should be noted that an alternating field is generated between the developing roller 510 and the photoconductor 20 upon development of the latent image formed on the photoconductor 20.

The upper sealing member 520 abuts against the developing roller 510 along the axial direction thereof to allow the toner T remaining on the developing roller 510 after passing the developing position to move into the housing 540 and also to restrict movement of the toner T in the housing 540 from moving outside therefrom. The upper sealing member 520 is a seal made, for example, of polyethylene film. The upper sealing member 520 is supported by an upper-seal supporting section 527 of the holder 526 described below, and it is arranged such that its longitudinal direction is in the axial direction of the developing roller 510 (see FIG. 7). The abutting position where the upper sealing member 520 abuts against the developing roller 510 is above the central axis of the developing roller 510.

Further, as shown in FIG. 4, in between the upper-seal supporting section 527 and a surface of the upper sealing member 520 (which is also referred to as the opposite surface 520*c*) on the opposite side from the abutting surface 520*b* of the upper sealing member 520 with which it abuts against the developing roller 510, there is provided an upper-seal urging member 524 made of an elastic body, such as Moltoprene, in a compressed state. The upper-seal urging member 524 presses the upper sealing member 520 against the developing roller 510 by urging the upper sealing member 520 toward the developing roller 510 with its urging force.

The restriction blade 560 abuts against the developing roller 510 along the axial direction thereof, and restricts the thickness of the layer of the toner T borne by the developing roller 510 as well as gives an electric charge to the toner T borne by the developing roller 510. The restriction blade 560 includes a rubber section 560*a* and a rubber-supporting section 560*b*. The rubber section 560*a* is made of, for example, silicone rubber or urethane rubber. The rubber-supporting section 560*b* is a thin plate that is made of, for example, phosphor bronze or stainless steel, and that has a spring-like characteristic.

The rubber section 560*a* is supported by the rubber-supporting section 560*b*. The rubber-supporting section 560*b* presses, with its urging force, the rubber section 560*a* against the developing roller 510. The rubber-supporting section 560*b* is attached to a restriction-blade supporting section 528 of the holder 526, which is described later, in a state where one end of the rubber-supporting section 560*b* is supported by the restriction-blade supporting section 528.

The end of the restricting blade 560 opposite from the end that is being supported by the restriction-blade supporting section 528, i.e., the tip end of the restriction blade 560, is not placed in contact with the developing roller 510; rather, a section at a predetermined distance away from the tip end contacts, with some breadth, the developing roller 510. That is, the restriction blade 560 does not abut against the developing roller 510 at its edge, but abuts against the roller 510 near its central portion. Further, the restriction blade 560 is arranged so that its tip end faces toward the upstream side of the rotating direction of the developing roller 510, and thus, makes a so-called counter-abutment with respect to the roller 510. It should be noted that the abutting position at which the restriction blade 560 abuts against the developing roller 510 is below the central axis of the developing roller 510 and is also below the central axis of the toner supplying roller 550.

Further, end seals 574 are provided on the outer sides, in the longitudinal direction, of the rubber section 560*a* of the restriction blade 560 (see FIG. 7). The end seals 574 are made of nonwoven fabric and abut against the ends, in the axial direction, of the developing roller 510 along the circumferential direction of the developing roller 510, so as to function as to prevent the toner T from spilling from between the circumferential surface of the roller and the housing 540.

The assembly member 525 is a member made of metal for assembling the various members such as the developing roller 510 and the driving gear wheels. In consideration of allowing easy assembly of the developing device (that is, in order to allow the holder 526 and the side plate 580 described below to be attached separately at the time of assembling the developing device), the assembly member 525 is structured mainly of two members, namely, the holder 526 which is an example of a "first positioning member" and the side plate 580 which is an example of a "second positioning member" positioned on a side of one end, in the longitudinal direction, of the holder 526 (yellow developing device 54) (see FIG. 9).

The holder 526 is a member made of metal. As shown in FIG. 7, the holder 526 has an upper-seal supporting section 527 arranged in the longitudinal direction (i.e., the axial direction of the developing roller 510), a restriction-blade supporting section 528 also arranged in the longitudinal direction (i.e., the axial direction of the developing roller 510), and developing-roller supporting sections 529 which are provided on the outer sides of the upper-seal supporting section 527 and the restriction-blade supporting section 528 in the longitudinal direction (the axial direction) and which intersect with the longitudinal direction (the axial direction).

The developing-roller supporting sections 529 are made of a one-end-side developing-roller supporting section 529*a* positioned on a side of one end, in the longitudinal direction, of the holder 526 (yellow developing device 54), and an other-end-side developing-roller supporting section 529*b* positioned on a side of the other end, in the longitudinal direction, of the holder 526 (yellow developing device 54). Further, the one-end-side and other-end-side developing-roller supporting sections 529*a* and 529*b* have, respectively: a one-end-side developing-roller fitting hole 530*a* which is an example of a "one-end-side third fitting hole" into which the one-end-side developing-roller bearing 576*a* can fit; and an other-end-side developing-roller fitting hole 530*b* which is an example of an "other-end-side third fitting hole" into which the other-end-side developing-roller bearing 576*b* can fit, the holes 530*a* and 530*b* serving as developing-roller fitting holes 530 which are an example of a "first supporting section" or a "third fitting hole" into which the developing-roller bearings 576 can fit. The developing roller 510 is rotatably supported by the holder 526 (assembly member 525) via the one-end-side developing-roller bearing 576*a* that fits into the one-end-side developing-roller fitting hole 530*a* and the other-end-side developing-roller bearing 576*b* that fits into the other-end-side developing-roller fitting hole 530*b* (see FIG. 6). It should be noted that on the one-end-side developing-roller supporting section 529*a*, there is provided an intermediate-gear-wheel supporting section 531, which is an example of a "third supporting section", for rotatably supporting an intermediate gear wheel 614 which is an example of a "third driving wheel (third driving gear wheel)" described below.

Further, the upper sealing member 520 is supported by the upper-seal supporting section 527 at its lateral-direction end 520*a* (see FIG. 4), and the restriction blade 560 is supported by the restriction-blade supporting section 528 at its lateral-direction end 560*c* (also see FIG. 4). Further, as shown in FIG. 7, the restriction blade 560 supports the end seals 574 at its longitudinal-direction ends 560*d*.

The side plate 580 is a member made of metal positioned only on a side of one end, in the longitudinal direction, of the yellow developing device 54. As shown in FIG. 8, the side plate 580 has: a supporting-section fitting hole 582 which is an example of a "supporting-section fitting hole" into which the intermediate-gear-wheel supporting section 531 can fit; a developing-roller fitting hole 584 which is an example of a "bearing fitting hole" into which the one-end-side developing-roller bearing 576*a* can fit; a supplying-roller fitting hole 586 which is an example of a "fourth supporting section" or a "first fitting hole" into which the one-end-side supplying-roller bearing 578*a* can fit; a pin-fitting hole 588 into which the pin 544*a* can fit; a developing-device-side gear-wheel supporting section 590, which is an example of a "second supporting section", for rotatably supporting a developing-device-side gear wheel 616 which is an example of a "second driving wheel (second driving gear wheel)" described later; and a positioning pin 592 for positioning the yellow developing device 54 with respect to the body of the image forming apparatus.

As shown in FIG. 9, the assembly member 525 is structured by fitting, respectively, the one-end-side developing-roller bearing 576*a* and the intermediate-gear-wheel supporting section 531 of the holder 526 provided with the developing roller 510 etc. into the developing-roller fitting hole 584 and the supporting-section fitting hole 582 of the side plate 580.

The assembly member 525 structured as above is attached, as shown in FIG. 10 and FIG. 11, to the housing 540 provided with the toner supplying roller 550 (see FIG. 5) via a housing seal 602 (see FIG. 4) for preventing the toner T from spilling from between the assembly member 525 and the housing 540. At this time, the one-end-side supplying-roller bearing 578*a* and the pin 544*a*, which are provided on the housing 540 having the toner supplying roller 550, fit respectively into the supplying-roller fitting hole 586 and the pin-fitting hole 588 of the assembly member 525 on the side of one end, in the longitudinal direction, of the yellow developing device 54. Thus, the toner supplying roller 550 is rotatably supported by the supplying-roller fitting hole 586 of the assembly member 525 and the supplying-roller fitting holes 546 of the housing 540.

As described above, a developing-roller driving gear wheel 612 and a supplying-roller driving gear wheel 610 are provided, respectively, on the end (one-end-side in the axial direction) of the developing roller 510 and the toner supplying roller 550; in addition to these gear wheels, the yellow developing device 54 is further provided with the developing-device-side gear wheel 616 and the intermediate gear wheel 614, as shown in FIG. 3.

The developing-device-side gear wheel 616 is a gear wheel that, when the yellow developing device 54 is attached to the body of the image forming apparatus, receives a drive force from the body of the image forming apparatus, more specifically, from the apparatus-side gear wheel 56 which is an example of an "other driving wheel" described later, and that transmits this drive force to the developing-roller driving gear wheel 612 and the supplying-roller driving gear wheel 610. The developing-device-side gear wheel 616 is rotatably supported by the developing-device-side gear-wheel supporting section 590.

The intermediate gear wheel 614 is a gear wheel that serves as a medium when the developing-device-side gear wheel 616 transmits the drive force to the developing-roller driving gear wheel 612 and the supplying-roller driving gear wheel 610. More specifically, in a state where the yellow developing device 54 is attached to the body of the image forming apparatus, the developing-device-side gear wheel 616 receives the drive force from the body of the image forming apparatus, and transmits the drive force to the developing-roller driving gear wheel 612 and the supplying-roller driving gear wheel 610 via the intermediate gear wheel 614. The intermediate gear wheel 614 is rotatably supported by the intermediate-gear-wheel supporting section 531.

As shown in FIG. 3, the developing-device-side gear wheel 616 meshes with the intermediate gear wheel 614, the intermediate gear wheel 614 meshes with the developing-roller driving gear wheel 612, and the developing-roller driving gear wheel 612 meshes with the supplying-roller driving gear wheel 610. Further, the developing-device-side gear wheel 616 meshes with the apparatus-side gear wheel 56 provided on the body of the image forming apparatus, as shown in FIG. 12.

The apparatus-side gear wheel 56 gives a drive force received from a not-shown drive source to the developing-device-side gear wheel 616. The developing-device-side gear wheel 616 then transmits the drive force that it received from the apparatus-side gear wheel 56 to the developing-roller driving gear wheel 612 via the intermediate gear wheel 614. The drive force transmitted to the developing-roller driving gear wheel 612 is then transmitted to the supplying-roller driving gear wheel 610 due to meshing of the developing-roller driving gear wheel 612 and the supplying-roller driving gear wheel 610.

In the yellow developing device 54 structured as above, the toner supplying roller 550, by rotating, supplies the toner T contained in the toner containing body 538 to the developing roller 510. At this time, the toner supplying roller 550 is driven to rotate by the drive force transmitted to the supplying-roller driving gear wheel 610. With the rotation of the developing roller 510, the toner T, which has been supplied to the developing roller 510, reaches the abutting position of the restriction blade 560; then, as the toner T passes the abutting position, the toner is electrically charged and its layer thickness is restricted. With further rotation of the developing roller 510, the toner T on the developing roller 510, which has been electrically charged and whose layer thickness has been restricted, reaches the developing position opposing the photoconductor 20; then, under the alternating field, the toner T is used at the developing position for developing the latent image formed on the photoconductor 20. With further rotation of the developing roller 510, the toner T on the developing roller 510, which has passed the developing position, passes the upper sealing member 520 and is collected into the developing device by the upper sealing member 520 without being scraped off. It should be noted that the developing roller 510 is driven to rotate by the drive force transmitted to the developing-roller driving gear wheel 612. Further, the toner T that still remains on the developing roller 510 can be stripped off by the toner supplying roller 550.

===Positioning of the Gear Wheels <Part 1>===

As described in the "Description of the Related Art", it is necessary for the developing-device-side gear wheel 616 and the developing-roller driving gear wheel 612 to be positioned with high accuracy in order to appropriately drive the developing roller 510. In developing devices in which the developing-device-side gear wheel 616 and the developing-roller driving gear wheel 612 are not positioned with high accuracy, the developing roller 510 will not be driven appropriately, which may result in inappropriate developing operations. Further, in cases where the developing device is provided with a toner supplying roller 550, it is also necessary for the supplying-roller driving gear wheel 610 to be positioned with high accuracy in order to appropriately drive the toner supplying roller 550. Furthermore, in cases where the developing device is provided with an intermediate gear wheel 614, it is also necessary to position the intermediate gear wheel 614 with high accuracy.

The way in which these gear wheels are positioned is described below with regard to the developing device according to the present embodiment. As described above, the intermediate-gear-wheel supporting section 531 and the one-end-side developing-roller bearing 576*a* of the holder 526, to which the developing roller 510 etc. is attached, are fitted, respectively, into the supporting-section fitting hole 582 and the developing-roller fitting hole 584 of the side plate 580. In this way, the relative position between the side plate 580 and the holder 526, to which the developing roller 510 etc. is attached, is set.

Further, the one-end-side supplying-roller bearing 578*a* fits into the supplying-roller fitting hole 586 of the side plate 580; furthermore, the side plate 580 is provided with the developing-device-side gear-wheel supporting section 590 for rotatably supporting the developing-device-side gear wheel 616, and the holder 526 is provided with the intermediate-gear-wheel supporting section 531 for rotatably supporting the intermediate gear wheel 614. In this way, the relative position among the developing-device-side gear-wheel supporting section 590, the intermediate-gear-wheel supporting section 531, the one-end-side developing-roller bearing 576*a*, and the one-end-side supplying-roller bearing 578*a*, is set.

Further, the developing-device-side gear wheel 616 is supported by the developing-device-side gear-wheel supporting section 590, the intermediate gear wheel 614 is supported by the intermediate-gear-wheel supporting section 531, and the developing-roller driving gear wheel 612 and the supplying-roller driving gear wheel 610 are provided, respectively, on the ends (the side on one end in the axial direction) of the developing roller 510 and the toner supplying roller 550. In this way, the relative position among the developing-device-side gear wheel 616, the intermediate gear wheel 614, the developing-roller driving gear wheel 612, and the supplying-roller driving gear wheel 610, is set.

As described above, the assembly member 525 structured of the holder 526 and the side plate 580 serves to position the above-mentioned gear wheels. Furthermore, since the assembly member 525 is made of metal, the gear wheels can be positioned with high accuracy. Therefore, the developing roller 510 and the toner supplying roller 550 can be driven appropriately, and thus, it becomes possible to achieve a developing device with which developing operations can be performed appropriately.

Further, as described above, the assembly member 525 (side plate 580) made of metal has a positioning pin 592, and this positioning pin 592, which is also made of metal, fits into the positioning-pin fitting hole 58 provided in the body of the image forming apparatus. Thus, the developing device is positioned with high accuracy with respect to the body of the image forming apparatus. Therefore, the relative position between the apparatus-side gear wheel 56 provided on the body of the image forming apparatus and the developing-device-side gear wheel 616 can be set with high accuracy. As a result, the developing roller 510 and the toner supplying roller 550 are driven more appropriately.

It should be noted that, as shown in FIG. 13 and FIG. 14, a bracket 630 for setting the relative position between the other-end-side developing-roller bearing 576*b* and the other-end-side supplying-roller bearing 578*b* is provided on the side of the other end, in the longitudinal direction, of the yellow developing device 54. As shown in FIG. 15, the bracket 630 has a first recess 630*a* into which the other-end-side developing-roller bearing 576*b* can fit, and a second recess 630*b* into which the other-end-side supplying-roller bearing 578*b* can fit. By fitting the other-end-side developing-roller bearing 576*b* into the first recess 630*a* and fitting the other-end-side supplying-roller bearing 578*b* into the second recess 630*b*, the relative position between the other-end-side developing-roller bearing 576*b* and the other-end-side supplying-roller bearing 578*b* is set. In this way, the developing roller 510 and the toner supplying roller 550 are driven even more appropriately.

===Positioning of the Gear Wheels <Part 2>===

Again, the way in which the above-mentioned gear wheels are positioned is described below with regard to the image forming apparatus according to the present embodiment. As described above, the intermediate-gear-wheel supporting section 531 and the one-end-side developing-roller bearing 576*a* of the holder 526, to which the developing roller 510 etc. is attached, are fitted, respectively, into the supporting-section fitting hole 582 and the developing-roller fitting hole 584 of the side plate 580. In this way, the relative position between the side plate 580 and the holder 526, to which the developing roller 510 etc. is attached, is set.

Further, the one-end-side supplying-roller bearing 578*a* fits into the supplying-roller fitting hole 586 of the side plate 580; furthermore, the side plate 580 is provided with the developing-device-side gear-wheel supporting section 590 for rotatably supporting the developing-device-side gear wheel 616, and the holder 526 is provided with the intermediate-gear-wheel supporting section 531 for rotatably supporting the intermediate gear wheel 614. In this way, the relative position among the developing-device-side gear-wheel supporting section 590, the intermediate-gear-wheel supporting section 531, the one-end-side developing-roller bearing 576*a*, and the one-end-side supplying-roller bearing 578*a*, is set.

Further, the developing-device-side gear wheel 616 is supported by the developing-device-side gear-wheel supporting section 590, the intermediate gear wheel 614 is supported by the intermediate-gear-wheel supporting section 531, and the developing-roller driving gear wheel 612 and the supplying-roller driving gear wheel 610 are provided, respectively, on the ends (the side on one end in the axial direction) of the developing roller 510 and the toner supplying roller 550. In this way, the relative position among the developing-device-side gear wheel 616, the intermediate gear wheel 614, the developing-roller driving gear wheel 612, and the supplying-roller driving gear wheel 610, is set.

As described above, the assembly member 525 serves to position the above-mentioned gear wheels. Further, as described above, a positioning pin 592 is provided on the side plate 580 of the assembly member 525, and this positioning pin 592 fits into the positioning-pin fitting hole 58 provided in the body of the image forming apparatus. Thus, the developing device is positioned with respect to the body of the image forming apparatus. In this way, the relative position between the apparatus-side gear wheel 56, which is provided on the body of the image forming apparatus, and the developing-device-side gear wheel 616 is set.

As described in the "Description of the Related Art", in order to let the developing device achieve appropriate developing operations, it is necessary to drive the developing roller 510 appropriately. On the other hand, in order to drive the developing roller 510 appropriately, it is necessary to design the developing device etc. so that the above-mentioned developing-device-side gear wheel 616 can appropriately receive the drive force from the body of the image forming apparatus. In cases where the developing-device-side gear wheel 616 cannot appropriately receive the drive force from the body of the image forming apparatus, then it will become difficult for the developing-device-side gear wheel 616 to transmit a sufficient amount of drive force to the developing-roller driving gear wheel 612, which may cause inappropriate driving of the developing roller 510 and result in inappropriate developing operations.

On the other hand, the developing device according to the present embodiment is provided with a holder 526 which is an example of a "first positioning member" for positioning the developing-roller driving gear wheel 612, and a side plate 580 which is an example of a "second positioning member" for positioning the developing-device-side gear wheel 616 and that has a positioning pin 592 for positioning the developing device with respect to the body of the image forming apparatus. With this structure, it is possible to appropriately prevent the above-mentioned problem from arising.

More specifically, as described above, the assembly member 525, which is an example of a "positioning member" is divided into the holder 526 and the side plate 580 in consideration of, for example, allowing easy assembly of the developing device; in the present embodiment, the developing-device-side gear wheel 616 is positioned using the side plate 580 having the positioning pin 592, and not the holder 526 without the positioning pin 592.

If the developing-device-side gear wheel 616 is positioned using the holder 526 which is not provided with the positioning pin 592 (in the case of a reference example), it not only becomes necessary to position the developing device with respect to the body of the image forming apparatus with high accuracy, but also becomes necessary to set the relative position between the side plate 580 and the holder 526 with high accuracy as well, in order to appropriately set the relative position between the apparatus-side gear wheel 56 and the developing-device-side gear wheel 616.

On the other hand, when the developing-device-side gear wheel 616 is positioned using the side plate 580 having the positioning pin 592 (in the case of the present embodiment), it is not necessary to set the relative position between the side plate 580 and the holder 526 with high accuracy in order to appropriately set the relative position between the apparatus-side gear wheel 56 and the developing-device-side gear wheel 616. Therefore, the relative position between the apparatus-side gear wheel 56 and the developing-device-side gear wheel 616 can be set reliably.

Accordingly, with the present embodiment, the developing-device-side gear wheel 616 can receive a drive force from the body of the image forming apparatus (i.e., from the apparatus-side gear wheel 56) more appropriately, and can therefore transmit a sufficient amount of drive force to the developing-roller driving gear wheel 612. As a result, the developing roller 510 is driven appropriately, achieving appropriate developing operations.

It should be noted that, as shown in FIG. 13 and FIG. 14, a bracket 630 for setting the relative position between the other-end-side developing-roller bearing **576*b* and the other-end-side supplying-roller bearing 578*b* is provided on the side of the other end, in the longitudinal direction, of the yellow developing device 54. As shown in FIG. 15, the bracket 630 has a first recess 630*a* into which the other-end-side developing-roller bearing 576*b* can fit, and a second recess 630*b* into which the other-end-side supplying-roller bearing 578*b* can fit. By fitting the other-end-side developing-roller bearing 576*b* into the first recess 630*a* and fitting the other-end-side supplying-roller bearing 578*b* into the second recess 630*b*, the relative position between the other-end-side developing-roller bearing 576*b* and the other-end-side supplying-roller bearing 578*b*** is set.

===Positioning of Toner Supplying Roller 550 and Developing Roller 510===

As described in the "Description of the Related Art", in order to make the toner supplying roller 550 achieve its function of supplying the toner T to the developing roller 510, it is necessary to position the toner supplying roller 550 and the developing roller 510 with high accuracy with respect to one another. The way in which the toner supplying roller 550 and the developing roller 510 in the developing device of the present embodiment is described below.

As described above, the toner supplying roller 550 is attached to the housing 540. More specifically, the housing 540 has, as supplying-roller fitting holes 546 into which the supplying-roller bearings 578 can fit: a one-end-side supplying-roller fitting hole **546*a* into which the one-end-side supplying-roller bearing 578*a* can fit; and an other-end-side supplying-roller fitting hole 546*b* into which the other-end-side supplying-roller bearing 578*b* can fit. The toner supplying roller 550 is rotatably supported by the housing 540 via the one-end-side supplying-roller bearing 578*a* that is fitted into the one-end-side supplying-roller fitting hole 546*a* and the other-end-side supplying-roller bearing 578*b* that is fitted into the other-end-side supplying-roller fitting hole 546*b*. In this way, the toner supplying roller 550 is positioned with respect to the housing 540**.

On the other hand, the developing roller 510 is attached to the assembly member 525. More specifically, the assembly member 525 has, as developing-roller fitting holes 530 into which the developing-roller bearings 576 can fit: a one-end-side developing-roller fitting hole **530*a* into which the one-end-side developing-roller bearing 576*a* can fit; and an other-end-side developing-roller fitting hole 530*b* into which the other-end-side developing-roller bearing 576*b* can fit. The developing roller 510 is rotatably supported by the assembly member 525 via the one-end-side developing-roller bearing 576*a* that is fitted into the one-end-side developing-roller fitting hole 530*a* and the other-end-side developing-roller bearing 576*b* that is fitted into the other-end-side developing-roller fitting hole 530*b*. In this way, the developing roller 510 is positioned with respect to the assembly member 525**.

Further, on the side of one end, in the longitudinal direction, of the yellow developing device 54, the one-end-side supplying-roller bearing 578*a*, which has been fitted into the one-end-side supplying-roller fitting hole 546*a* of the housing 540 to which the toner supplying roller 550 has been positioned, is also fitted into the supplying-roller fitting hole 586 of the assembly member 525 to which the developing roller 510 has been positioned. Furthermore, the pin 544*a* provided on the housing 540 is fitted into the pin-fitting hole 588 of the assembly member 525.

In this way, the relative position between the assembly member 525 to which the developing roller 510 has been positioned and the housing 540 to which the toner supplying roller 550 has been positioned, is set. As a result, the relative position between the toner supplying roller 550 and the developing roller 510 is set.

Further, as shown in FIG. 13 and FIG. 14, a bracket 630, which is an example of an "other-end-side positioning member" for setting the relative position between the other-end-side developing-roller bearing 576*b* and the other-end-side supplying-roller bearing 578*b*, is provided on the side of the other end, in the longitudinal direction, of the yellow developing device 54. As shown in FIG. 15, the bracket 630 has a first recess 630*a* into which the other-end-side developing-roller bearing 576*b* can fit, and a second recess 630*b* into which the other-end-side supplying-roller bearing 578*b* can fit. By fitting the other-end-side developing-roller bearing 576*b* into the first recess 630*a* and fitting the other-end-side supplying-roller bearing 578*b* into the second recess 630*b*, the relative position between the other-end-side developing-roller bearing 576*b* and the other-end-side supplying-roller bearing 578*b* is set. In this way, the relative positioning of the toner supplying roller 550 and the developing roller 510 becomes even more reliable.

<Effectiveness of Developing Device etc. of the Present Embodiment>

As described above, the developing device of the present embodiment is provided with: a developing roller 510 for bearing toner T; an assembly member 525 to which the developing roller 510 is attached; a toner supplying roller 550 for supplying the toner T to the developing roller 510; a housing 540 to which the toner supplying roller 550 is attached; and a supplying-roller bearing 578 (that is, one-end-side supplying-roller bearing 578*a*) for relatively positioning the assembly member 525 and the housing 540 and for receiving the shaft of the toner supplying roller 550. In this way, it becomes possible to achieve a developing device etc. in which the toner supplying roller 550 and the developing roller 510 can be positioned with high accuracy using a simple structure.

That is, as described in the "Description of the Related Art", in order to make the toner supplying roller 550 achieve its function of supplying the toner T to the developing roller 510, it is necessary to position the toner supplying roller 550 and the developing roller 510 with high accuracy. Further, it is preferable that this positioning is achieved with a simple structure.

With the developing device of the present embodiment, the supplying-roller bearing 578 for receiving the shaft of the toner supplying roller 550 functions as to relatively position the assembly member 525 and the housing 540. Therefore, the relative positioning between the toner supplying roller 550 and the developing roller 510 provided on the assembly member 525 can be set with higher accuracy, compared to a case in which a member having no relation with the toner supplying roller 550 sets the relative position.

Further, since the supplying-roller bearing 578 for receiving the shaft of the toner supplying roller 550 also has the function of relatively positioning the assembly member 525 and the housing 540, it is not necessary to provide a dedicated structural member for setting the relative position. As a result, a high-accuracy positioning of the toner supplying roller 550 and the developing roller 510 can be achieved with a simple structure.

As described above, with the foregoing embodiment, it becomes possible to achieve a developing device etc. in which the toner supplying roller 550 and the developing roller 510 can be positioned with high accuracy using a simple structure.

===Other Considerations===

In the foregoing embodiment, the assembly member 525 was structured of two separate members, that is, the holder 526 and the side plate 580. This, however, is not a limitation, and the assembly member 525 may be a single member.

Further, in the foregoing embodiment, the developing device had an intermediate gear wheel 614 that serves as a medium when the developing-device-side gear wheel 616 transmits the drive force to the developing-roller driving gear wheel 612; in a state where the developing device is attached to the body of the image forming apparatus, the developing-device-side gear wheel 616 received the drive force from the body of the image forming apparatus and transmitted the drive force to the developing-roller driving gear wheel 612 via the intermediate gear wheel 614; and the intermediate gear wheel 614 was positioned using the assembly member 525 or the holder 526. This, however, is not a limitation. For example, the present invention is applicable to a developing device that does not have an intermediate gear wheel 614 and in which the developing-device-side gear wheel 616 directly transmits the drive force to the developing-roller driving gear wheel 612.

Further, in the foregoing embodiment, the first driving wheel, the second driving wheel, and the third driving wheel were the developing-roller driving gear wheel 612, the developing-device-side gear wheel 616, and the intermediate gear wheel 614, respectively; the assembly member 525 had a developing-roller fitting hole 530 for rotatably supporting the developing roller 510, a developing-device-side gear-wheel supporting section 590 for rotatably supporting the developing-device-side gear wheel 616, and an intermediate-gear-wheel supporting section 531 for rotatably supporting the intermediate gear wheel 614; the developing-device-side gear wheel 616 supported by the developing-device-side gear-wheel supporting section 590 meshed with the intermediate gear wheel 614 supported by the intermediate-gear-wheel supporting section 531; and the intermediate gear wheel 614 meshed with the developing-roller driving gear wheel 612 that is provided on the developing roller 510 supported by the developing-roller fitting hole 530. This, however, is not a limitation. For example, the first driving wheel, the second driving wheel, and the third driving wheel may be band wheels, and a belt may be spanned across the second driving wheel and the third driving wheel, and across the third driving wheel and the first driving wheel.

The foregoing embodiment, however, is more preferable in terms that the structure of the driving-system members is simplified.

Further, in the foregoing embodiment, the developing device had a toner supplying roller 550 for supplying the toner T to the developing roller 510, and a supplying-roller driving gear wheel 610 that is provided on an end of the toner supplying roller 550 and that is for driving the toner supplying roller 550; in a state where the developing device is attached to the body of the image forming apparatus, the developing-device-side gear wheel 616 received the drive force from the body of the image forming apparatus and transmitted the drive force to the supplying-roller driving gear wheel 610; and the supplying-roller driving gear wheel 610 was positioned using the assembly member 525. This, however, is not a limitation. For example, the present invention is applicable to a developing device that does not have a toner supplying roller 550 nor a supplying-roller driving gear wheel 610.

Further, in a developing device having a toner supplying roller 550 and a supplying-roller driving gear wheel 610, the supplying-roller driving gear wheel 610 may be positioned not using the assembly member 525 made of metal, but using another member made, for example, of resin. The foregoing embodiment, however, is more preferable because the supplying-roller driving gear wheel 610 is positioned with high accuracy and the toner supplying roller 550 is thus driven appropriately, and therefore, it is possible to achieve a developing device with which the developing operations can be performed appropriately.

Further, in the foregoing embodiment, the first driving wheel and the fourth driving wheel were a developing-roller driving gear wheel 612 and a supplying-roller driving gear wheel 610, respectively; the assembly member 525 had a supplying-roller fitting hole 586 for rotatably supporting the toner supplying roller 550; and the developing-roller driving gear wheel 612 meshed with the supplying-roller driving gear wheel 610 that is provided on the toner supplying roller 550 supported by the supplying-roller fitting hole 586. This, however, is not a limitation. For example, the first driving wheel and the fourth driving wheel may be band wheels, and a belt may be spanned across the first driving wheel and the fourth driving wheel.

The foregoing embodiment, however, is more preferable in terms that the structure of the driving-system members is simplified.

Further, in the foregoing embodiment, the assembly member 525 had a positioning pin 592 for positioning the developing device with respect to the body of the image forming apparatus; the body of the image forming apparatus had a positioning-pin fitting hole 58 into which the positioning pin 592 can fit, and an apparatus-side gear wheel 56 that gives the drive force to the developing-device-side gear wheel 616; the developing device was positioned with respect to the body of the image forming apparatus by fitting the positioning pin 592 into the positioning-pin fitting hole 58; and the developing-device-side gear wheel 616 received the drive force from the apparatus-side gear wheel 56 and transmitted the drive force to the developing-roller driving gear wheel 612. This, however, is not a limitation. For example, the assembly member 525 does not have to be provided with the positioning pin 592.

The foregoing embodiment, however, is more preferable in terms that the developing roller 510 etc. is driven even more appropriately because the relative position of the apparatus-side gear wheel 56 and the developing-device-side gear wheel 616 is set with high accuracy, as described above.

Further, in the foregoing embodiment, the first driving wheel, the second driving wheel, and the third driving wheel were the developing-roller driving gear wheel 612, the developing-device-side gear wheel 616, and the intermediate gear wheel 614, respectively; the holder 526 had a developing-roller fitting hole 530 for rotatably supporting the developing roller 510, and an intermediate-gear-wheel supporting section 531 for rotatably supporting the intermediate gear wheel 614; the side plate 580 had a developing-device-side gear-wheel supporting section 590 for rotatably supporting the developing-device-side gear wheel 616; the developing-device-side gear wheel 616 supported by the developing-device-side gear-wheel supporting section 590 meshed with the intermediate gear wheel 614 supported by the intermediate-gear-wheel supporting section 531; and the intermediate gear wheel 614 meshed with the developing-roller driving gear wheel 612 that is provided on the developing roller 510 supported by the developing-roller fitting hole 530. This, however, is not a limitation. For example, the first driving wheel, the second driving wheel, and the third driving wheel may be band wheels, and a belt may be spanned across the second driving wheel and the third driving wheel, and across the third driving wheel and the first driving wheel.

The foregoing embodiment, however, is more preferable in terms that the structure of the driving-system members is simplified.

Further, in the foregoing embodiment, the developing-roller fitting hole 530 of the holder 526 rotatably supported the developing roller 510 via a developing-roller bearing 576; the side plate 580 had a supporting-section fitting hole 582 into which the intermediate-gear-wheel supporting section 531 of the holder 526 can fit, and a developing-roller fitting hole 584 into which the developing-roller bearing 576 can fit; and the holder 526 and the side plate 580 were positioned by fitting the intermediate-gear-wheel supporting section 531 into the supporting-section fitting hole 582 and fitting the developing-roller bearing 576 into the developing-roller fitting hole 584. This, however, is not a limitation. For example, the holder 526 and the side plate 580 do not have to be positioned.

Further, in the foregoing embodiment, the assembly member 525 and the housing 540 had, respectively, a supplying-roller fitting hole 586 and a supplying-roller fitting hole 546 into which the supplying-roller bearing 578 can fit; the toner supplying roller 550 was rotatably supported by the housing 540 via the supplying-roller bearing 578 that is fitted into the supplying-roller fitting hole 546; and the assembly member 525 and the housing 540 were relatively positioned by fitting the supplying-roller bearing 578 that is fitted into the supplying-roller fitting hole 546 also into the supplying-roller fitting hole 586. This, however, is not a limitation. For example, a portion of the housing may have the function of a supplying-roller bearing.

Further, in the foregoing embodiment, the developing device had a developing-roller bearing 576 for receiving a shaft 510*a* of the developing roller 510; the assembly member 525 had a developing-roller fitting hole 530 into which the developing-roller bearing 576 can fit; and the developing roller 510 was rotatably supported by the assembly member 525 via the developing-roller bearing 576 that is fitted into the developing-roller fitting hole 530. This, however, is not a limitation. For example, a portion of the assembly member may have the function of a developing-roller bearing.

Further, in the foregoing embodiment, the developing device had, as the supplying-roller bearing 578, a one-end-side supplying-roller bearing 578*a* positioned on a side of one end, in a longitudinal direction, of the yellow developing device 54, and an other-end-side supplying-roller bearing 578*b* positioned on a side of the other end, in the longitudinal direction, of the yellow developing device 54; the housing 540 had, as the supplying-roller fitting hole 546, a one-end-side supplying-roller fitting hole 546*a* into which the one-end-side supplying-roller bearing 578*a* can fit, and an other-end-side supplying-roller fitting hole 546*b* into which the other-end-side supplying-roller bearing 578*b* can fit; the toner supplying roller 550 was rotatably supported by the housing 540 via the one-end-side supplying-roller bearing 578*a* that is fitted into the one-end-side supplying-roller fitting hole 546*a* and the other-end-side supplying-roller bearing 578*b* that is fitted into the other-end-side supplying-roller fitting hole 546*b*; the yellow developing device 54 had, as the developing-roller bearing 576, a one-end-side developing-roller bearing 576*a* positioned on the side of one end, in the longitudinal direction, of the yellow developing device 54, and an other-end-side developing-roller bearing 576*b* positioned on the side of the other end, in the longitudinal direction, of the yellow developing device 54; the assembly member 525 had, as the developing-roller fitting hole 530, a one-end-side developing-roller fitting hole 530*a* into which the one-end-side developing-roller bearing 576*a* can fit, and an other-end-side developing-roller fitting hole 530*b* into which the other-end-side developing-roller bearing 576*b* can fit; the developing roller 510 was rotatably supported by the assembly member 525 via the one-end-side developing-roller bearing 576*a* that is fitted into the one-end-side developing-roller fitting hole 530*a* and the other-end-side developing-roller bearing 576*b* that is fitted into the other-end-side developing-roller fitting hole 530*b*; the assembly member 525 had, only on the side of one end of the yellow developing device 54 in the longitudinal direction, the supplying-roller fitting hole 586 into which the one-end-side supplying-roller bearing 578*a* can fit; and the assembly member 525 and the housing 540 were relatively positioned by fitting the one-end-side supplying-roller bearing 578*a* that is fitted into the one-end-side supplying-roller fitting hole 546*a* also into the supplying-roller fitting hole 586. This, however, is not a limitation. For example, the assembly member may have supplying-roller fitting holes, into which the supplying-roller bearings can fit, provided in both the one-end-side and the other-end-side in the longitudinal direction of the yellow developing device; and the assembly member and the housing may be relatively positioned by fitting the supplying-roller bearings into those supplying-roller fitting holes at both the one-end-side and the other-end-side in the longitudinal direction.

Further, in the foregoing embodiment, on the side of one end of the yellow developing device 54 in the longitudinal direction, a pin 544*a* was provided on either one of the assembly member 525 and the housing 540, and a pin-fitting hole 588 into which the pin 544*a* can fit was provided in the other of the assembly member 525 and the housing 540; and the pin 544*a* was fitted into the pin-fitting hole 588. This, however, is not a limitation. For example, the pin and the pin-fitting hole do not have to be provided.

The foregoing embodiment, however, is more preferable in terms that the positioning of the assembly member 525 and the housing 540 becomes even more reliable.

Further, in the foregoing embodiment, the developing device had, on the side of the other end of the yellow developing device 54 in the longitudinal direction, a bracket 630 for relatively positioning the other-end-side supplying-roller bearing 578*b* and the other-end-side developing-roller bearing 576*b*. This, however, is not a limitation. For example, the bracket 630 does not have to be provided.

The foregoing embodiment, however, is more preferable in terms that the relative position of the toner supplying roller 550 and the developing roller 510 can be set even more reliably.

SECOND EMBODIMENT

===Overall Configuration Example of Image Forming Apparatus===

Figure 16:
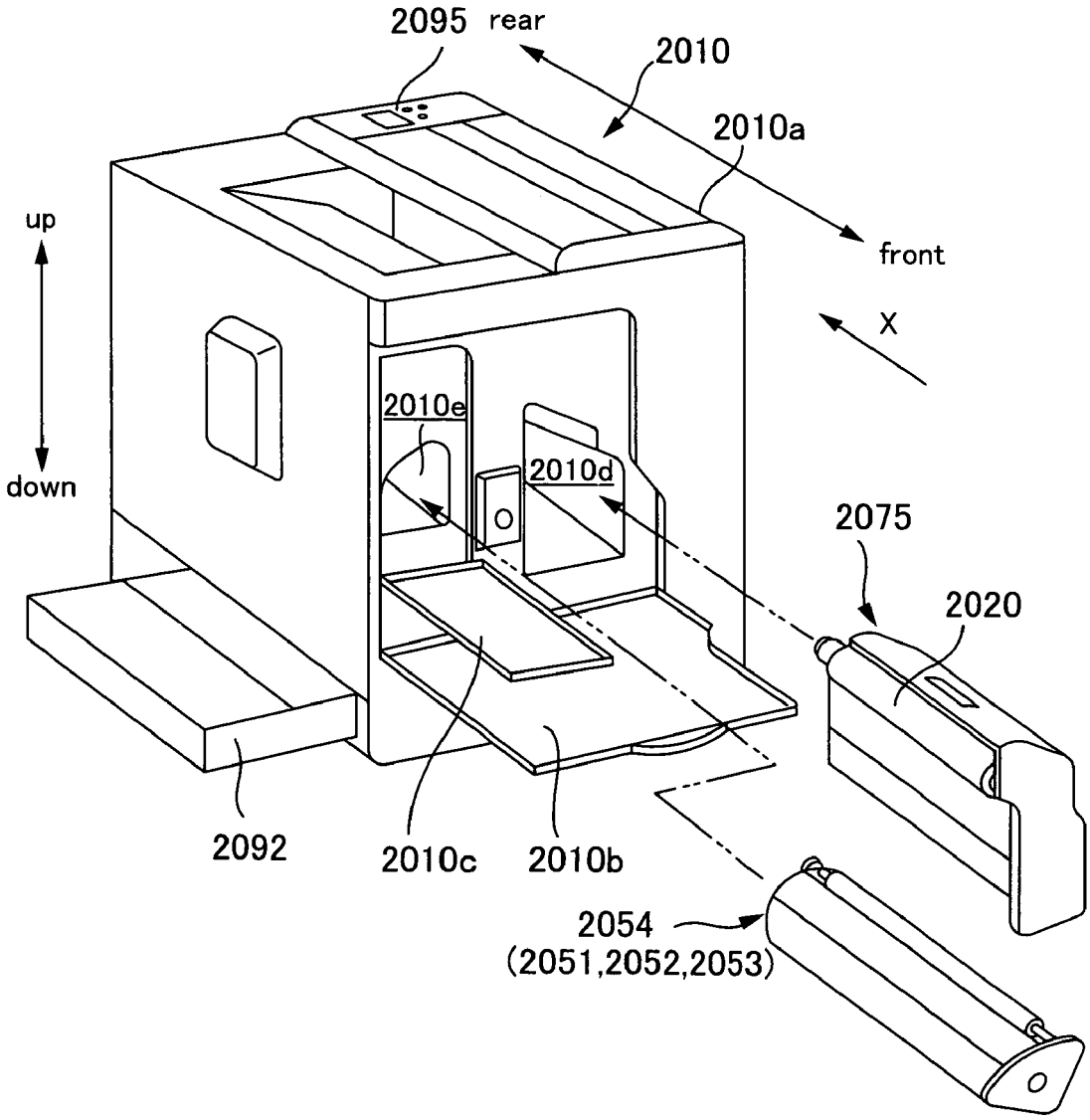
FIG. 16 is a diagram for illustrating the attach/detach configuration of developing units 2051, 2052, 2053, and 2054 with respect to a body 2010*a* of a printer.
Figure 17:
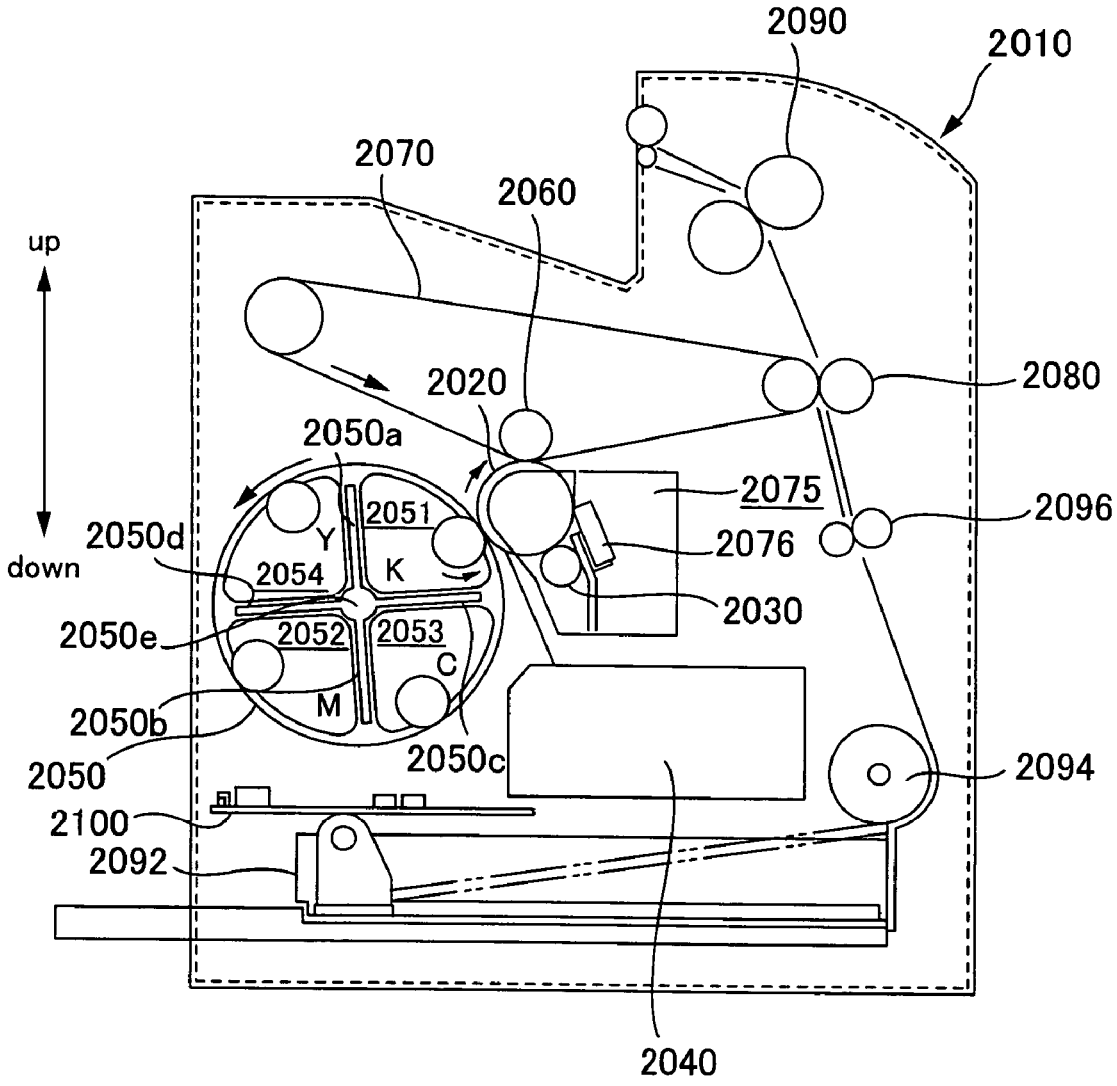
FIG. 17 is a diagram showing main structural components constructing the printer 2010.

Next, using FIG. 16 and FIG. 17, an outline of a laser beam printer 2010 (referred to also as "printer 2010" below), which is an example of an image forming apparatus, is described. FIG. 16 is a diagram for illustrating the attach/detach configuration of the developing units 2051, 2052, 2053, and 2054 with respect to the body 2010*a* of the printer. FIG. 17 is a diagram showing main structural components constructing the printer 2010. It should be noted that FIG. 17 is a section view taken along a direction perpendicular to the X-direction shown in FIG. 16. Further, in FIG. 16 and FIG. 17, the vertical direction is shown by the arrow, and, for example, a paper supply tray 2092 is arranged at a lower section of the printer 2010, and a fusing unit 2090 is arranged at an upper section of the printer 2010.

<Attach/Detach Configuration>

To/from the body 2010*a* of the printer, which is an example of a "body of an image forming apparatus", it is possible to attach/detach the developing units 2051, 2052, 2053, and 2054, which are an example of a "developing device", and a photoconductor unit 2075. The printer 2010 is structured by attaching the developing units 2051, 2052, 2053, and 2054 and the photoconductor unit 2075 to the body 2010*a* of the printer.

The body 2010*a* of the printer has a first open/close cover 2010*b* which is openable and closable, a second open/close cover 2010*c* which is openable and closable and is provided further inward of the first open/close cover 2010*b*, a photoconductor unit attach/detach opening 2010*d* through which the photoconductor unit 2075 is attached and detached, and a developing unit attach/detach opening 2010*e* through which the developing units 2051, 2052, 2053, and 2054 are attached and detached.

By opening the first open/close cover 2010*b*, the user is able attach/detach the photoconductor unit 2075 to/from the body 2010*a* of the printer through the photoconductor unit attach/detach opening 2010*d*. Further, by opening the second open/close cover 2010*c*, the user is able attach/detach the developing unit 2051, 2052, 2053, and 2054 to/from the body 2010*a* of the printer through the developing unit attach/detach opening 2010*e*.

<Configuration of Printer 2010>

A configuration of the printer 2010 with the developing units 2051, 2052, 2053, and 2054 and the photoconductor unit 2075 attached to the printer body 2010*a* will be described.

As shown in FIG. 17, the printer 2010 according to the present embodiment includes a charging unit 2030, an exposing unit 2040, a developing-unit holding unit 2050, a first transferring unit 2060, an intermediate transferring body 2070, and a cleaning blade 2076. These components are arranged in the direction of rotation of a photoconductor 2020, which serves as an example of an "image bearing body" for bearing a latent image. The printer 2010 further includes a second transferring unit 2080, a fusing unit 2090, a displaying unit 2095 constructed of a liquid-crystal panel and serving as means for making notifications to the user etc., and a control unit 2100 for controlling these units etc. and managing the operations as a printer.

The photoconductor 2020 has a cylindrical electrically-conductive base and a photoconductive layer formed on the outer peripheral surface of the electrically-conductive base, and it is rotatable about its central axis. In the present embodiment, the photoconductor 2020 rotates clockwise, as shown by the arrow in FIG. 17.

The charging unit 2030 is a device for charging the photoconductor 2020. The exposing unit 2040 is a device for forming a latent image on the charged photoconductor 2020 by radiating a laser beam thereon. The exposing unit 2040 has, for example, a semiconductor laser, a polygon mirror, and an F-θ lens, and radiates a modulated laser beam onto the charged photoconductor 2020 according to image signals having been input from a not-shown host computer such as a personal computer or a word processor.

The developing-unit holding unit 2050 is a device for developing the latent image formed on the photoconductor 2020 using toner T, that is, black (K) toner contained in a black developing unit 2051, magenta (M) toner contained in a magenta developing unit 2052, cyan (C) toner contained in a cyan developing unit 2053, and yellow (Y) toner contained in a yellow developing unit 2054. The toner T is an example of a "developer" contained in each of the developing units 2051, 2052, 2053, and 2054 that has been moved to a predetermined position (developing position).

In the present embodiment, the developing-unit holding unit 2050 rotates to allow the positions of the four developing units 2051, 2052, 2053, and 2054 to be moved. More specifically, the developing-unit holding unit 2050 holds the four developing units 2051, 2052, 2053, and 2054 with four attach/detach sections 2050*a*, 2050*b*, 2050*c*, and 2050*d*, respectively, and the four developing units 2051, 2052, 2053, and 2054 can be rotated (moved) along with the rotation (movement) of the attach/detach sections about a rotating shaft 2050*e*. A different one of the developing units is made to selectively oppose the photoconductor 2020 each time the photoconductor 2020 makes one revolution, thereby successively developing the latent image formed on the photoconductor 2020 using the toner contained in each of the developing units 2051, 2052, 2053, and 2054. It should be noted that details on the developing units are described further below.

The first transferring unit 2060 is a device for transferring, onto the intermediate transferring body 2070, a single-color toner image formed on the photoconductor 2020. When toner images of four colors are successively transferred in a superposed manner, a full-color toner image is formed on the intermediate transferring body 2070. The intermediate transferring body 2070 is an endless belt that is driven to rotate at substantially the same circumferential speed as the photoconductor 2020.

The second transferring unit 2080 is a device for transferring the single-color toner image, or the full-color toner image, formed on the intermediate transferring body 2070 onto a recording medium such as paper, film, and cloth. The fusing unit 2090 is a device for fusing the single-color toner image or the full-color toner image, which has been transferred to the recording medium, onto the recording medium such as paper to make it into a permanent image.

The cleaning blade 2076 is made of rubber and abuts against the surface of the photoconductor 2020. The cleaning blade 2076 removes the toner remaining on the photoconductor 2020 by scraping it off after the toner image has been transferred onto the intermediate transferring body 2070 by the first transferring unit 2060.

The photoconductor unit 2075 is provided between the first transferring unit 2060 and the exposing unit 2040, and includes the photoconductor 2020, the charging unit 2030, the cleaning blade 2076, and a waste-toner containing section (not shown) for containing the toner that has been scraped off by the cleaning blade 2076.

Figure 18:
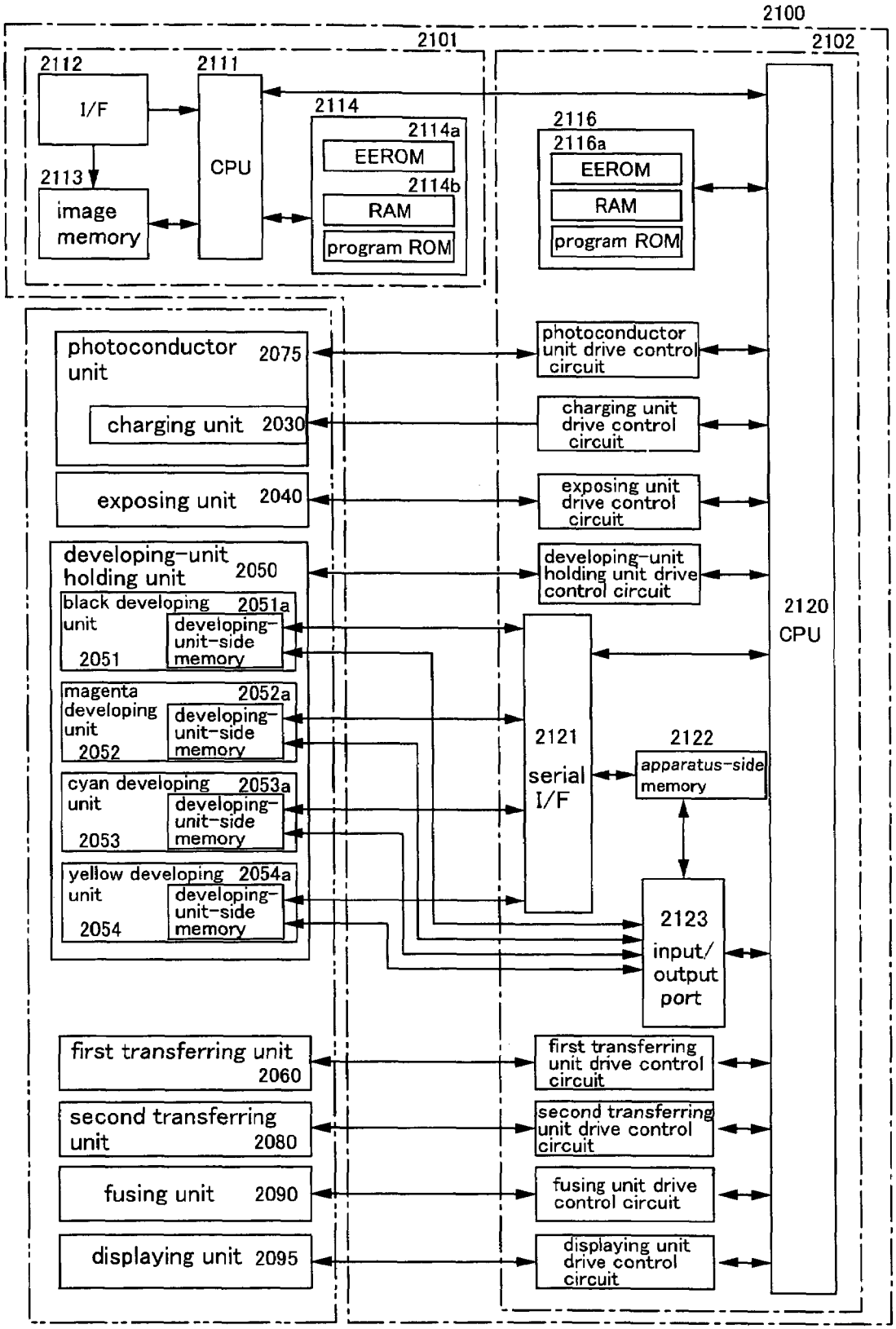
FIG. 18 is a block diagram showing a control unit 2100 of the printer 2010.

The control unit 2100 includes a main controller 2101 and a unit controller 2102 as shown in FIG. 18. Image signals are input to the main controller 2101, and according to instructions based on these image signals, the unit controller 2102 controls each of the above-mentioned units etc. to form an image.

<Operation of Printer 2010>

Next, operations of the printer 2010 structured as above are described, referring also to other structural components.

When image signals are input from the not-shown host computer to the main controller 2101 of the printer 2010 through an interface (I/F) 2112, the photoconductor 2020, a developing roller 2510 that is provided in each of the developing units 2051, 2052, 2053, and 2054, and the intermediate transferring body 2070 rotate under the control of the unit controller 2102 according to the instructions from the main controller 2101. While being rotated, the photoconductor 2020 is successively charged by the charging unit 2030 at a charging position.

With the rotation of the photoconductor 2020, the charged area of the photoconductor 2020 reaches an exposing position. A latent image that corresponds to the image information for the first color, for example, yellow Y, is formed in that area by the exposing unit 2040. The developing-unit holding unit 2050 positions the yellow developing unit 2054, which contains yellow (Y) toner, at the developing position opposing the photoconductor 2020.

With the rotation of the photoconductor 2020, the latent image formed on the photoconductor 2020 reaches the developing position, and is developed with the yellow toner by the yellow developing unit 2054. Thus, a yellow toner image is formed on the photoconductor 2020.

With the rotation of the photoconductor 2020, the yellow toner image formed on the photoconductor 2020 reaches a first transferring position, and is transferred onto the intermediate transferring body 2070 by the first transferring unit 2060. At this time, a first transferring voltage, which is in an opposite polarity to the polarity to which the toner is charged, is applied to the first transferring unit 2060. It should be noted that, during this process, the second transferring unit 2080 is kept separated from the intermediate transferring body 2070.

By repeating the above-mentioned processes for the second, the third, and the fourth colors, toner images in four colors corresponding to the respective image signals are transferred to the intermediate transferring body 2070 in a superimposed manner. As a result, a full-color toner image is formed on the intermediate transferring body 2070.

With the rotation of the intermediate transferring body 2070, the full-color toner image formed on the intermediate transferring body 2070 reaches a second transferring position, and is transferred onto a recording medium by the second transferring unit 2080. It should be noted that the recording medium is carried from the paper supply tray 2092 to the second transferring unit 2080 via the paper-feed roller 2094 and resisting rollers 2096. During transferring operations, a second transferring voltage is applied to the second transferring unit 2080 and also the unit 2080 is pressed against the intermediate transferring body 2070.

The full-color toner image transferred onto the recording medium is heated and pressurized by the fusing unit 2090 and fused to the recording medium. On the other hand, after the photoconductor 2020 passes the first transferring position, the toner adhering to the surface of the photoconductor 2020 is scraped off by the cleaning blade 2076, and the photoconductor 2020 is prepared for charging for the next latent image to be formed. The scraped-off toner is collected into the waste-toner containing section.

===Overview of Control Unit===

Next, with reference to FIG. 18, the configuration of the control unit 2100 will be described. FIG. 18 is a block diagram showing the control unit 2100 of the printer 2010. The control unit 2100 includes a main controller 2101 and a unit controller 2102.

The main controller 2101 includes a CPU 2111, an interface 2112 for establishing connection with the not-shown computer, an image memory 2113 for storing image signals that have been input from the computer, and a main-controller-side memory 2114 that is made up of, for example, an electrically rewritable EEPROM 2114*a*, a RAM 2114*b*, and a programmable ROM in which various programs for control are written.

The CPU 2111 of the main controller 2101 manages control of writing/reading of image data, which has been input via the interface, to/from the image memory 2113, and also manages overall control of the apparatus in synchronism with the CPU 2120 of the unit controller 2102 according to control signals that have been input from the computer.

The unit controller 2102 includes, for example, a CPU 2120, a unit-controller-side memory 2116 that is made up of, for example, an electrically rewritable EEPROM 2116*a*, a RAM, and a programmable ROM in which various programs for control are written, and various drive control circuits for driving and controlling the units in the apparatus body (i.e., the charging unit 2030, the exposing unit 2040, the developing-unit holding unit 2050, the first transferring unit 2060, the photoconductor unit 2075, the second transferring unit 2080, the fusing unit 2090, and the displaying unit 2095).

The CPU 2120 of the unit controller 2102 is electrically connected to each of the drive control circuits and controls the drive control circuits according to control signals from the CPU 2111 of the main controller 2101. More specifically, the CPU 2120 controls each of the units according to signals received from the main controller 2101 while detecting the state of each of the units and the developing-unit holding unit 2050 by receiving signals from sensors etc. provided in each unit.

Further, the CPU 2120 of the unit controller 2102 is connected, via a serial interface (I/F) 2121, to a non-volatile storage element 2122 (which is referred to below as "apparatus-side memory") which is, for example, a serial EEPROM. Data necessary for controlling the apparatus are stored in the apparatus-side memory 2122. The CPU 2120 is not only connected to the apparatus-side memory 2122, but is also connected to the developing-unit-side memories 2051*a*, 2052*a*, 2053*a*, and 2054*a*, which are provided on the respective developing units 2051, 2052, 2053, and 2054, via the serial interface 2121. Therefore, data can be exchanged between the apparatus-side memory 2122 and the developing-unit-side memories 2051*a*, 2052*a*, 2053*a*, and 2054*a*, and also, it is possible to input chip-select signals CS to the developing-unit-side memories 2051*a*, 2052*a*, 2053*a*, and 2054*a* via an input/output port 2123.

===Overview of Developing Unit===

Figure 19:
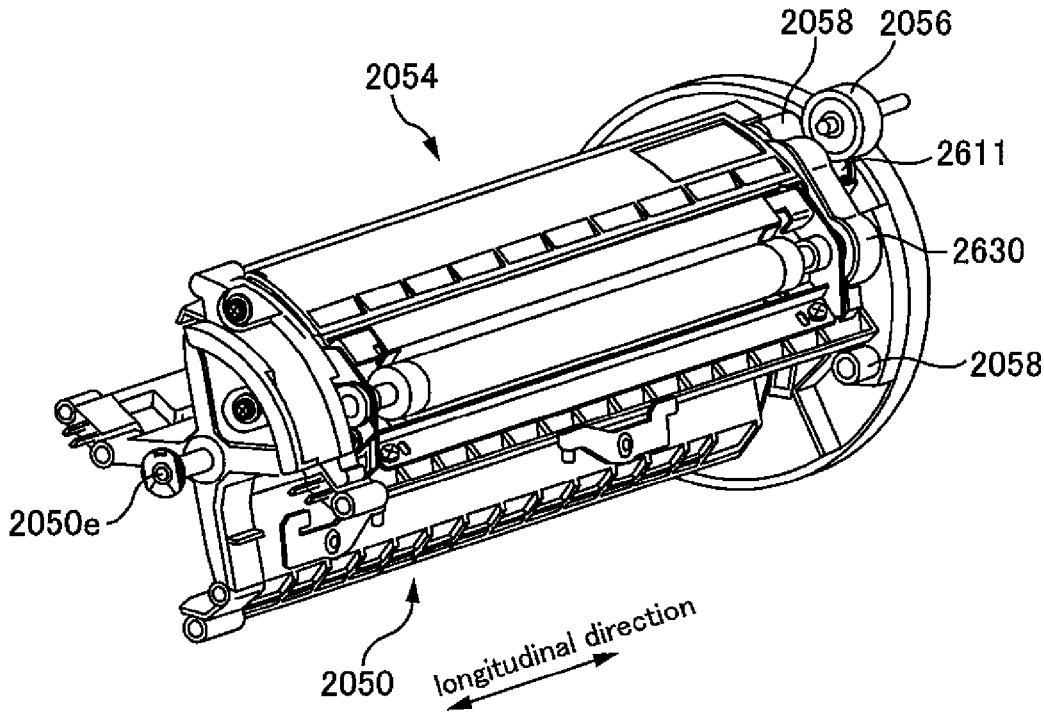
FIG. 19 is a diagram showing a state in which a yellow developing unit 2054 is attached to an attach/detach section 2050*d;*
Figure 20:
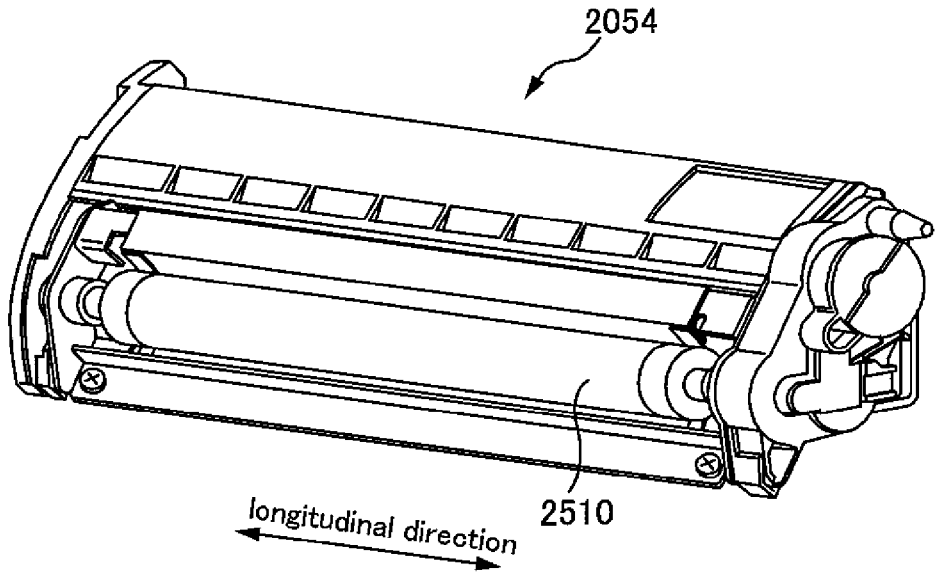
FIG. 20 is a perspective view of the yellow developing unit 2054.
Figure 21:
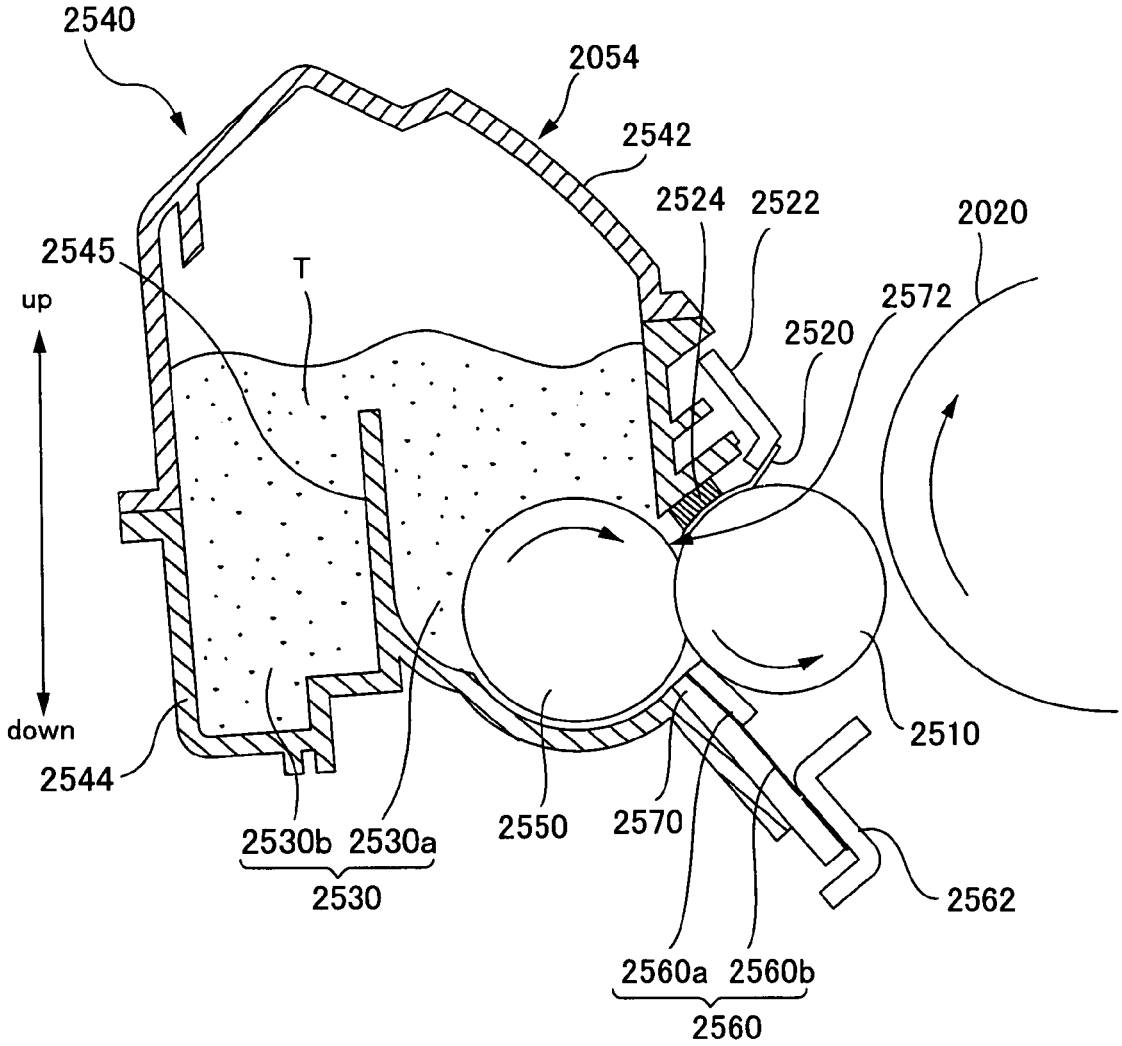
FIG. 21 is a section view showing main structural components of the yellow developing unit 2054.
Figure 22:
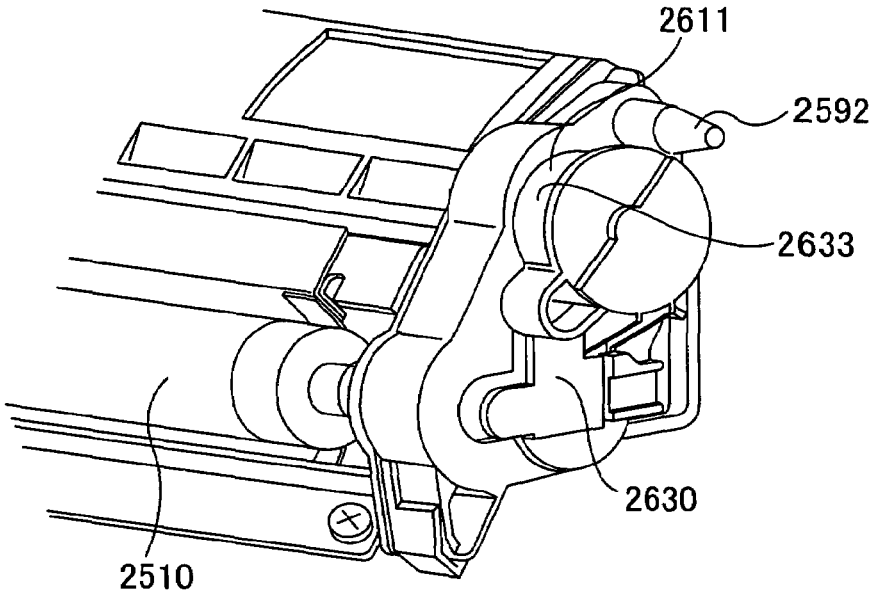
FIG. 22 is a perspective view showing a driving section of the yellow developing unit 2054.
Figure 23:
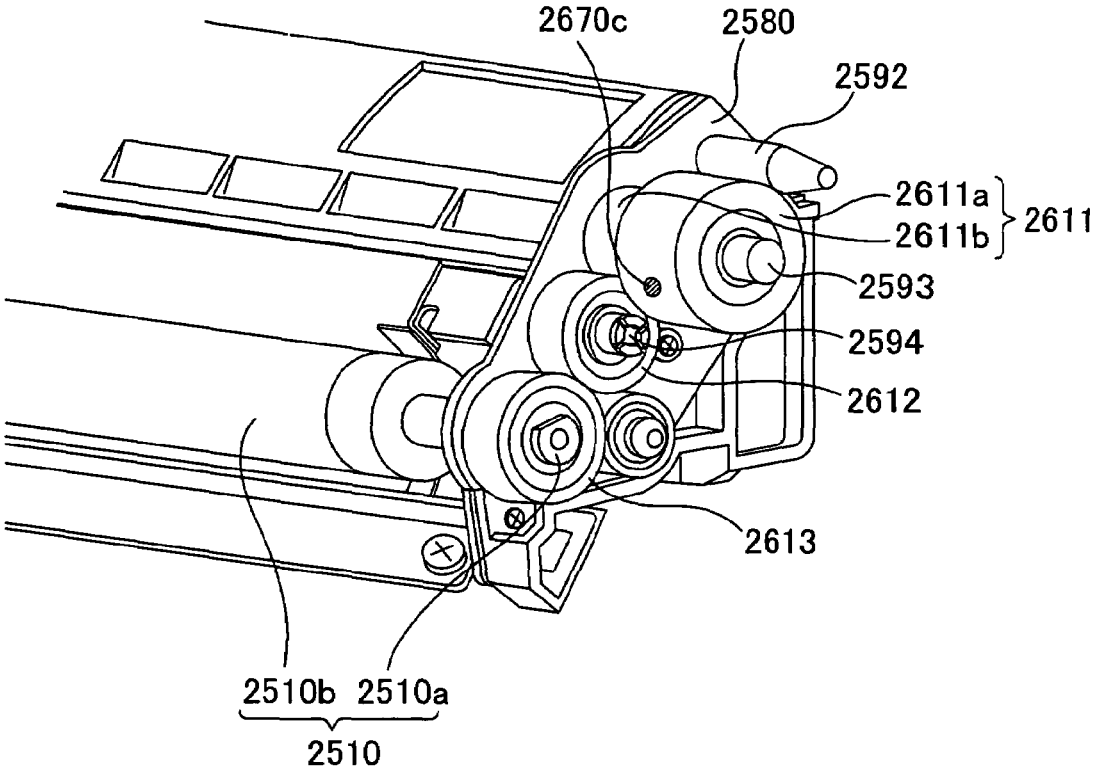
FIG. 23 is a perspective view showing the driving section with the cover 2630 taken off.
Figure 24:
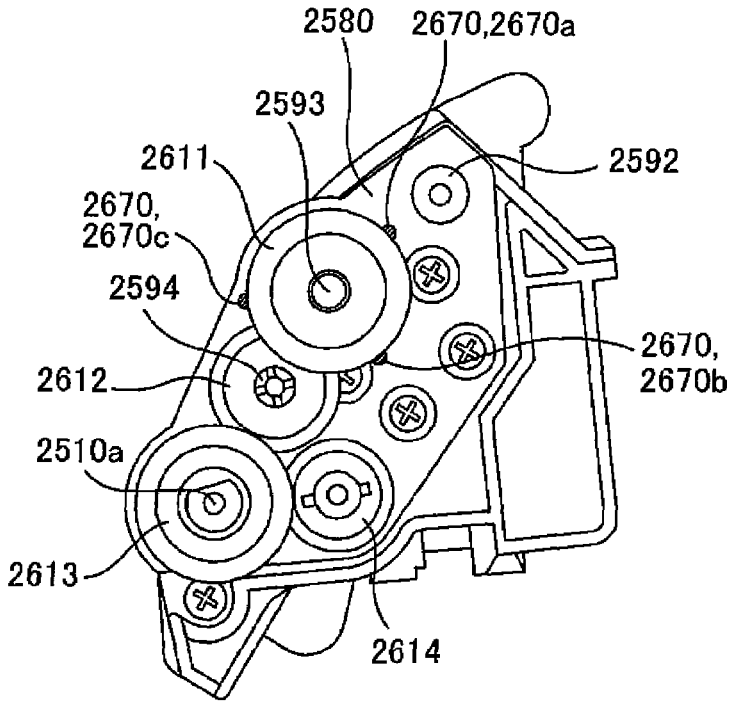
FIG. 24 is a front view showing the driving section of the yellow developing unit 2054.
Figure 25:
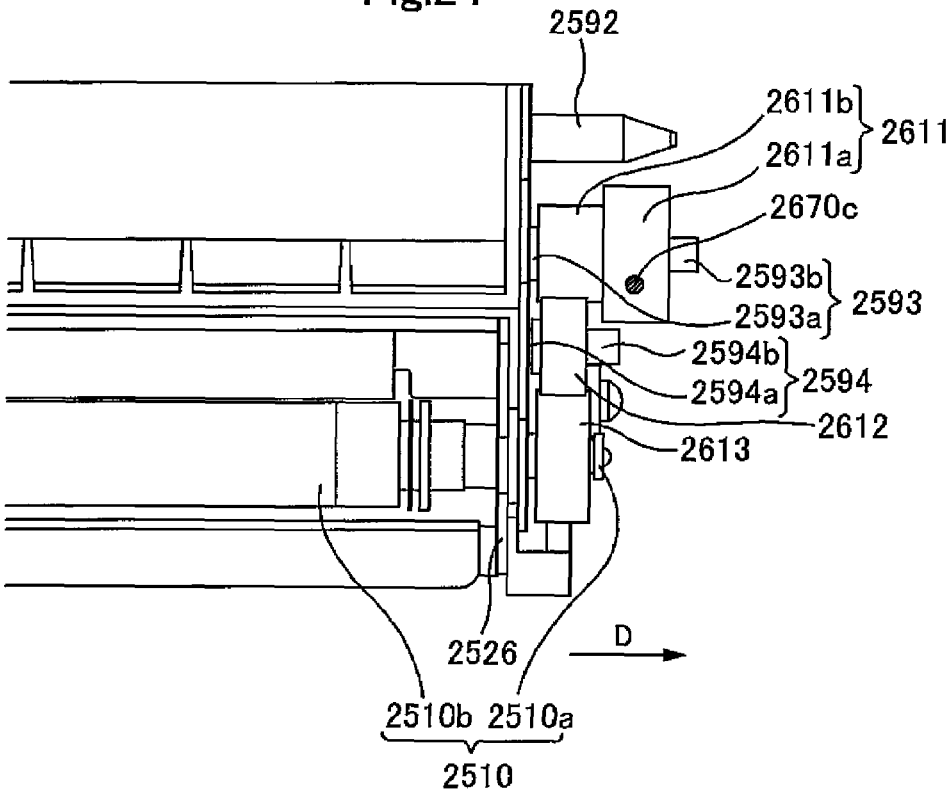
FIG. 25 is a side view showing the driving section of the yellow developing unit 2054.
Figure 26:
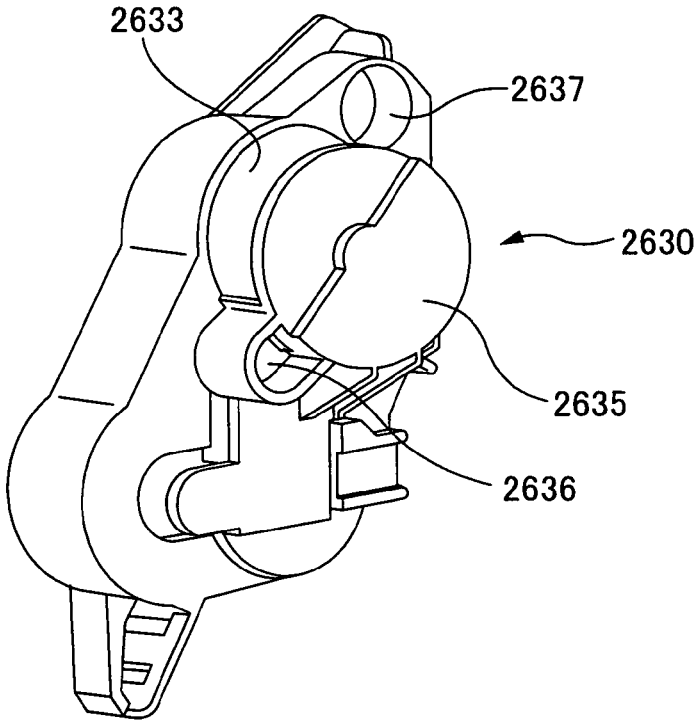
FIG. 26 is a perspective view of the cover 2630.
Figure 27:
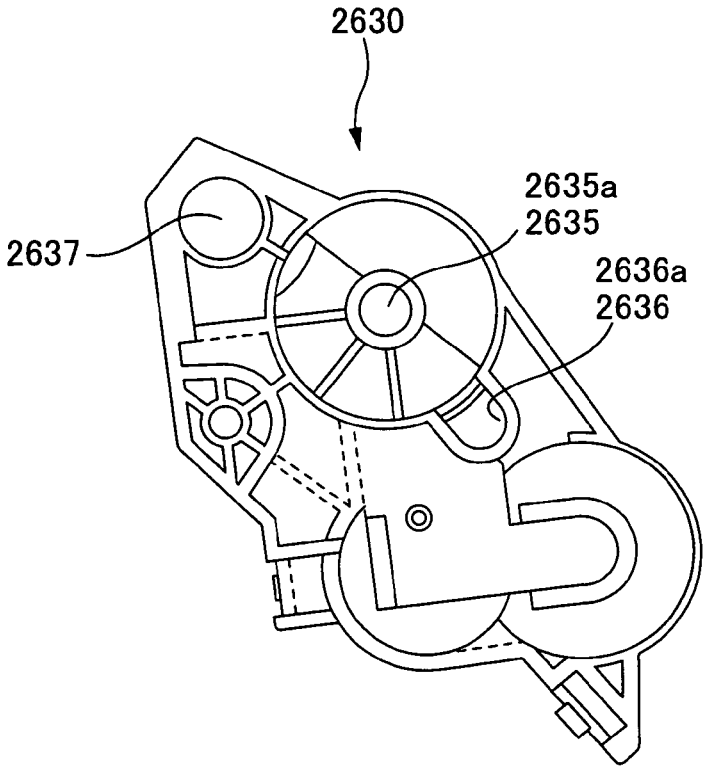
FIG. 27 is a diagram showing the back side of the cover 2630.

Next, with reference to FIG. 19 through FIG. 27, an internal structure, a configuration of a driving section, and operations of the developing units 2051, 2052, 2053, and 2054 will be described. FIG. 19 is a diagram showing a state in which a yellow developing unit 2054 is attached to an attach/detach section 2050*d*. FIG. 20 is a perspective view of the yellow developing unit 2054. FIG. 21 is a section view showing main structural components of the yellow developing unit 2054. FIG. 22 is a perspective view showing a driving section of the yellow developing unit 2054. FIG. 23 is a perspective view showing the driving section with the cover 2630 taken off. FIG. 24 is a front view showing the driving section with the cover 2630 taken off. FIG. 25 is a side view showing the driving section with the cover 2630 taken off. FIG. 26 is a perspective view of the cover 2630. FIG. 27 is a diagram showing the back side of the cover 2630.

It should be noted that the section view shown in FIG. 21 is a cross section of the yellow developing unit 2054 taken along a plane perpendicular to the longitudinal direction shown in FIG. 20. Further, in FIG. 21, the arrow indicates the vertical direction as in FIG. 16, and, for example, the central axis of the developing roller 2510 is located below the central axis of the photoconductor 2020. Further, in FIG. 21, the yellow developing unit 2054 is shown to be in a state where it is positioned at the developing position opposing the photoconductor 2020.

To the developing-unit holding unit 2050, it is possible to attach: the black developing unit 2051 containing black (K) toner; the magenta developing unit 2052 containing magenta (M) toner; the cyan developing unit 2053 containing cyan (C) toner; and the yellow developing unit 2054 containing yellow (Y) toner. Since the internal structure, the configuration of the driving section, and the operations of the developing units are the same, explanation will be made only about the yellow developing unit 2054 below.

<Internal Structure of Yellow Developing Unit 2054>

First, the internal structure of the yellow developing unit 2054 will be described. The yellow developing unit 2054 has the developing roller 2510 which is an example of a "developer bearing body", a toner containing section 2530, a housing 2540, a toner supplying roller 2550, a restriction blade 2560, and a sealing member 2520.

The developing roller 2510 bears toner T and delivers it to the developing position opposing the photoconductor 2020. The developing roller 2510 is made of metal and, for example, it is manufactured from aluminum alloy such as aluminum alloy 5056 or aluminum alloy 6063, or iron alloy such as STKM, and the roller 2510 is plated with, for example, nickel plating or chromium plating, as necessary.

As shown in FIG. 23, the developing roller 2510 has a shaft 2510*a* and a large-diameter section 2510*b*. The developing roller 2510 is rotatably supported by its shaft 2510*a* being supported by a holder 2526 via two developing-roller bearings (not shown) located on both ends in the longitudinal direction. As shown in FIG. 21, the developing roller 2510 rotates in the opposite direction (counterclockwise in FIG. 21) to the rotating direction of the photoconductor 2020 (clockwise in FIG. 21). The central axis of the roller 2510 is located below the central axis of the photoconductor 2020.

As shown in FIG. 23, on an end of the developing roller 2510 (on a side of one end in the longitudinal direction), there is provided a developing-roller driving gear wheel 2613 which is an example of a "fourth gear wheel" for rotating the developing roller 2510. The developing-roller driving gear wheel 2613 is a helical gear, and as shown in FIG. 24, meshes with an intermediate gear wheel 2612 described further below.

Further, as shown in FIG. 21, in the state where the yellow developing unit 2054 is in opposition to the photoconductor 2020, there is a gap between the developing roller 2510 and the photoconductor 2020. That is, the yellow developing unit 2054 develops the latent image formed on the photoconductor 2020 in a non-contacting state. It should be noted that an alternating field is generated between the developing roller 2510 and the photoconductor 2020 upon development of the latent image formed on the photoconductor 2020.

The sealing member 2520 prevents the toner T in the yellow developing unit 2054 from spilling outside therefrom, as well as collects the toner T on the developing roller 2510 that has passed the developing position into the developing unit without scraping it off. The sealing member 2520 is a seal made, for example, of polyethylene film. The sealing member 2520 is supported by a seal-supporting metal plate 2522, and is attached to the housing 2540 via the seal-supporting metal plate 2522. On one side of the sealing member 2520 opposite from the side of the developing roller 2510, there is provided a seal-urging member 2524 made, for example, of Moltoprene. The sealing member 2520 is pressed against the developing roller 2510 with the elastic force of the seal-urging member 2524. It should be noted that the abutting position where the sealing member 2520 abuts against the developing roller 2510 is above the central axis of the developing roller 2510.

The housing 2540 is manufactured by welding together a plurality of integrally-molded housing sections, that is, an upper housing section 2542 and a lower housing section 2544. The inside of the housing 2540 is divided into two toner containing sections 2530, namely, the first toner containing section 2530*a* and the second toner containing section 2530*b*, by a partitioning wall 2545 that protrudes inwards (in the up/down direction of FIG. 21) from the inner wall to partition the toner T. It should be noted that a housing opening 2572 is provided in the lower section of the housing 2540, and the developing roller 2510 is arranged with respect to the housing opening 2572 such that a portion of the roller 2510 is exposed from the opening.

The toner containing sections 2530 may be provided with a stirring member for stirring the toner T. In the present embodiment, however, no stirring member is provided in the toner containing sections 2530 because each of the developing units (i.e., the black developing unit 2051, the magenta developing unit 2052, the cyan developing unit 2053, and the yellow developing unit 2054) is rotated with the rotation of the developing-unit holding unit 2050 and the toner T in each developing unit is thereby stirred.

The toner supplying roller 2550 is provided in the first toner containing section 2530*a* described above, and supplies the toner T contained in the first toner containing section 2530*a* to the developing roller 2510, as well as strips off, from the developing roller 2510, the toner T remaining on the developing roller 2510 after development. The toner supplying roller 2550 is made of, for example, polyurethane foam, and is made to abut against the developing roller 2510 in an elastically deformed state. The toner supplying roller 2550 is arranged at a lower section of the toner containing section 2530. The toner T contained in the toner containing section 2530 is supplied to the developing roller 2510 by the toner supplying roller 2550 at the lower section of the toner containing section 2530.

The toner supplying roller 2550 is rotatably supported by its shaft being supported on the housing 2540 via two supplying-roller bearings (not shown). The toner supplying roller 2550 rotates in the opposite direction (clockwise in FIG. 21) to the rotating direction of the developing roller 2510 (counterclockwise in FIG. 21). Its central axis is located below the central axis of rotation of the developing roller 2510.

Further, as shown in FIG. 23, on an end of the toner supplying roller 2550 (on a side of one end in the longitudinal direction), there is provided a supplying-roller driving gear wheel 2614 for rotating the toner supplying roller 2550. The supplying-roller driving gear wheel 2614 is a helical gear, and as shown in FIG. 24, meshes with the developing-roller driving gear wheel 2613.

The restriction blade 2560 electrically charges the toner T borne by the developing roller 2510 and also restricts the thickness of the layer of the toner T borne by the developing roller 2510. The restriction blade 2560 has a rubber section 2560*a* and a rubber-supporting section 2560*b*. The rubber section 2560*a* is made of an elastic body such as silicone rubber or urethane rubber. The rubber-supporting section 2560*b* is a thin plate having a spring-like characteristic and made of, for example, phosphor bronze or stainless steel. The rubber section 2560*a* is supported on the rubber-supporting section 2560*b*. The rubber-supporting section 2560*b* is attached to the housing 2540 via a blade-supporting metal plate 2562 with one end thereof being supported by the blade-supporting metal plate 2562. Further, a blade-backing member 2570 made of, for example, Moltoprene is provided on one side of the restriction blade 2560 opposite from the side of the developing roller 2510.

Here, the rubber section 2560*a* is pressed against the developing roller 2510 by the elastic force due to flexure of the rubber-supporting section 2560*b*. Further, the blade-backing member 2570 prevents the toner T from entering in between the rubber-supporting section 2560*b* and the housing 2540 to stabilize the elastic force caused by the flexure of the rubber-supporting section 2560*b*. Further, the blade-backing member 2570 presses the rubber section 2560*a* against the developing roller 2510 by applying force to the rubber section 2560*a* from right behind the rubber section 2560*a* in the direction toward the developing roller 2510. Therefore, the blade-backing member 2570 serves as to make the rubber section 2560*a* abut against the developing roller 2510 more evenly.

The end of the restricting blade 2560 opposite from the end that is supported by the blade-supporting metal plates 2562, i.e., the tip end, is not placed in contact with the developing roller 2510; rather, a section at a predetermined distance from the tip end contacts, with some breadth, the developing roller 2510. That is, the restriction blade 2560 does not abut against the developing roller 2510 at its edge, but abuts against the roller 2510 near its central portion. Further, the restriction blade 2560 is arranged such that its tip end faces towards the upstream side of the rotating direction of the developing roller 2510, and thus, makes a so-called counter-abutment with respect to the roller 2510. It should be noted that the abutting position at which the restriction blade 2560 abuts against the developing roller 2510 is below the central axis of the developing roller 2510 and is also below the central axis of the toner supplying roller 2550.

<Configuration of Driving Section of Yellow Developing Unit 2054>

Next, the configuration of the driving section of the yellow developing unit 2054 will be described. As shown in FIG. 22 and FIG. 23, the driving section of the yellow developing unit 2054 has various gear wheels and a cover 2630. It should be noted that in the following, the term "body of the developing unit", which is an example of a "body of a developing device", refers to a section of the yellow developing unit 2054 excluding the driving section. The yellow developing unit 2054 is provided with, as the various gear wheels, the above-described developing-roller driving gear wheel 2613 and the supplying-roller driving gear wheel 2614, and also, a developing-unit-side gear wheel 2611 which is an example of a "second gear wheel", and the intermediate gear wheel 2612 which is an example of a "third gear wheel".

The developing-unit-side gear wheel 2611 is a gear wheel that, when the yellow developing unit 2054 is attached to the attach/detach section 2050*d* (body 2010*a* of the printer), receives a drive force from the body 2010*a* of the printer, more specifically, from an apparatus-side gear wheel 2056 which is an example of a "first gear wheel" provided in the body 2010*a* of the printer, and that transmits the drive force to the developing-roller driving gear wheel 2613 and the supplying-roller driving gear wheel 2614. The developing-unit-side gear wheel 2611 is a helical gear. When the yellow developing unit 2054 is attached to the attach/detach section 2050*d* (body 2010*a* of the printer) and when the yellow developing unit 2054 is moved to a predetermined position (developing position) along with the movement of the attach/detach section 2050*d*, the developing-unit-side gear wheel 2611 meshes with the apparatus-side gear wheel 2056, which is also a helical gear, provided on the body 2010*a* of the printer, as shown in FIG. 19. The apparatus-side gear wheel 2056 gives, to the developing-unit-side gear wheel 2611, a drive force received from a not-shown drive source provided in the body 2010*a* of the printer. It should be noted that grease is applied to the apparatus-side gear wheel 2056.

As shown in FIG. 22, the developing-unit-side gear wheel 2611 is covered by the cover 2630 with a portion thereof being exposed from the cover opening 2633. The developing-unit-side gear wheel 2611 has a first teeth section 2611*a* that is covered by the cover 2630 with a portion thereof exposed from the cover opening 2633, and a second teeth section 2611*b* that is not exposed from the cover opening 2633. The first teeth section 2611*a* can mesh with the apparatus-side gear wheel 2056 provided on the body 2010*a* of the printer via the cover opening 2633 when the developing unit 2051, 2052, 2053, 2054 is attached to the body 2010*a* of the printer. The second teeth section 2611*b* meshes with a gear wheel (in this embodiment, the intermediate gear wheel 2612) provided in the developing unit other than the developing-unit-side gear wheel 2611.

Further, grease 2670, which is an example of a "lubricant", is applied to the first teeth section 2611*a* of the developing-unit-side gear wheel 2611. The grease 2670 is applied only to sections of the first teeth section 2611*a* that are not exposed from the cover opening 2633 in a state where the yellow developing unit 2054 is attached to the body 2010*a* of the printer and before the developing-unit-side gear wheel 2611 is rotated. The grease 2670 is applied to the first teeth section 2611*a* divided in a plurality of sections (in the present embodiment, three sections, namely, 2670*a*, 2670*b*, and 2670*c*).

The developing-unit-side gear wheel 2611 is rotatably supported by a developing-unit-side gear-wheel shaft 2593 which is an example of a "second-gear-wheel shaft". The developing-unit-side gear-wheel shaft 2593 is supported on a side plate 2580 of the body of the developing unit by a supported section 2593*a*. The supported section 2593*a* is provided on a side of one end of the developing-unit-side gear-wheel shaft 2593. Further, the cover 2630 supports a section 2593*b* of the developing-unit-side gear-wheel shaft 2593 located on a side opposite from the side of the supported section 2593*a* with respect to the developing-unit-side gear wheel 2611. The opposite-side section 2593*b* is provided on a side of the other end of the developing-unit-side gear-wheel shaft 2593.

The intermediate gear wheel 2612 is a gear wheel that serves as a medium when the developing-unit-side gear wheel 2611 transmits the drive force to the developing-roller driving gear wheel 2613 and the supplying-roller driving gear wheel 2614. That is, in a state where the yellow developing unit 2054 is attached to the attach/detach section 2050*d* (body 2010*a* of the printer), the developing-unit-side gear wheel 2611 receives the drive force from the body 2010*a* of the printer and transmits the drive force to the developing-roller driving gear wheel 2613 and the supplying-roller driving gear wheel 2614 via the intermediate gear wheel 2612.

The intermediate gear wheel 2612 is a helical gear, and meshes with the second teeth section 2611*b* of the developing-unit-side gear wheel 2611 as well as the developing-roller driving gear wheel 2613. The intermediate gear wheel 2612 is rotatably supported by an intermediate-gear-wheel shaft 2594 which is an example of a "third-gear-wheel shaft". The intermediate-gear-wheel shaft 2594 is supported on the side plate 2580 of the body of the developing unit by a second supported section 2594*a*. The second supported section 2594*a* is provided on a side of one end of the intermediate-gear-wheel shaft 2594. Further, the cover 2630 supports a section 2594*b* of the intermediate-gear-wheel shaft 2594 located on a side opposite from the side of the second supported section 2594*a* with respect to the intermediate gear wheel 2612. The opposite-side section 2594*b* is provided on a side of the other end of the intermediate-gear-wheel shaft 2594.

As shown in FIG. 22, the cover 2630 protects the developing-unit-side gear wheel 2611, the intermediate gear wheel 2612, the developing-roller driving gear wheel 2613, and the supplying-roller driving gear wheel 2614 by covering them. It should be noted that as shown in FIG. 26, the cover 2630 has a cover opening 2633, and the cover opening 2633 is provided along the outer circumference of the developing-unit-side gear wheel 2611 (first teeth section 2611*a*). Therefore, a portion of the first teeth section 2611*a* is exposed from the cover opening 2633.

Further, as shown in FIG. 27, the cover 2630 has a shaft-supporting section 2635 that supports the section 2593*b* of the developing-unit-side gear-wheel shaft 2593 located on the side opposite from the side of the supported section 2593*a* with respect to the developing-unit-side gear wheel 2611 (see FIG. 25), that is, the side of the other end of the developing-unit-side gear-wheel shaft 2593. The shaft-supporting section 2635 has a first hole 2635*a* into which the developing-unit-side gear-wheel shaft 2593 can fit. The whole outer periphery of the opposite-side section 2593*b* of the developing-unit-side gear-wheel shaft 2593 can fit into the first hole 2635*a*. By fitting the developing-unit-side gear-wheel shaft 2593 into the first hole 2635*a*, the developing-unit-side gear-wheel shaft 2593 is supported by the shaft-supporting section 2635. Further, the shaft-supporting section 2635 restricts movement of the developing-unit-side gear wheel 2611 in a direction from the supported section 2593*a* toward the opposite-side section 2593*b* (this direction is shown by arrow D in FIG. 25).

Further, as shown in FIG. 27, the cover 2630 has a second shaft-supporting section 2636 that supports the section 2594*b* of the intermediate-gear-wheel shaft 2594 located on the side opposite from the side of the second supported section 2594*a* with respect to the intermediate gear wheel 2612 (see FIG. 25), that is, the side of the other end of the intermediate-gear-wheel shaft 2594. The second shaft-supporting section 2636 has a second hole 2636*a* into which the intermediate-gear-wheel shaft 2594 can fit. A portion of the outer periphery of the opposite-side section 2594*b* of the intermediate-gear-wheel shaft 2594 can fit into the second hole 2636*a*. By fitting the intermediate-gear-wheel shaft 2594 into the second hole 2636*a*, the intermediate-gear-wheel shaft 2594 is supported by the second shaft-supporting section 2636. Further, the second shaft-supporting section 2636 restricts movement of the intermediate gear wheel 2612 in a direction from the second supported section 2594*a* toward the opposite-side section 2594*b* (this direction is shown by arrow D in FIG. 25).

When the developing-unit-side gear-wheel shaft 2593 is fitted into the first hole 2635*a* and the intermediate-gear-wheel shaft 2594 is fitted into the second hole 2636*a*, the movement of the cover 2630 with respect to the body of the developing unit is restricted. Thus, the developing-unit-side gear-wheel shaft 2593 and the intermediate-gear-wheel shaft 2594 also have the function of a "cover-positioning member" for positioning the cover 2630.

Further, the cover 2630 has a pin hole 2637 through which a positioning pin 2592 passes. The positioning pin 2592 is for positioning the yellow developing unit 2054 with respect to the body 2010*a* of the printer. By fitting the positioning pin 2592 into the fitting hole 2058 provided in the body 2010*a* of the printer, the yellow developing unit 2054 is positioned with respect to the body 2010*a* of the printer. A side of one end of the positioning pin 2592 is fixed to the side plate 2580.

It should be noted that grease may be applied also to the second teeth section 2611*b* of the developing-unit-side gear wheel 2611, the intermediate gear wheel 2612, the developing-roller driving gear wheel 2613, and the supplying-roller driving gear wheel 2614, but in the present embodiment, no grease is applied thereto.

<Operation of Yellow Developing Unit 2054>

Next, the operation of the yellow developing unit 2054 will be described. In the yellow developing unit 2054 structured as above, the toner supplying roller 2550 supplies the toner T contained in the toner containing section 2530 to the developing roller 2510 by rotating. At this time, the toner supplying roller 2550 is driven to rotate by the drive force transmitted to the supplying-roller driving gear wheel 2614.

With the rotation of the developing roller 2510, the toner T, which has been supplied to the developing roller 2510, reaches the abutting position of the restriction blade 2560; then, as the toner T passes the abutting position, the toner is electrically charged and its layer thickness is restricted. With further rotation of the developing roller 2510, the toner T on the developing roller 2510, which has been electrically charged and whose layer thickness has been restricted, reaches the developing position opposing the photoconductor 2020; then, under the alternating field, the toner T is used at the developing position for developing the latent image formed on the photoconductor 2020.

With further rotation of the developing roller 2510, the toner T on the developing roller 2510, which has passed the developing position, passes the sealing member 2520 and is collected into the developing unit without being scraped of f by the sealing member 2520. It should be noted that the developing roller 2510 is driven to rotate by the drive force transmitted to the developing-roller driving gear wheel 2613. Then, the toner T that still remains on the developing roller 2510 can be stripped off by the toner supplying roller 2550.

It should be noted that as described above, since the developing-unit-side gear wheel 2611 transmits the drive force to the supplying-roller driving gear wheel 2614 and the developing-roller driving gear wheel 2613 via the intermediate gear wheel 2612, the developing-unit-side gear wheel 2611 will also rotate when the toner supplying roller 2550 and the developing roller 2510 rotate. When the developing-unit-side gear wheel 2611 rotates, the grease 2670*a*, 2670*b*, and 2670*c* applied to three sections of the first teeth section 2611*a* of the developing-unit-side gear wheel 2611 (before rotation) will be dispersed. More specifically, when the developing-unit-side gear wheel 2611 rotates, the grease 2670*a*, 2670*b*, and 2670*c* moves, and a portion of the grease builds up in the vicinity of a section where the first teeth section 2611*a* and the apparatus-side gear wheel 2056 mesh with one another. Then, with further rotation of the developing-unit-side gear wheel 2611, the grease that has built up in the vicinity of that section will then adhere to sections of the first teeth section 2611*a* where grease was not applied before rotation. Therefore, grease will be dispersed and spread over all of the teeth of the first teeth section 2611*a*.

===Effectiveness of Developing Unit According to the Present Embodiment===

The developing unit 2051, 2052, 2053, 2054 (developing device) according to the present embodiment, that is, the developing unit 2051, 2052, 2053, 2054 attachable to and detachable from a movable attach/detach section 2050*a*, 2050*b*, 2050*c*, 2050*d* provided in the body 2010*a* of the printer (body of an image forming apparatus), has: a developing-unit-side gear wheel 2611 (second gear wheel) that meshes with an apparatus-side gear wheel 2056 (first gear wheel) provided in the body 2010*a* of the printer when the developing unit is in a state attached to the body 2010*a* of the printer and when the developing unit is moved to a predetermined position along with the movement of the attach/detach section (for example, when the yellow developing unit 2054 is attached to the body 2010*a* of the printer and the yellow developing unit 2054 is moved to the predetermined position along with the movement of the attach/detach section 2050*d*); a developing-unit-side gear-wheel shaft 2593 (second-gear-wheel shaft) that is supported on the body of the developing unit (body of the developing device) by a supported section 2593*a* and that supports the developing-unit-side gear wheel 2611; and a cover 2630 that covers a portion of the developing-unit-side gear wheel 2611 and that supports a section 2593*b* of the developing-unit-side gear-wheel shaft 2593 located on a side opposite from the side of the supported section 2593*a* with respect to the developing-unit-side gear wheel 2611. In this way, it becomes possible to appropriately prevent bending of the developing-unit-side gear-wheel shaft 2593. This is described in detail below.

First, description will be made about a comparative example. In this comparative example, the developing-unit-side gear-wheel shaft 2593 that supports the developing-unit-side gear wheel 2611 is supported on the body of the developing unit by the supported section 2593*a*, but the section of the developing-unit-side gear-wheel shaft 2593 on the side opposite from the side of the supported section 2593*a* with respect to the developing-unit-side gear wheel 2611 is not supported. That is, the developing-unit-side gear-wheel shaft 2593 is supported in a so-called cantilever fashion.

In such a case, there is a possibility that the developing-unit-side gear-wheel shaft 2593 may bend due to the developing-unit-side gear wheel 2611 coming into contact with the apparatus-side gear wheel 2056 provided on the body 2010*a* of the printer when the developing unit is moved to the predetermined position along with the movement of the attach/detach section. That is, an external force will be applied to the developing-unit-side gear wheel 2611 via the apparatus-side gear wheel 2056 due to the impact that is caused when the developing-unit-side gear wheel 2611 comes into contact with the apparatus-side gear wheel 2056. Due to this external force being applied to the developing-unit-side gear-wheel shaft 2593 via the developing-unit-side gear wheel 2611, the developing-unit-side gear-wheel shaft 2593 may bend. If the bending amount of the developing-unit-side gear-wheel shaft 2593 becomes large, then the developing-unit-side gear wheel 2611 supported by the developing-unit-side gear-wheel shaft 2593 will not appropriately mesh with the other gear wheels (for example, the apparatus-side gear wheel 2056).

On the other hand, in the present embodiment, as shown in FIG. 22 and FIG. 23, the cover 2630, which covers a portion of the developing-unit-side gear wheel 2611, supports the section 2593*b* of the developing-unit-side gear-wheel shaft 2593 (which is supported on the body of the developing unit by the supported section 2593*a*) that is located on a side opposite from the side of the supported section 2593*a* with respect to the developing-unit-side gear wheel 2611. In this way, the developing-unit-side gear-wheel shaft 2593 is supported through a so-called dual-support (supported on both sides).

When the developing-unit-side gear-wheel shaft 2593 is supported through the so-called dual-support, the rigidity of the developing-unit-side gear-wheel shaft 2593 becomes higher compared to a case where it is supported in a so-called cantilever fashion. Therefore, even when an external force is applied to the developing-unit-side gear-wheel shaft 2593, it is less prone to bend. As a result, it is possible to prevent bending of the developing-unit-side gear-wheel shaft 2593 caused by an external force applied via the developing-unit-side gear wheel 2611 when the developing-unit-side gear-wheel shaft 2593 comes into contact with the apparatus-side gear wheel 2056.

As described above, by supporting, with the cover 2630, the section 2593*b* of the developing-unit-side gear-wheel shaft 2593 (which is supported on the body of the developing unit by the supported section 2593*a*) that is located on a side opposite from the side of the supported section 2593*a* with respect to the developing-unit-side gear wheel 2611, the developing-unit-side gear-wheel shaft 2593 is supported through a so-called dual-support, and thus its rigidity becomes higher. As a result, it becomes possible to appropriately prevent bending of the developing-unit-side gear-wheel shaft 2593.

===Other Considerations===

In the foregoing embodiment, as shown in FIG. 25 and FIG. 26, the cover 2630 had a shaft-supporting section 2635 that supports the section of the developing-unit-side gear-wheel shaft 2593 located on the side opposite from the side of the supported section 2593*a* with respect to the developing-unit-side gear wheel 2611, and that restricts movement of the developing-unit-side gear wheel 2611 in a direction from the supported section 2593*a* toward the opposite-side section 2593*b*. This, however, is not a limitation. For example, a member other than the cover 2630 (such as a snap ring) may restrict the movement of the developing-unit-side gear wheel 2611 in the direction from the supported section 2593*a* toward the opposite-side section 2593*b* (which is referred to as "fall-out direction").

In order to prevent the developing-unit-side gear wheel 2611 from moving in the fall-out direction and falling out from the developing-unit-side gear-wheel shaft 2593, it is preferable to provide a member for restricting movement of the developing-unit-side gear wheel 2611 in the fall-out direction. By providing the cover 2630 with the shaft-supporting section 2635 that has the function of supporting the developing-unit-side gear-wheel shaft 2593 as well as the function of restricting the movement of the developing-unit-side gear wheel 2611 in the fall-out direction, it is not necessary to separately provide a member for restricting the movement of the developing-unit-side gear wheel 2611 in the fall-out direction, and thus, it is possible to achieve a reduction in the number of structural components. The foregoing embodiment is therefore more preferable.

Further, in the foregoing embodiment, as shown in FIG. 25, the supported section 2593*a* was provided on a side of one end of the developing-unit-side gear-wheel shaft 2593; and the shaft-supporting section 2635 of the cover 2630 supported a side of the other end of the developing-unit-side gear-wheel shaft 2593. This, however, is not a limitation. For example, the supported section 2593*a* may be provided close to the center of the developing-unit-side gear-wheel shaft 2593, and the shaft-supporting section 2635 may support a section close to the center of the developing-unit-side gear-wheel shaft 2593.

Further, in the foregoing embodiment, as shown in FIG. 25, the developing unit 2051, 2052, 2053, 2054 had an intermediate gear wheel 2612 (third gear wheel) that meshes with the developing-unit-side gear wheel 2611, and an intermediate-gear-wheel shaft 2594 (third-gear-wheel shaft) that is supported on the body 2010*a* of the printer by a second supported section 2594*a* and that supports the intermediate gear wheel 2612. This, however, is not a limitation. For example, the developing unit does not have to be provided with the intermediate gear wheel 2612 nor the intermediate-gear-wheel shaft 2594.

Further, in the foregoing embodiment, as shown in FIG. 25, the cover 2630 supported a section 2594*b* of the intermediate-gear-wheel shaft 2594 located on a side opposite from the side of the second supported section 2594*a* with respect to the intermediate gear wheel 2612. This, however, is not a limitation. For example, the cover 2630 does not have to support the intermediate-gear-wheel shaft 2594.

In a case, however, where the cover 2630 supports the section 2594*b* of the intermediate-gear-wheel shaft 2594 located on a side opposite from the side of the second supported section 2594*a* with respect to the intermediate gear wheel 2612, the rigidity of the intermediate-gear-wheel shaft 2594 is increased due to the intermediate-gear-wheel shaft 2594 being supported at both ends with respect to the intermediate gear wheel 2612, that is, supported by a so-called dual-support. As a result, it becomes possible to prevent bending of the intermediate-gear-wheel shaft 2594. The foregoing embodiment is therefore more preferable.

Further, in the foregoing embodiment, as shown in FIG. 25 and FIG. 26, the cover 2630 had a second shaft-supporting section 2636 that supports the section 2594*b* of the intermediate-gear-wheel shaft 2594 located on the side opposite from the side of the second supported section 2594*a* with respect to the intermediate gear wheel 2612, and that restricts movement of the intermediate gear wheel 2612 in a direction from the second supported section 2594*a* toward the opposite-side section 2594*b*. This, however, is not a limitation. For example, a member other than the cover 2630 (such as a snap ring) may restrict the movement of the intermediate gear wheel 2612 in the direction from the second supported section 2594*a* toward the opposite-side section 2594*b* (which is referred to as "second fall-out direction").

In order to prevent the intermediate gear wheel 2612 from moving in the second fall-out direction and falling out from the intermediate-gear-wheel shaft 2594, it is preferable to provide a member for restricting movement of the intermediate gear wheel 2612 in the second fall-out direction. By providing the cover 2630 with the second shaft-supporting section 2636 that has the function of supporting the intermediate-gear-wheel shaft 2594 as well as the function of restricting the movement of the intermediate gear wheel 2612 in the second fall-out direction, it is not necessary to separately provide a member for restricting the movement of the intermediate gear wheel 2612 in the second fall-out direction, and thus, it is possible to achieve a reduction in the number of structural components. The foregoing embodiment is therefore more preferable.

Further, in the foregoing embodiment, as shown in FIG. 26 and FIG. 27, the shaft-supporting section 2635 had a first hole 2635*a* into which the developing-unit-side gear-wheel shaft 2593 can fit; and the second shaft-supporting section 2636 had a second hole 2636*a* into which the intermediate-gear-wheel shaft 2594 can fit. Further, the shaft-supporting section 2635 supported the developing-unit-side gear-wheel shaft 2593 by the developing-unit-side gear-wheel shaft 2593 fitting into the first hole 2635*a*; and the second shaft-supporting section 2636 supported the intermediate-gear-wheel shaft 2594 by the intermediate-gear-wheel shaft 2594 fitting into the second hole 2636*a*. This, however, is not a limitation. For example, the shaft-supporting section 2635 and the second shaft-supporting section 2636 may support the developing-unit-side gear-wheel shaft 2593 and the intermediate-gear-wheel shaft 2594 using a structure other than a hole.

In a case, however, where the shaft-supporting section 2635 and the second shaft-supporting section 2636 respectively support the developing-unit-side gear-wheel shaft 2593 and the intermediate-gear-wheel shaft 2594 using a hole, the shaft-supporting section 2635 can reliably support the developing-unit-side gear-wheel shaft 2593 and the second shaft-supporting section 2636 can reliably support the intermediate-gear-wheel shaft 2594. Therefore, it becomes possible to prevent bending of the developing-unit-side gear-wheel shaft 2593 and the intermediate-gear-wheel shaft 2594 even more effectively. The foregoing embodiment is therefore more preferable.

Further, in the foregoing embodiment, as shown in FIG. 22, the developing-unit-side gear-wheel shaft 2593 and the intermediate-gear-wheel shaft 2594 served as a cover-positioning member for positioning the cover 2630. This, however, is not a limitation. For example, the cover 2630 may be positioned using a member other than the developing-unit-side gear-wheel shaft 2593 and the intermediate-gear-wheel shaft 2594 (such as a pin fixed to the body of the developing unit).

In order to prevent the cover 2630 from interfering with the developing-unit-side gear wheel 2611 and the intermediate gear wheel 2612, it is necessary to precisely position the cover 2630 with respect to the body of the developing unit. If the developing-unit-side gear-wheel shaft 2593 and the intermediate-gear-wheel shaft 2594 function as a cover-positioning member, then the developing-unit-side gear-wheel shaft 2593 and the intermediate-gear-wheel shaft 2594 can possess both the function of supporting the gear wheels and the function of determining the position of the cover 2630 with respect to the body of the developing unit. As a result, it is not necessary to provide a cover-positioning member separately, and thus, it becomes possible to achieve a reduction in the number of structural components. The foregoing embodiment is therefore more preferable.

Further, in the foregoing embodiment, as shown in FIG. 23, the developing device had a developing roller 2510 (developer bearing body) for bearing toner T (developer), and a developing-roller driving gear wheel 2613 (fourth gear wheel) that is provided on a side of one end, in a longitudinal direction, of the developing roller 2510 and that meshes with the intermediate gear wheel 2612. This, however, is not a limitation.

In a structure where the intermediate gear wheel 2612 and the developing-roller driving gear wheel 2613 mesh with one another, the intermediate gear wheel 2612 and the developing-roller driving gear wheel 2613 may not mesh appropriately when the intermediate-gear-wheel shaft 2594 is bent, and this may cause unevenness in rotation of the developing roller 2510. This unevenness in rotation, in turn, leads to defects in an image. On the other hand, by supporting the intermediate-gear-wheel shaft 2594 with the cover 2630, bending of the intermediate-gear-wheel shaft 2594 can be prevented, and thus, it becomes possible to make the intermediate gear wheel 2612 and the developing-roller driving gear wheel 2613 mesh appropriately and make the developing roller 2510 rotate properly. The foregoing embodiment is therefore more preferable.

Further, in the foregoing embodiment, as shown in FIG. 17, the developing unit 2051, 2052, 2053, 2054 developed a latent image borne on a photoconductor 2020 (image bearing body) provided in the body 2010*a* of the printer when the developing unit was moved to the predetermined position. This, however, is not a limitation. For example, the developing unit 2051, 2052, 2053, 2054 may perform an operation other than development of a latent image when it is moved to the predetermined position.

However, one main function of the developing unit 2051, 2052, 2053, 2054 is to develop a latent image borne on the photoconductor 2020. Therefore, the frequency that the developing unit moves to the predetermined position and the developing-unit-side gear wheel 2611 comes into contact with the apparatus-side gear wheel 2056 is high, and thus, there is a high possibility that the developing-unit-side gear-wheel shaft 2593 will bend. In such a case where the developing unit develops a latent image borne on the photoconductor 2020 when the developing device is moved to the predetermined position, the effect of being able to appropriately prevent the developing-unit-side gear-wheel shaft 2593 from bending, can be achieved more effectively. The foregoing embodiment is therefore more preferable.

OTHER EMBODIMENTS

In the foregoing, a developing device, an image forming apparatus, etc. of the present invention were described according to embodiments thereof. However, the foregoing embodiments of the invention are for the purpose of elucidating the present invention and are not to be interpreted as limiting the present invention. The present invention can be altered and improved without departing from the gist thereof, and needless to say, the present invention includes its equivalents.

In the foregoing embodiments, an intermediate transferring type full-color laser beam printer was described as an example of the image forming apparatus, but the present invention is also applicable to various types of image forming apparatuses, such as full-color laser beam printers that are not of the intermediate transferring type, monochrome laser beam printers, copying machines, and facsimiles.

Further, the photoconductor, which is an image bearing body, is not limited to a so-called photoconductive roller having a structure in which a photoconductive layer is provided on the outer peripheral surface of a cylindrical, electrically-conductive base. The photoconductor can be a so-called photoconductive belt structured by providing a photoconductive layer on a surface of a belt-like electrically-conductive base, for example.

<<<Configuration of Image Forming System Etc.>>>

Next, an embodiment of an image forming system, which serve as an example of an embodiment of the present invention, is described with reference to the drawings.

Figure 28:
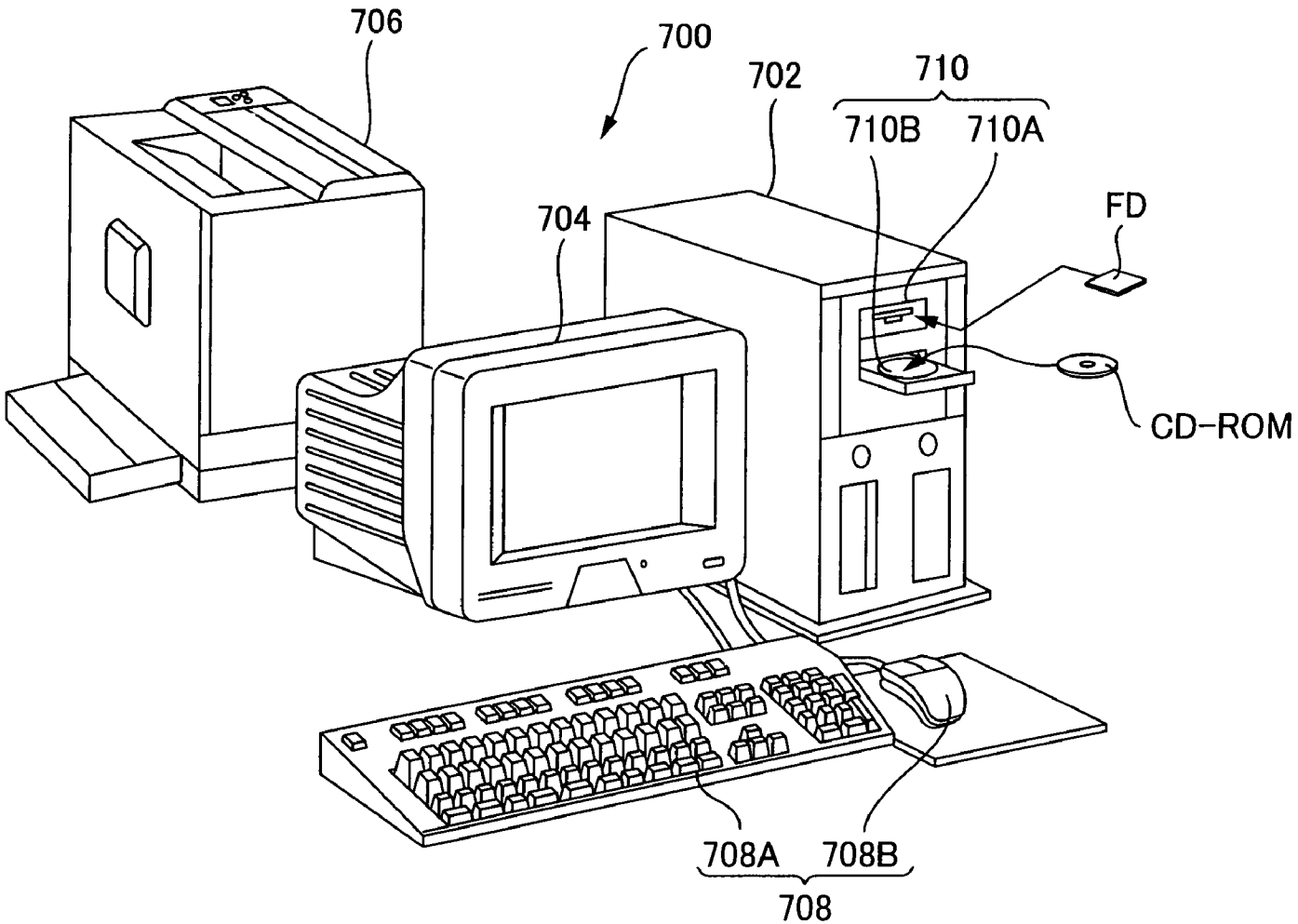
FIG. 28 is an explanatory drawing showing an external structure of an image forming system.

FIG. 28 is an explanatory drawing showing an external structure of an image forming system. The image forming system 700 comprises a computer 702, a display device 704, a printer 706, an input device 708, and a reading device 710. In this embodiment, the computer 702 is accommodated in a mini-tower type housing, but this is not a limitation. A CRT (cathode ray tube), a plasma display, or a liquid crystal display device, for example, is generally used as the display device 704, but this is not a limitation. The printer described above is used as the printer 706. In this embodiment, a keyboard 708A and a mouse 708B are used as the input device 708, but this is not a limitation. In this embodiment, a flexible disk drive device 710A and a CD-ROM drive device 710B are used as the reading device 710, but the reading device is not limited to these, and other devices such as an MO (magneto optical) disk drive device or a DVD (digital versatile disk) may be used.

Figure 29:
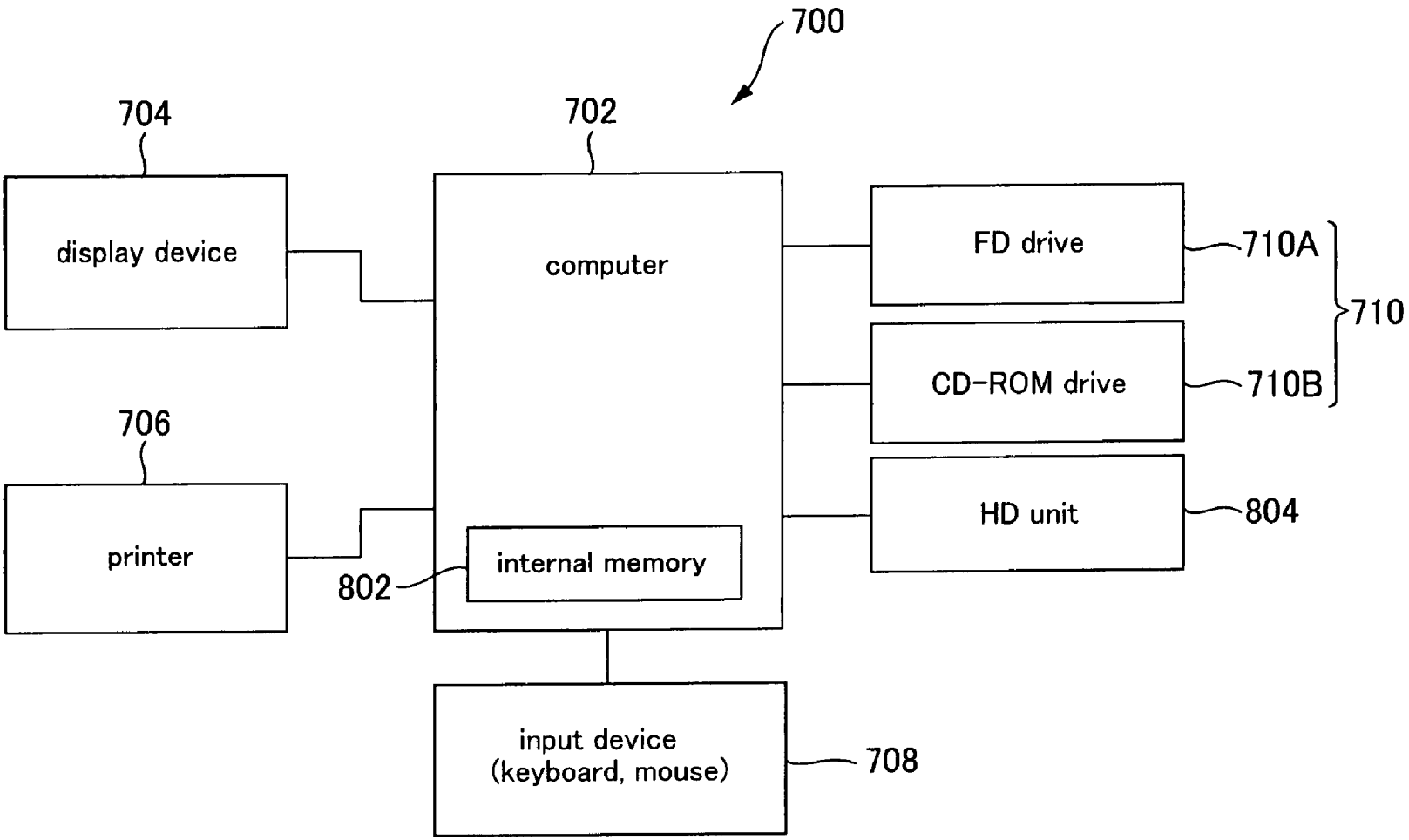
FIG. 29 is a block diagram showing a configuration of the image forming system shown in FIG. 28.

FIG. 29 is a block diagram showing a configuration of the image forming system shown in FIG. 28. Further provided are an internal memory 802, such as a RAM inside the housing accommodating the computer 702, and an external memory such as a hard disk drive unit 804.

It should be noted that in the above description, an example in which the image forming system is structured by connecting the printer 706 to the computer 702, the display device 704, the input device 708, and the reading device 710 was described, but this is not a limitation. For example, the image forming system can be made of the computer 702 and the printer 706, and the image forming system does not have to be provided with one of the display device 704, the input device 708, and the reading device 710.

Further, for example, the printer 706 can have some of the functions or mechanisms of the computer 702, the display device 704, the input device 708, and the reading device 710. As an example, the printer 706 may be configured so as to have an image processing section for carrying out image processing, a displaying section for carrying out various types of displays, and a recording media attach/detach section to and from which recording media storing image data captured by a digital camera or the like are inserted and taken out.

As an overall system, the image forming system that is achieved in this way becomes superior to conventional systems.

What is claimed is:

1. A developing device attachable to and detachable from a body of an image forming apparatus, comprising:

a developer bearing roller for bearing a developer;

a first driving wheel that is provided on an end of said developer bearing roller and that is for driving said developer bearing roller;

a second driving wheel that, in a state where said developing device is attached to the body of said image forming apparatus, receives a drive force from the body of said image forming apparatus and that transmits said drive force to said first driving wheel; and a positioning member that is made of metal and that is for positioning said first driving wheel and said second driving wheel, wherein said developing device has a third driving wheel that serves as a medium when said second driving wheel transmits said drive force to said first driving wheel;

wherein, in a state where said developing device is attached to the body of said image forming apparatus, said second driving wheel receives said drive force from the body of said image forming apparatus and transmits said drive force to said first driving wheel via said third driving wheel;

wherein said third driving wheel is positioned using said positioning member, wherein said first driving wheel, said second driving wheel, and said third driving wheel are a first driving gear wheel, a second driving gear wheel, and a third driving gear wheel, respectively;

wherein said positioning member has a first supporting section for rotatably supporting said developer bearing roller, a second supporting section for rotatably supporting said second driving gear wheel, and a third supporting section for rotatably supporting said third driving gear wheel;

wherein said second driving gear wheel supported by said second supporting section meshes with said third driving gear wheel supported by said third supporting section; and wherein said third driving gear wheel meshes with said first driving gear wheel that is provided on said developer bearing roller supported by said first supporting section.

2. A developing device according to claim 1, wherein said developing device has a developer supplying roller for supplying said developer to said developer bearing roller, and a fourth driving wheel that is provided on an end of said developer supplying roller and that is for driving said developer supplying roller;

wherein, in a state where said developing device is attached to the body of said image forming apparatus, said second driving wheel receives said drive force from the body of said image forming apparatus and transmits said drive force to said fourth driving wheel; and wherein said fourth driving wheel is positioned using said positioning member.

3. A developing device according to claim 2, wherein said first driving wheel, said second driving wheel, said third driving wheel, and said fourth driving wheel are a first driving gear wheel, a second driving gear wheel, a third driving gear wheel, and a fourth driving gear wheel, respectively;

wherein said positioning member has a first supporting section for rotatably supporting said developer bearing roller, a second supporting section for rotatably supporting said second driving gear wheel, a third supporting section for rotatably supporting said third driving gear wheel, and a fourth supporting section for rotatably supporting said developer supplying roller;

wherein said second driving gear wheel supported by said second supporting section meshes with said third driving gear wheel supported by said third supporting section;

wherein said third driving gear wheel meshes with said first driving gear wheel that is provided on said developer bearing roller supported by said first supporting section; and wherein said first driving gear wheel meshes with said fourth driving gear wheel that is provided on said developer supplying roller supported by said fourth supporting section.

4. A developing device according to claim 1, wherein said positioning member comprises:

a first positioning member for positioning said first driving wheel; and a second positioning member that is for positioning said second driving wheel and that has a positioning pin for positioning said developing device with respect to the body of said image forming apparatus.

5. A developing device according to claim 4, wherein said developing device has a third driving wheel that serves as a medium when said second driving wheel transmits said drive force to said first driving wheel;

wherein, in a state where said developing device is attached to the body of said image forming apparatus, said second driving wheel receives said drive force from the body of said image forming apparatus and transmits said drive force to said first driving wheel via said third driving wheel; and wherein said third driving wheel is positioned using said first positioning member.

6. A developing device according to claim 5, wherein said first driving wheel, said second driving wheel, and said third driving wheel are a first driving gear wheel, a second driving gear wheel, and a third driving gear wheel, respectively;

wherein said first positioning member has a first supporting section for rotatably supporting said developer bearing roller, and a third supporting section for rotatably supporting said third driving gear wheel;

wherein said second positioning member has a second supporting section for rotatably supporting said second driving gear wheel;

wherein said second driving gear wheel supported by said second supporting section meshes with said third driving gear wheel supported by said third supporting section; and wherein said third driving gear wheel meshes with said first driving gear wheel that is provided on said developer bearing roller supported by said first supporting section.

7. A developing device according to claim 6, wherein said first supporting section of said first positioning member rotatably supports said developer bearing roller via a developing-roller bearing;

wherein said second positioning member has a supporting-section fitting hole into which said third supporting section of said first positioning member can fit, and a bearing fitting hole into which said developing-roller bearing can fit; and wherein said first positioning member and said second positioning member are positioned by fitting said third supporting section into said supporting-section fitting hole and fitting said developing-roller bearing into said bearing fitting hole.

8. A developing device according to claim 1, and further comprising:

a first attachment member to which said developer bearing roller is attached;

a developer supplying roller for supplying said developer to said developer bearing roller;

a second attachment member to which said developer supplying roller is attached; and a first bearing for relatively positioning said first attachment member and said second attachment member and for receiving a shaft of said developer supplying roller.

9. A developing device according to claim 8, wherein said first attachment member and said second attachment member have, respectively, a first fitting hole and a second fitting hole into which said first bearing can fit;

wherein said developer supplying roller is rotatably supported by said second attachment member via said first bearing that is fitted into said second fitting hole; and wherein said first attachment member and said second attachment member are relatively positioned by fitting said first bearing that is fitted into said second fitting hole also into said first fitting hole.

10. A developing device according to claim 9, wherein said developing device has a second bearing for receiving a shaft of said developer bearing roller;

wherein said first attachment member has a third fitting hole into which said second bearing can fit; and wherein said developer bearing roller is rotatably supported by said first attachment member via said second bearing that is fitted into said third fitting hole.

11. A developing device according to claim 10, wherein said developing device has, as said first bearing, a one-end-side first bearing positioned on a side of one end, in a longitudinal direction, of said developing device, and an other-end-side first bearing positioned on a side of the other end, in the longitudinal direction, of said developing device;

wherein said second attachment member has, as said second fitting hole, a one-end-side second fitting hole into which said one-end-side first bearing can fit, and an other-end-side second fitting hole into which said other-end-side first bearing can fit;

wherein said developer supplying roller is rotatably supported by said second attachment member via said one-end-side first bearing that is fitted into said one-end-side second fitting hole and said other-end-side first hearing that is fitted into said other-end-side second fitting hole;

wherein said developing device has, as said second bearing, a one-end-side second bearing positioned on the side of one end, in the longitudinal direction, of said developing device, and an other-end-side second bearing positioned on the side of the other end, in the longitudinal direction, of said developing device;

wherein said first attachment member has, as said third fitting hole, a one-end-side third fitting hole into which said one-end-side second bearing can fit, and an other-end-side third fitting hole into which said other-end-side second bearing can fit;

wherein said developer bearing roller is rotatably supported by said first attachment member via said one-end-side second bearing that is fitted into said one-end-side third fitting hole and said other-end-side second bearing that is fitted into said other-end-side third fitting hole;

wherein said first attachment member has, only on the side of one end of said developing device in the longitudinal direction, said first fitting hole into which said one-end-side first bearing can fit; and wherein said first attachment member and said second attachment member are relatively positioned by fitting said one-end-side first hearing that is fitted into said one-end-side second fitting hole also into said first fitting hole.

12. A developing device according to claim 11, wherein, on the side of one end of said developing device in the longitudinal direction, a pin is provided on either one of said first attachment member and said second attachment member, and a fourth fitting hole into which said pin can fit is provided in the other of said first attachment member and said second attachment member; and wherein said pin is fitted into said fourth fitting hole.

13. A developing device according to claim 11, wherein said developing device has, on the side of the other end of said developing device in the longitudinal direction, an other-end-side positioning member for relatively positioning said other-end-side first bearing and said other-end-side second bearing.

14. A developing device according to claim 1 that is attachable to and detachable from a movable attach/detach section provided in said body of said image forming apparatus, and further comprising:

a second gear wheel that meshes with a first gear wheel provided in the body of said image forming apparatus when said developing device is in a state attached to said attach/detach section and when said developing device is moved to a predetermined position along with the movement of said attach/detach section;

a second-gear-wheel shaft that is supported on a body of said developing device by a supported section and that supports said second gear wheel; and a cover that covers a portion of said second gear wheel and that supports a section of said second-gear-wheel shaft located on a side opposite from the side of said supported section with respect to said second gear wheel.

15. A developing device according to claim 14, wherein said cover has a shaft-supporting section that supports the section of said second-gear-wheel shaft located on the side opposite from the side of said supported section with respect to said second gear wheel, and that restricts movement of said second gear wheel in a direction from said supported section toward the section on the opposite side.

16. A developing device according to claim 15, wherein said supported section is provided on a side of one end of said second-gear-wheel shaft; and wherein said shaft-supporting section of said cover supports a side of the other end of said second-gear-wheel shaft.

17. A developing device according to claim 15, wherein said developing device has a third gear wheel that meshes with said second gear wheel, and a third-gear-wheel shaft that is supported on the body of said developing device by a second supported section and that supports said third gear wheel.

18. A developing device according to claim 17, wherein said cover supports a section of said third-gear-wheel shaft located on a side opposite from the side of said second supported section with respect to said third gear wheel.

19. A developing device according to claim 18, wherein said cover has a second shaft-supporting section that supports the section of said third-gear-wheel shaft located on the side opposite from the side of said second supported section with respect to said third gear wheel, and that restricts movement of said third gear wheel in a direction from said second supported section toward the section on the opposite side.

20. A developing device according to claim 19, wherein said shaft-supporting section has a first hole into which said second-gear-wheel shaft can fit;

wherein said second shaft-supporting section has a second hole into which said third-gear-wheel shaft can fit;

wherein said shaft-supporting section supports said second-gear-wheel shaft by said second-gear-wheel shaft fitting into said first hole; and wherein said second shaft-supporting section supports said third-gear-wheel shaft by said third-gear-wheel shaft fitting into said second hole.

21. A developing device according to claim 20, wherein said second-gear-wheel shaft and said third-gear-wheel shaft are a cover-positioning member for positioning said cover.

22. A developing device according to claim 18, wherein said developing device has a developer bearing body for bearing a developer, and a fourth gear wheel that is provided on a side of one end, in a longitudinal direction, of said developer bearing body and that meshes with said third gear wheel.

23. A developing device according to claim 14, wherein said developing device develops a latent image borne on an image bearing body provided in the body of said image forming apparatus when said developing device is moved to said predetermined position.

24. A developing device attachable to and detachable from a body of an image forming apparatus, comprising:

a developer bearing roller for bearing a developer;

a first driving wheel that is provided on an end of said developer bearing roller and that is for driving said developer bearing roller;

a second driving wheel that, in a state where said developing device is attached to the body of said image forming apparatus, receives a drive force from the body of said image forming apparatus and that transmits said drive force to said first driving wheel; and a positioning member that is made of metal and that is for positioning said first driving wheel and said second driving wheel, wherein said positioning member has a positioning pin for positioning said developing device with respect to the body of said image forming apparatus.

25. A developing device attachable to and detachable from a body of an image forming apparatus, comprising:

a developer bearing roller for bearing a developer;

a first driving wheel that is provided on an end of said developer bearing roller and that is for driving said developer bearing roller;

a second driving wheel that, in a state where said developing device is attached to the body of said image forming apparatus, receives a drive force from the body of said image forming apparatus and that transmits said drive force to said first driving wheel; and a positioning member that is made of metal and that is for positioning said first driving wheel and said second driving wheel;

wherein said developing device has a third driving wheel that serves as a medium when said second driving wheel transmits said drive force to said first driving wheel;

wherein, in a state where said developing device is attached to the body of said image forming apparatus, said second driving wheel receives said drive force from the body of said image forming apparatus and transmits said drive force to said first driving wheel via said third driving wheel;

wherein said third driving wheel is positioned using said positioning member;

wherein said developing device has a developer supplying roller for supplying said developer to said developer bearing roller, and a fourth driving wheel that is provided on an end of said developer supplying roller and that is for driving said developer supplying roller;

wherein, in a state where said developing device is attached to the body of said image forming apparatus, said second driving wheel receives said drive force from the body of said image forming apparatus and transmits said drive force to said fourth driving wheel;

wherein said fourth driving wheel is positioned using said positioning member;

wherein said first driving wheel, said second driving wheel, said third driving wheel, and said fourth driving wheel are a first driving gear wheel, a second driving gear wheel, a third driving gear wheel, and a fourth driving gear wheel, respectively;

wherein said positioning member has a first supporting section for rotatably supporting said developer bearing roller, a second supporting section for rotatably supporting said second driving gear wheel, a third supporting section for rotatably supporting said third driving gear wheel, and a fourth supporting section for rotatably supporting said developer supplying roller;

wherein said second driving gear wheel supported by said second supporting section meshes with said third driving gear wheel supported by said third supporting section;

wherein said third driving gear wheel meshes with said first driving gear wheel that is provided on said developer bearing roller supported by said first supporting section;

wherein said first driving gear wheel meshes with said fourth driving gear wheel that is provided on said developer supplying roller supported by said fourth supporting section; and wherein said positioning member has a positioning pin for positioning said developing device with respect to the body of said image forming apparatus.

26. A developing device according to claim 25, wherein said positioning member comprises:

a first positioning member for positioning said first driving wheel; and a second positioning member that is for positioning said second driving wheel and that has said positioning pin for positioning said developing device with respect to the body of said image forming apparatus;

wherein said third driving wheel is positioned using said first positioning member;

wherein said first positioning member has said first supporting section for rotatably supporting said developer bearing roller, and said third supporting section for rotatably supporting said third driving gear wheel;

wherein said second positioning member has said second supporting section for rotatably supporting said second driving gear wheel;

wherein said first supporting section of said first positioning member rotatably supports said developer bearing roller via a developing-roller bearing;

wherein said second positioning member has a supporting-section fitting hole into which said third supporting section of said first positioning member can fit, and a bearing fitting hole into which said developing-roller bearing can fit; and wherein said first positioning member and said second positioning member are positioned by fitting said third supporting section into said supporting-section fitting hole and fitting said developing-roller bearing into said bearing fitting hole.

27. A developing device according to claim 25, and further comprising:

a first attachment member to which said developer bearing roller is attached;

a second attachment member to which said developer supplying roller is attached; and a first bearing for relatively positioning said first attachment member and said second attachment member and for receiving a shaft of said developer supplying roller;

wherein said first attachment member and said second attachment member have, respectively, a first fitting hole and a second fitting hole into which said first bearing can fit;

wherein said developer supplying roller is rotatably supported by said second attachment member via said first bearing that is fitted into said second fitting hole;

wherein said first attachment member and said second attachment member are relatively positioned by fitting said first bearing that is fitted into said second fitting hole also into said first fitting hole;

wherein said developing device has a second bearing for receiving a shaft of said developer bearing roller;

wherein said first attachment member has a third fitting hole into which said second bearing can fit;

wherein said developer bearing roller is rotatably supported by said first attachment member via said second bearing that is fitted into said third fitting hole;

wherein said developing device has, as said first bearing, a one-end-side first bearing positioned on a side of one end, in a longitudinal direction, of said developing device, and an other-end-side first bearing positioned on a side of the other end, in the longitudinal direction, of said developing device;

wherein said second attachment member has, as said second fitting hole, a one-end-side second fitting hole into which said one-end-side first bearing can fit, and an other-end-side second fitting hole into which said other-end-side first bearing can fit;

wherein said developer supplying roller is rotatably supported by said second attachment member via said one-end-side first bearing that is fitted into said one-end-side second fitting hole and said other-end-side first bearing that is fitted into said other-end-side second fitting hole;

wherein said developing device has, as said second bearing, a one-end-side second bearing positioned on the side of one end, in the longitudinal direction, of said developing device, and an other-end-side second bearing positioned on the side of the other end, in the longitudinal direction, of said developing device;

wherein said first attachment member has, as said third fitting hole, a one-end-side third fitting hole into which said one-end-side second bearing can fit, and an other-end-side third fitting hole into which said other-end-side second bearing can fit;

wherein said developer bearing roller is rotatably supported by said first attachment member via said one-end-side second bearing that is fitted into said one-end-side third fitting hole and said other-end-side second bearing that is fitted into said other-end-side third fitting hole;

wherein said first attachment member has, only on the side of one end of said developing device in the longitudinal direction, said first fitting hole into which said one-end-side first bearing can fit;

wherein said first attachment member and said second attachment member are relatively positioned by fitting said one-end-side first bearing that is fitted into said one-end-side second fitting hole also into said first fitting hole;

wherein, on the side of one end of said developing device in the longitudinal direction, a pin is provided on either one of said first attachment member and said second attachment member, and a fourth fitting hole into which said pin can fit is provided in the other of said first attachment member and said second attachment member;

wherein said pin is fitted into said fourth fitting hole; and wherein said developing device has, on the side of the other end of said developing device in the longitudinal direction, an other-end-side positioning member for relatively positioning said other-end-side first bearing and said other-end-side second bearing.

28. A developing device according to claim 25 that is attachable to and detachable from a movable attach/detach section provided in said body of said image forming apparatus, and further comprising:

a second gear wheel that meshes with a first gear wheel provided in the body of said image forming apparatus when said developing device is in a state attached to said attach/detach section and when said developing device is moved to a predetermined position along with the movement of said attach/detach section;

a second-gear-wheel shaft that is supported on a body of said developing device by a supported section and that supports said second gear wheel; and a cover that covers a portion of said second gear wheel and that supports a section of said second-gear-wheel shaft located on a side opposite from the side of said supported section with respect to said second gear wheel;

wherein said cover has a shaft-supporting section that supports the section of said second-gear-wheel shaft located on the side opposite from the side of said supported section with respect to said second gear wheel, and that restricts movement of said second gear wheel in a direction from said supported section toward the section on the opposite side;

wherein said supported section is provided on a side of one end of said second-gear-wheel shaft;

wherein said shaft-supporting section of said cover supports a side of the other end of said second-gear-wheel shaft;

wherein said developing device has a third gear wheel that meshes with said second gear wheel, and a third-gear-wheel shaft that is supported on the body of said developing device by a second supported section and that supports said third gear wheel;

wherein said cover supports a section of said third-gear-wheel shaft located on a side opposite from the side of said second supported section with respect to said third gear wheel;

wherein said cover has a second shaft-supporting section that supports the section of said third-gear-wheel shaft located on the side opposite from the side of said second supported section with respect to said third gear wheel, and that restricts movement of said third gear wheel in a direction from said second supported section toward the section on the opposite side;

wherein said shaft-supporting section has a first hole into which said second-gear-wheel shaft can fit;

wherein said second shaft-supporting section has a second hole into which said third-gear-wheel shaft can fit;

wherein said shaft-supporting section supports said second-gear-wheel shaft by said second-gear-wheel shaft fitting into said first hole;

wherein said second shaft-supporting section supports said third-gear-wheel shaft by said third-gear-wheel shaft fitting into said second hole;

wherein said second-gear-wheel shaft and said third-gear-wheel shaft are a cover-positioning member for positioning said cover;

wherein said developing device has a developer bearing body for bearing a developer, and a fourth gear wheel that is provided on a side of one end, in a longitudinal direction, of said developer bearing body and that meshes with said third gear wheel; and wherein said developing device develops a latent image borne on an image bearing body provided in the body of said image forming apparatus when said developing device is moved to said predetermined position.

29. An image forming apparatus comprising:

a body of said image forming apparatus; and a developing device that has:

a developer bearing roller for bearing a developer;

a first driving wheel that is provided on an end of said developer bearing roller and that is for driving said developer bearing roller;

a second driving wheel that receives a drive force from the body of said image forming apparatus and that transmits said drive force to said first driving wheel; and a positioning member that is made of metal and that is for positioning said first driving wheel and said second driving wheel, wherein said developing device has a third driving wheel that serves as a medium when said second driving wheel transmits said drive force to said first driving wheel;

wherein, in a state where said developing device is attached to the body of said image forming apparatus, said second driving wheel receives said drive force from the body of said image forming apparatus and transmits said drive force to said first driving wheel via said third driving wheel;

wherein said third driving wheel is positioned using said positioning member;

wherein said first driving wheel, said second driving wheel, and said third driving wheel are a first driving gear wheel, a second driving gear wheel, and a third driving gear wheel, respectively;

wherein said positioning member has a first supporting section for rotatably supporting said developer bearing roller, a second supporting section for rotatably supporting said second driving gear wheel, and a third supporting section for rotatably supporting said third driving gear wheel;

wherein said second driving gear wheel supported by said second supporting section meshes with said third driving gear wheel supported by said third supporting section; and wherein said third driving gear wheel meshes with said first driving gear wheel that is provided on said developer bearing roller supported by said first supporting section.

30. An image forming apparatus according to claim 29, wherein said positioning member has a positioning pin for positioning said developing device with respect to the body of said image forming apparatus;

wherein said body of said image forming apparatus has a fitting hole into which said positioning pin can fit, and an other driving wheel that gives the drive force to said second driving wheel;

wherein said developing device is positioned with respect to said body of said image forming apparatus by fitting said positioning pin into said fitting hole; and wherein said second driving wheel receives the drive force from said other driving wheel and transmits said drive force to said first driving wheel.

31. An image forming apparatus according to claim 29, wherein said positioning member comprises:

a first positioning member for positioning said first driving wheel; and a second positioning member that is for positioning said second driving wheel and that has a positioning pin for positioning said developing device with respect to the body of said image forming apparatus.

32. An image forming apparatus according to claim 31, wherein said body of said image forming apparatus has an apparatus-side fitting hole into which said positioning pin can fit, and an other driving wheel that gives the drive force to said second driving wheel;

wherein said developing device is positioned with respect to said body of said image forming apparatus by fitting said positioning pin into said apparatus-side fitting hole; and wherein said second driving wheel receives the drive force from said other driving wheel and transmits said drive force to said first driving wheel.

33. An image forming apparatus according to claim 29, wherein said developing device further comprises:

a first attachment member to which said developer bearing roller is attached;

a developer supplying roller for supplying said developer to said developer bearing roller;

a second attachment member to which said developer supplying roller is attached; and a first bearing for relatively positioning said first attachment member and said second attachment member and for receiving a shaft of said developer supplying roller.

34. An image forming apparatus according to claim 29, and further comprising:

an image bearing body for bearing a latent image; and wherein the developing device is attachable to and detachable from a movable attach/detach section provided in said body of said image forming apparatus, that is for developing the latent image borne on said image bearing body in a state where said developing device is attached to said attach/detach section, and that has:

a second gear wheel that meshes with a first gear wheel provided in the body of said image forming apparatus when said developing device is in a state attached to said attach/detach section and when said developing device is moved to a predetermined position along with the movement of said attach/detach section;

a second-gear-wheel shaft that is supported on a body of said developing device by a supported section and that supports said second gear wheel; and a cover that covers a portion of said second gear wheel and that supports a section of said second-gear-wheel shaft located on a side opposite from the side of said supported section with respect to said second gear wheel.

35. An image forming system comprising:

a computer; and an image forming apparatus that is connectable to said computer and that includes:

a body of said image forming apparatus; and a developing device that has:

a developer bearing roller for bearing a developer;

a first driving wheel that is provided on an end of said developer bearing roller and that is for driving said developer bearing roller;

a second driving wheel that receives a drive force from the body of said image forming apparatus and that transmits said drive force to said first driving wheel; and a positioning member that is made of metal and that is for positioning said first driving wheel and said second driving wheel, wherein said developing device has a third driving wheel that serves as a medium when said second driving wheel transmits said drive force to said first driving wheel;

wherein, in a state where said developing device is attached to the body of said image forming apparatus, said second driving wheel receives said drive force from the body of said image forming apparatus and transmits said drive force to said first driving wheel via said third driving wheel;

wherein said third driving wheel is positioned using said positioning member;

wherein said first driving wheel, said second driving wheel, and said third driving wheel are a first driving gear wheel, a second driving gear wheel, and a third driving gear wheel, respectively;

wherein said positioning member has a first supporting section for rotatably supporting said developer bearing roller, a second supporting section for rotatably supporting said second driving gear wheel, and a third supporting section for rotatably supporting said third driving gear wheel;

wherein said second driving gear wheel supported by said second supporting section meshes with said third driving gear wheel supported by said third supporting section; and wherein said third driving gear wheel meshes with said first driving gear wheel that is provided on said developer bearing roller supported by said first supporting section.

36. An image forming system according to claim 35, wherein said positioning member comprises:

a first positioning member for positioning said first driving wheel; and a second positioning member that is for positioning said second driving wheel and that has a positioning pin for positioning said developing device with respect to the body of said image forming apparatus.

37. An image forming system according to claim 35, wherein said developing device further comprises:

a first attachment member to which said developer bearing roller is attached;

a developer supplying roller for supplying said developer to said developer bearing roller;

a second attachment member to which said developer supplying roller is attached; and a first bearing for relatively positioning said first attachment member and said second attachment member and for receiving a shaft of said developer supplying roller.

38. An image forming system according to claim 35, and further comprising:

an image bearing body for bearing a latent image; and wherein said developing device is attachable to and detachable from a movable attach/detach section provided in said body of said image forming apparatus, that is for developing the latent image borne on said image bearing body in a state where said developing device is attached to said attach/detach section, and that has:

a second gear wheel that meshes with a first gear wheel provided in the body of said image forming apparatus when said developing device is in a state attached to said attach/detach section and when said developing device is moved to a predetermined position along with the movement of said attach/detach section;

a second-gear-wheel shaft that is supported on a body of said developing device by a supported section and that supports said second gear wheel; and a cover that covers a portion of said second gear wheel and that supports a section of said second-gear-wheel shaft located on a side opposite from the side of said supported section with respect to said second gear wheel.

* * * * *